US008394745B2

(12) United States Patent
Sano et al.

(10) Patent No.: US 8,394,745 B2
(45) Date of Patent: Mar. 12, 2013

(54) LUBE BASE OIL, PROCESS FOR PRODUCTION THEREOF, AND LUBRICATING OIL COMPOSITION

(75) Inventors: Takashi Sano, Yokohama (JP); Shinichi Shirahama, Yokohama (JP); Kazuo Tagawa, Yokohama (JP); Kenichi Komiya, Yokohama (JP); Shigeki Matsui, Yokohama (JP); Osamu Kurosawa, Yokohama (JP)

(73) Assignees: Nippon Oil Corporation, Tokyo (JP); Petroleum Energy Center, Tokyo (JP)

( * ) Notice: Subject to any disclaimer, the term of this patent is extended or adjusted under 35 U.S.C. 154(b) by 316 days.

(21) Appl. No.: 12/225,764

(22) PCT Filed: Mar. 28, 2007

(86) PCT No.: PCT/JP2007/056566

§ 371 (c)(1),
(2), (4) Date: Sep. 18, 2009

(87) PCT Pub. No.: WO2007/114132

PCT Pub. Date: Oct. 11, 2007

(65) Prior Publication Data

US 2010/0041572 A1 Feb. 18, 2010

(30) Foreign Application Priority Data

| | | |
|---|---|---|
| Mar. 31, 2006 | (JP) | P2006-100175 |
| Mar. 31, 2006 | (JP) | P2006-100204 |
| Jul. 6, 2006 | (JP) | P2006-187078 |
| Jul. 6, 2006 | (JP) | P2006-187084 |
| Jul. 6, 2006 | (JP) | P2006-187087 |
| Jul. 6, 2006 | (JP) | P2006-187092 |

(51) Int. Cl.
*C10M 137/10* (2006.01)
*C10G 71/00* (2006.01)

(52) U.S. Cl. ..... 508/371; 208/18

(58) Field of Classification Search ..... 508/371; 208/18

See application file for complete search history.

(56) References Cited

U.S. PATENT DOCUMENTS

| | | | | |
|---|---|---|---|---|
| 3,923,919 | A | 12/1975 | Stearns | |
| 5,643,440 | A * | 7/1997 | Borghard et al. | 208/58 |
| 7,531,081 | B2 | 5/2009 | Daniel et al. | |
| 2003/0232937 | A1 | 12/2003 | DiMaio | |
| 2004/0077506 | A1* | 4/2004 | Arrowsmith et al. | 508/185 |
| 2006/0205610 | A1* | 9/2006 | Rosenbaum et al. | 508/110 |

FOREIGN PATENT DOCUMENTS

| | | |
|---|---|---|
| JP | 63-223094 | 9/1988 |
| JP | 1-92295 | 4/1989 |
| JP | 1-259087 | 10/1989 |
| JP | 4-36391 | 2/1992 |
| JP | 4-68082 | 3/1992 |
| JP | 4-120193 | 4/1992 |
| JP | 8-302378 | 11/1996 |
| JP | 9-3463 | 1/1997 |
| JP | 10-510565 | 10/1998 |
| JP | 2000-109875 | 4/2000 |
| JP | 2001-262176 | 9/2001 |
| JP | 2003-41283 | 2/2003 |
| JP | 2003-505533 | 2/2003 |
| JP | 2003-528169 | 9/2003 |
| JP | 2004-521976 | 7/2004 |
| JP | 2004-521977 | 7/2004 |
| JP | 2004-522848 | 7/2004 |
| JP | 2004-262979 | 9/2004 |
| JP | 2004-262980 | 9/2004 |
| JP | 2004-532328 | 10/2004 |
| JP | 2005-530902 | 10/2005 |
| JP | 2005-537383 | 12/2005 |
| JP | 2006-502295 | 1/2006 |
| JP | 2007-270059 | 10/2007 |
| JP | 2006-241436 | 9/2008 |
| WO | WO96/17092 | 6/1996 |
| WO | WO 02/064710 | 8/2002 |
| WO | WO 02/070636 | 9/2002 |
| WO | WO 2005/066319 | 7/2005 |
| WO | WO 2006/073198 A1 | 7/2006 |

OTHER PUBLICATIONS

Supplementary European Search Report dated Dec. 10, 2010.

Chinese Office Action for Chinese Counterpart Application No. 200780019801.0 dated Nov. 21, 2011.

Notification of Information Provision for Japanese Counterpart Application No. P2006-100175 issued on Jun. 26, 2012.

Peter D. Mack et al., "Severely Hydro-cracked/Hydro-isomerized Base Oils the Key to Enhanced Performance Levels", 1996 NPRA National Fuels and Lubricants Meeting, FL-96-114, Nov. 7-8, 1996, pp. 1-29.

(Continued)

*Primary Examiner* — Walter D Griffin

*Assistant Examiner* — Francis C Campanell

(74) *Attorney, Agent, or Firm* — Finnegan, Henderson, Farabow, Garrett & Dunner, LLP

(57) ABSTRACT

The present invention provides a lubricating base oil comprising saturated components of 90% by mass or greater, wherein the proportion of cyclic saturated components among the saturated components is not greater than 40% by mass, and by having a viscosity index of 110 or higher and an iodine value of not greater than 2.5. The lubricating base oil of the invention exhibits excellent viscosity-temperature characteristics and heat and oxidation stability while also allowing additives to exhibit a higher level of function when additives are included. The lubricating base oil of the invention is suitable for use in various lubricating oil fields, and is especially useful for reducing energy loss and achieving energy savings in devices in which the lubricating base oil is applied.

11 Claims, No Drawings

OTHER PUBLICATIONS

Vincenzo Calemma et al., "Hydroisomerization of Slack Wax Over Pt/Amorphous $SiO_2$-$Al_2O_3$ Catalyst to Produce Very High Viscosity Index Lubricating Base Oils,"Presented before the Division of Petroleum Chemistry, Inc., 218$^{th}$ National Meeting, American Chemical Society, New Orleans, LA, Aug. 22-26, pp. 241-244, 1999.
Tetsuo Takito et al., "Manufacturing Process and Properties of High-Viscosity Index Base Oil", Mitsubishi Oil Technical Reference No. 80, Feb. 18, 1993, pp. 80-87.
Jinichi Igarashi, "Current Situation and Future Trends in Lubricant Base oils", The Tribology, No. 61, Sep. 10, 1992, pp. 19-25.
"Technique of High-Quality Lubricant Base Oil Dealing with Environmental Problems and International Market Trend Report", Petroleum Energy Center (PEC), PEC-2000T-32, Mar. 2001, p. 18.
Minoru Kibukawa, "Base Oils with High Viscosity Index", The Tribologist, vol. 41, No. 3, 1996, pp. 203-208.
Japanese Office Action for Japanese Counterpart Application No. P2006-187092 issued Jul. 24, 2012.
Takanori Kugimiya, "Effects of Additives of ATF and Components of Friction Material for AT on μ-y Characteristics", The Tribologist, vol. 45, No. 5, 2000, pp. 387-395, Abstract.
Notification of Information Provision for Japanese Counterpart Application No. P2006-187092 issued on Jul. 10, 2012.
Partial translation of Tetsuo Takito et al., "Manufacturing Process and Properties of High-Viscosity Index Base Oil", Mitsubishi Oil Technical Reference No. 80, Feb. 18, 1993, pp. 80-87.
Partial translation of Jinichi Igarashi, "Current Situation and Future Trends in Lubricant Base Oils", The Tribology, No. 61, Sep. 10, 1992, pp. 19-25.
Partial translation of"Technique of High-Quality Lubricant Base Oil Dealing with Environmental Problems and International Market Trend Report", Petroleum Energy Center (PEC), PEC-2000T-32, Mar. 2001, p. 18.
Partial translation of Minoru Kibukawa, "Base Oils with High Viscosity Index", The Tribologist, vol. 41, No. 3, 1996, pp. 203-208.

* cited by examiner

LUBE BASE OIL, PROCESS FOR PRODUCTION THEREOF, AND LUBRICATING OIL COMPOSITION

CROSS-REFERENCE TO RELATED APPLICATIONS

This application is a national phase application of International Application No. PCT/JP2007/056566, filed Mar. 28, 2007, and claims the priority of Japanese Application Nos. 2006-100175, filed Mar. 31, 2006; 2006-100204, filed Mar. 31, 2006; 2006-187078, filed Jul. 6, 2006; 2006-187084, filed Jul. 6, 2006; 2006-187087, filed Jul. 6, 2006; and 2006-187092, filed Jul. 6, 2006, the contents of all of which are incorporated herein by reference.

TECHNICAL FIELD

The present invention relates to a lubricating base oil and a process for its production, and to a lubricating oil composition, a lubricating oil composition for an internal combustion engine, a lubricating oil composition for a wet clutch and a lubricating oil composition for a drive-train.

BACKGROUND ART

In the field of lubricating oils, additives have been added to lubricating base oils such as highly refined mineral oils, to improve the properties such as the viscosity-temperature characteristics or heat and oxidation stability of the lubricating oils (for example, see Patent documents 1-9).

For example, lubricating oils used in internal combustion engines such as automobile engines require heat and oxidation stability that allows them to withstand harsh conditions for prolonged periods. In order to ensure heat and oxidation stability for conventional internal combustion engine lubricating oils, it is common to use highly refined base oils such as hydrocracked mineral oils or high performance base oils such as synthetic oils, with addition of peroxide-decomposable sulfur-containing compounds such as zinc dithiophosphate (ZDTP), molybdenum dithiocarbamate (MoDTC), or ashless antioxidants such as phenol-based or amine-based antioxidants to the base oils.

In motorcycles with 4-stroke internal combustion engines, on the other hand, lubrication of the internal combustion engine, transmission and wet clutch is accomplished using the same lubricating oil. The lubricating oil used, therefore, must exhibit properties suitable for lubrication of transmissions and wet clutches, in addition to the performance generally required as an automobile lubricating oil. For this reason it is not desirable to apply lubricating oils for four-wheeled vehicles directly as lubricating oils for such motorcycles, and therefore research is being conducted toward developing lubricating oils suitable for 4-stroke internal combustion engines for motorcycles (see Patent document 7, for example).

With the recent emphasis on environmental issues including reduction of carbon dioxide gas emissions, the goal of reducing energy consumption (fuel efficient) in automobiles, construction equipment, agricultural machinery and the like has become a matter of urgency, and it is highly desirable for drive-trains such as gearboxes and final reduction gears to help contribute to reduced energy consumption. Fuel efficiency of drive-trains can be achieved by methods that lower the viscosity of the lubricating oil to reduce stirring resistance and friction resistance against the sliding surfaces. For example, gearboxes used as automobile automatic transmissions or continuously variable transmissions comprise a torque converter, wet clutch, gear bearing mechanism, oil pump, overpressure control mechanism and the like, while manual transmissions and final reduction gears include a gear bearing mechanism, and by reducing the viscosity of the lubricating oils used therein to lower stirring resistance and friction resistance, it is possible to improve power transmission efficiency and achieve fuel savings. However, reducing the viscosity of the lubricating oil also results in lower lubricity (wear resistance, prevention of seizure properties, fatigue life, etc.), which is disadvantageous for gearboxes. Also, addition of phosphorus-based extreme-pressure agents to guarantee wear resistance for lubricating oils with reduced viscosity can significantly shorten the fatigue life. In addition, while sulfur-based extreme-pressure agents are effective for improving fatigue life, it is generally known that the effect of the lubricating base oil viscosity in low viscosity lubricating base oils is greater than that of the additives. One strategy for ensuring lubricity when lowering the viscosity of lubricating oils for increased fuel efficiency has been to optimize the combinations of phosphorus-based extreme-pressure agents and sulfur-based extreme-pressure agents added to lubricating base oils (for example, see Patent documents 8 and 9).

[Patent document 1] Japanese Unexamined Patent Publication HEI No. 4-36391

[Patent document 2] Japanese Unexamined Patent Publication SHO No. 63-223094

[Patent document 3] Japanese Unexamined Patent Publication HEI No. 8-302378

[Patent document 4] Japanese Unexamined Patent Publication HEI No. 9-003463

[Patent document 5] Japanese Unexamined Patent Publication HEI No. 4-68082

[Patent document 6] Japanese Unexamined Patent Publication HEI No. 4-120193

[Patent document 7] Japanese Unexamined Patent Publication No. 2003-41283

[Patent document 8] Japanese Unexamined Patent Publication No. 2004-262979

[Patent document 9] Japanese Unexamined Patent Publication No. 2004-262980

DISCLOSURE OF THE INVENTION

Problems to be Solved by the Invention

With the ever increasing demand for improved properties of lubricating oils in recent years, the conventional lubricating base oils described in Patent documents 1-9 are often less than satisfactory in terms of viscosity-temperature characteristic and heat and oxidation stability. Moreover, only limited improvement in properties can be achieved by addition of additives to conventional lubricating base oils.

The present invention has been accomplished in light of these circumstances, and its object is to provide a lubricating base oil that exhibits excellent viscosity-temperature characteristics and heat and oxidation stability while also allowing additives to exhibit a higher level of function when additives are included, as well as a process for its production, and a lubricating oil composition.

Means for Solving the Problems

In order to solve the problems described above, the invention provides a lubricating base oil characterized by comprising saturated components of 90% by mass or greater, wherein the proportion of cyclic saturated components among the saturated components is not greater than 40% by mass, and having a viscosity index of 110 or higher and an iodine value of not greater than 2.5 (hereinafter referred to as "first lubricating base oil" for convenience).

The first lubricating base oil, which satisfies the conditions for the saturated component content, the proportion of cyclic saturated components among the saturated components, the viscosity index and the iodine value, exhibits excellence in terms of viscosity-temperature characteristic and heat and oxidation stability. When additives are included in the lubricating base oil, it is possible to achieve a high level of function for the additives while maintaining sufficiently stable dissolution of the additives in the lubricating base oil.

In addition, the first lubricating base oil can reduce viscous resistance and stirring resistance in a practical temperature range due to its superior viscosity-temperature characteristic, and when friction modifiers or the like are added their effects are maximally exhibited. Consequently, the first lubricating base oil is highly useful for reducing energy loss and achieving energy savings in devices in which the lubricating base oil is applied.

The mass ratio of monocyclic saturated components and bicyclic or greater saturated components among the cyclic saturated components in the first lubricating base oil preferably satisfies the condition represented by the following inequality (1):

$$M_A/M_B \leqq 3 \quad (1)$$

Wherein $M_A$ represents the mass of monocyclic saturated components and $M_B$ represents the mass of bicyclic or greater saturated components.

Also, the proportion of bicyclic or greater saturated components among the saturated components in the first lubricating base oil is preferably 0.1% by mass or greater.

The first lubricating base oil also preferably has an aromatic content of 0.1-7% by mass.

Preferably, the first lubricating base oil has a kinematic viscosity at 100° C. of 3.5-6 $mm^2/s$, a viscosity index of 130 or higher and a freezing point of no higher than −25° C.

The invention further provides a lubricating base oil characterized by having a kinematic viscosity at 100° C. of 3.5-6 $mm^2/s$, a viscosity index of 130 or higher and a freezing point of not higher than −25° C. (hereinafter referred to as "second lubricating base oil" for convenience).

The second lubricating base oil, which satisfies the conditions for the kinematic viscosity at 100° C., viscosity index and freezing point, exhibits excellence in terms of viscosity-temperature characteristic and heat and oxidation stability. With the second lubricating base oil it is possible to achieve both a high viscosity index of 135 or higher and low temperature viscosity at −35° C. or lower, and in particular it allows the MRV viscosity at −40° C. to be significantly reduced. When additives are included in the second lubricating base oil, it is possible to achieve a high level of function for the additives while maintaining sufficiently stable dissolution of the additives in the lubricating base oil.

In addition, the second lubricating base oil can reduce viscous resistance and stirring resistance in a practical temperature range due to its superior viscosity-temperature characteristic, and when friction modifiers or the like are added their effects are maximally exhibited. Consequently, the second lubricating base oil is highly useful for reducing energy loss and achieving energy savings in devices in which the lubricating base oil is applied.

With the ever increasing demand for improved properties of lubricating oils in recent years, the conventional lubricating base oils described in Patent documents 1-9 are often less than satisfactory in terms of viscosity-temperature characteristic and heat and oxidation stability. Particularly for SAE10 class lubricating base oils or lubricating oil compositions containing them as the major components, it has been difficult to achieve a high level for both a high viscosity index and low temperature viscosity at −35° C. or lower (CCS viscosity, MRV viscosity, BF viscosity and the like), and it has therefore been necessary to use them in combination with lubricating base oils that exhibit excellent low temperature viscosity, such as synthetic oils such as a poly-α-olefinic base oils or esteric base oils, or low-viscosity mineral oil based base oils. Such synthetic oils are expensive, however, while low-viscosity mineral oil based base oils generally have low viscosity indexes and high NOACK evaporation amount, such that addition of such lubricating base oils increases production costs for lubricating oils and makes it difficult to achieve a high viscosity index and low evaporation properties. Moreover, only limited improvement in properties can be achieved by addition of additives to conventional lubricating base oils.

The first and second lubricating base oils described above, however, are lubricating base oils with excellent viscosity-temperature characteristics and heat and oxidation stability, and allow both a high viscosity index and low temperature viscosity −35° C. or lower to be achieved without using synthetic oils such as esteric base oils or poly-α-olefinic base oils or low-viscosity mineral oil based base oils, and in particular they allow the MRV viscosity at −40° C. of lubricating oils to be significantly improved.

The invention still further provides a process for production of a lubricating base oil having a kinematic viscosity at 100° C. of 3.5-6 $mm^2/s$ and a viscosity index of 130 or higher, and the process is characterized by including dewaxing treatment to allow a freezing point of to be not higher than −25° C.

By thus carrying out dewaxing treatment of the lubricating base oil to a freezing point of no higher than −25° C., it is possible to effectively obtain a lubricating base oil with an excellent viscosity-temperature characteristic and heat and oxidation stability, whereby both a high viscosity index and low temperature viscosity at −35° C. or lower can be achieved without using synthetic oils such as esteric base oils or poly-α-olefinic base oils or low-viscosity mineral oil based base oils, and particularly the MRV viscosity at −40° C. of lubricating oils can be significantly improved.

The invention still further provides a lubricating oil composition characterized by comprising the aforementioned first or second lubricating base oil, and by having a MRV viscosity at −40° C. of not greater than 20,000 mPa·s.

By including the first or second lubricating base oil exhibiting the aforementioned excellent performance, the lubricating oil composition of the invention can achieve high levels of both viscosity-temperature characteristic and heat and oxidation stability, and allow both a high viscosity index and low temperature viscosity at −35° C. or lower to be achieved without using synthetic oils such as esteric base oils or poly-α-olefinic base oils or low-viscosity mineral oil based base oils. As a result, it is possible to effectively realize low-temperature performance with a MRV viscosity at −40° C. of not greater than 20,000 mPa·s, which has been difficult to achieve with conventional lubricating oils.

The invention still further provides a lubricating oil composition for an internal combustion engine characterized by comprising the aforementioned first or second lubricating base oil, a phosphorus-based anti-wear agent of 0.02-0.08% by mass in terms of phosphorus element, an ashless antioxidant of 0.5-3% by mass and an ashless dispersant of 3-12% by mass, based on the total amount of the composition (hereinafter referred to as "first lubricating oil composition for an internal combustion engine" for convenience).

The first or second lubricating base oil in the first lubricating oil composition for an internal combustion engine will itself exhibit excellent heat and oxidation stability. When the first or second lubricating base oil includes additives, it can exhibit a high level of function by the additives while also maintaining stable dissolution of the additives. Furthermore, by adding a phosphorus-based anti-wear agent (hereinafter also referred to as "component (A-1)"), an ashless antioxidant (hereinafter also referred to as "component (B-1)") and an ashless dispersant (hereinafter also referred to as "component (C-1)") in their respective specified ranges to the lubricating base oil having the aforementioned excellent properties, it is possible to achieve a sufficiently long oxidation life while maintaining adequate performance of exhaust gas aftertreatment devices for long periods.

The first or second lubricating base oil in the first composition for an internal combustion engine will itself exhibit excellent viscosity-temperature characteristics and frictional properties. Moreover, the first or second lubricating base oil whose additives have excellent solubility and efficacy as described above permits a high level of friction reducing effect to be obtained when a friction modifier is added. Consequently, a first lubricating oil composition for an internal combustion engine containing such an excellent lubricating base oil results in reduced energy loss due to friction resistance or stirring resistance at sliding sections, and can therefore provide adequate energy savings.

It has been difficult to achieve both improvement in the low-temperature viscosity characteristic while ensuring low volatility when using conventional lubricating base oils, but the lubricating base oil of the invention can achieve a satisfactory balance with high levels of both the low-temperature viscosity characteristic and low volatility. The lubricating oil composition for an internal combustion engine according to the invention is also useful for improving the cold startability, in addition to the improvement in oxidation life, maintenance of exhaust gas aftertreatment device performance and energy savings for internal combustion engines.

Exhaust gas aftertreatment devices such as three-way catalysts and particulate filters are mounted in vehicles with internal combustion engines for the purpose of purifying and collecting hazardous substances in exhaust gas such as sulfur oxides and particulate matter, but using conventional lubricating oils often results in their partial infiltration into the combustion chamber, their combustion products are mixed into the exhaust gas and reduce the performance of the exhaust gas aftertreatment devices. Zinc alkyldithiophosphates have notably negative effects because they contain the elements phosphorus and zinc, with the phosphorus component poisoning three-way catalysts and the zinc component being converted to the sulfated ash and blocking the filter. Possible methods for preventing loss of performance of exhaust gas aftertreatment devices include reducing the phosphorus-based anti-wear agent contents of lubricating oils for internal combustion engines. With conventional lubricating oils, however, reducing additives that have also function as antioxidants such as zinc alkyldithiophosphate, results in undesirable problems from the viewpoint of environmental conservation such as increase in the amount of waste oil by shortening of the oil renewal period due to reduction in the oxidation life of the lubricating oil.

Since the first lubricating oil composition for an internal combustion engine exhibits the excellent performance described above, it can be suitably used as a lubricating oil for internal combustion engines in vehicles with exhaust gas aftertreatment devices. The sulfated ash content of the lubricating oil composition for an internal combustion engine of the invention is preferably limited to not greater than 1.2% by mass in order to maintain the performance of exhaust gas aftertreatment devices for prolonged periods.

The invention still further provides a lubricating oil composition for an internal combustion engine characterized by comprising the aforementioned first or second lubricating base oil, an ashless antioxidant containing no sulfur as a constituent element, and at least one compound selected from among ashless antioxidants containing sulfur as a constituent element and organic molybdenum compounds (hereinafter referred to as "second lubricating oil composition for an internal combustion engine" for convenience).

The first or second lubricating base oil in the second lubricating oil composition for an internal combustion engine will itself exhibit excellent heat and oxidation stability and low volatility. When the first or second lubricating base oil includes additives, it can exhibit a high level of function for the additives while maintaining stable dissolution of the additives. Moreover, by adding both an ashless antioxidant containing no sulfur as a constituent element (hereinafter also referred to as "component (A-2)") and at least one compound selected from among ashless antioxidants containing sulfur as a constituent element and organic molybdenum compounds (hereinafter also referred to as "component (B-2)") to the lubricating base oil having such excellent properties, it is possible to maximize the effect of improved heat and oxidation stability by synergistic action of components (A-2) and (B-2). The second lubricating oil composition for an internal combustion engine according to the invention therefore allows a sufficient long drain property to be achieved.

The first or second lubricating base oil in the second composition for an internal combustion engine will itself exhibit excellent viscosity-temperature characteristics and functional properties. Moreover, the first or second lubricating base oil whose additives have excellent solubility and efficacy as described above permits a high level of friction reducing effect to be obtained when a friction modifier is added. Consequently, the second lubricating oil composition for an internal combustion engine according to the invention containing such an excellent lubricating base oil results in reduced energy loss due to friction resistance or stirring resistance at sliding sections, and can therefore provide adequate energy savings.

It has been difficult to achieve both improvement in the low-temperature viscosity characteristic while ensuring low volatility when using conventional lubricating base oils, but the first or second lubricating base oil can achieve a satisfactory balance with high levels of both the low-temperature viscosity characteristic and low volatility. The second lubricating oil composition for an internal combustion engine according to the invention is also useful for improving the cold startability, in addition to the long drain property and energy savings for internal combustion engines.

The first or second lubricating base oil in the second lubricating oil composition for an internal combustion engine also preferably has an aromatic content of 0.1-5% by mass.

The invention still further provides a lubricating oil composition for a wet clutch, characterized by comprising the aforementioned first or second lubricating base oil, an ashless antioxidant at 0.5-3% by mass and an ashless dispersant at 3-12% by mass, based on the total amount of the composition.

The first or second lubricating base oil in the lubricating oil composition for a wet clutch of the invention will itself exhibit excellent heat and oxidation stability, viscosity-temperature characteristics and frictional properties. When the lubricating base oil includes additives, it can exhibit a high level of function for the additives while maintaining stable dissolution of the additives. Furthermore, by adding an ashless antioxidant (hereinafter also referred to as "component (A-3)") and an ashless dispersant (hereinafter also referred to as "component (B-3)") in their respective specified ranges to the first or second lubricating base oil having the aforementioned excellent properties, it is possible to inhibit production of insoluble components such as sludge and varnish caused by deterioration, and the clogging of wet clutches that occurs as a result of the insoluble components, even when using a 4-stroke internal combustion engine for a motorcycle, thus allowing the wet clutch frictional properties and power transmission performance to be adequately maintained for long periods.

With conventional lubricating oils, it has not been possible to sufficiently inhibit production of insoluble components such as varnish or sludge caused by deterioration of the lubricating oils in 4-stroke internal combustion engines for motorcycles, which subject the lubricating oils to extremely harsh conditions of use including contact of the lubricating oils with combustion gases such as nitrogen oxides, and as a result, the heat and oxidation stability has been unsatisfactory. Production of insoluble components by deterioration of lubricating oil causes clogging of the pores of porous materials commonly used as friction materials in wet clutches, and can risk impairing the frictional properties or reducing the power transmitting performance in wet clutches.

The present invention still further provides a lubricating oil composition for a drive-train characterized by comprising the aforementioned first or second lubricating base oil, a poly (meth)acrylate-based viscosity index improver and a phosphorus-containing compound.

The first or second lubricating base oil in the lubricating oil composition for a drive-train according to the invention exhibits superior viscosity-temperature characteristics, heat and oxidation stability and frictional properties compared to those of conventional lubricating base oils of the same viscosity grade. When the first or second lubricating base oil includes additives, it can exhibit a high level of function for the additives while maintaining stable dissolution of the additives. Furthermore, by adding a poly(meth)acrylate-based viscosity index improver (hereinafter also referred to as "component (A-4)") and a phosphorus-containing compound (hereinafter also referred to as "component (B-4)") to the lubricating base oil having such superior properties, their synergistic action can maximize the effects of improved wear resistance, frictional properties, anti-seizing property and fatigue life, as well as the effect of improved shear stability, even when the viscosity is reduced. The lubricating oil composition for a drive-train according to the invention can therefore provide drive-trains with both increased fuel efficiency and durability.

It has been difficult to achieve both improvement in the low-temperature viscosity characteristic while ensuring low volatility when using conventional lubricating base oils, but the lubricating base oil of the invention can achieve a satisfactory balance with high levels of both low-temperature viscosity characteristic and low volatility. A lubricating oil composition for a drive unit according to the invention is therefore useful not only for achieving both fuel savings and durability for drive-trains, but also for improving the cold startability.

Also, the proportion of bicyclic or greater saturated components among the saturated components in the first or second lubricating base oil used in the lubricating oil composition for a drive transmission according to the invention is preferably 3% by mass or greater.

The first or second lubricating base oil in the lubricating oil composition for a drive transmission according to the invention also preferably has an aromatic content of 0.1-5% by mass.

Effect of the Invention

According to the invention there is provided a lubricating base oil that exhibits excellent viscosity-temperature characteristics and heat and oxidation stability while also allowing additives to exhibit a higher level of function when additives are included. The lubricating base oil of the invention is suitable for use in various lubricating oil fields, and is especially useful for reducing energy loss and achieving energy savings in devices in which the lubricating base oil is applied.

Also according to the invention, high levels of both viscosity-temperature characteristics and heat and oxidation stability are obtained, and a lubricating base oil and lubricating oil composition are provided that allow both a high viscosity index and low temperature viscosity at −35° C. or lower to be achieved without using synthetic oils such as esteric base oils or poly-α-olefinic base oils or low-viscosity mineral oil based base oils, and in particular that allow the MRV viscosity at −40° C. of lubricating oils to be significantly improved. According to the process for production of a lubricating base oil of the invention it is possible to effectively obtain a lubricating base oil of the invention having the excellent performance described above.

Also according to the invention, a lubricating oil composition for an internal combustion engine is realized that has a sufficiently long oxidation life and allows the performance of exhaust gas aftertreatment devices to be adequately maintained for long periods.

The invention, in addition, realizes a lubricating oil composition for an internal combustion engine with superior heat and oxidation stability, and also excellence in terms of viscosity-temperature characteristic, frictional properties and low volatility. Moreover, when the lubricating oil composition for an internal combustion engine according to the invention is applied to an internal combustion engine, it provides a long drain property and increases energy efficiency while also improving the cold startability.

The invention yet further provides a lubricating oil composition for a wet clutch whereby it is possible to inhibit production of insoluble components such as sludge and varnish caused by deterioration, and the clogging of wet clutches that occurs as a result of the insoluble components, even when using a 4-stroke internal combustion engine for a motorcycle, thus allowing the wet clutch frictional properties and power transmitting performance to be adequately maintained for long periods.

The invention still further realizes a lubricating oil composition for a drive-train that can exhibit high levels of wear resistance, anti-seizing property and fatigue life for prolonged periods even with reduced viscosity. By using a lubricating oil composition for a drive-train according to the invention it is possible to achieve both fuel savings and durability for drive-trains, while also improving the cold startability.

BEST MODE FOR CARRYING OUT THE INVENTION

Preferred embodiments of the invention will now be described in detail.

First Embodiment

The lubricating base oil according to a first embodiment of the invention is characterized by comprising saturated components of 90% by mass or greater, wherein the proportion of cyclic saturated components among the saturated components is not greater than 40% by mass, the viscosity index is 110 or higher and the iodine value is not greater than 2.5.

The lubricating base oil according to the first embodiment is not particularly restricted so long as the saturated component content, the proportion of cyclic saturated components among the saturated components and the viscosity index and the iodine value satisfy the conditions specified above. Specifically, there may be mentioned purified paraffinic mineral oils obtained by subjecting a lube-oil distillate, obtained by atmospheric distillation and/or vacuum distillation of crude oil, to a single treatment or two or more treatments from among refining treatments such as solvent deasphalting, solvent extraction, hydrocracking, solvent dewaxing, catalytic dewaxing, hydrorefining, sulfuric acid treatment or white clay treatment, or normal paraffin base oils, isoparaffinic base oils and the like, which satisfy the aforementioned conditions for the saturated components content, the proportion of cyclic saturated components among the saturated components and the viscosity index and iodine value. These lubricating base oils may be used alone or in combinations of two or more.

As a preferred example for the lubricating base oil of the first embodiment there may be mentioned a base oil obtained by using one of the base oils (1)-(8) mentioned below as the starting material and purifying this feedstock oil and/or the lube-oil distillate recovered from the feedstock oil by a prescribed refining process, and recovering the lube-oil distillate.

(1) Distilled oil from atmospheric distillation of a paraffinic crude oil and/or mixed-base crude oil.
(2) Distilled oil from vacuum distillation of the residue from atmospheric distillation of a paraffinic crude oil and/or mixed-base crude oil (WVGO).
(3) Wax obtained by a lubricating oil dewaxing step (slack wax or the like) and/or synthetic wax obtained by a gas-to-liquid (GTL) process (Fischer-Tropsch wax, GTL wax or the like).
(4) Blended oil comprising one or more selected from among base oils (1)-(3) and/or mildly hydrocracked oil obtained from the blended oil.
(5) Blended oil comprising two or more selected from among base oils (1)-(4).
(6) Deasphalted oil (DAO) from base oil (1), (2), (3), (4) or (5).
(7) Mild-hydrocracked oil (MHC) obtained from base oil (6).
(8) Blended oil comprising two or more selected from among base oils (1)-(7).

The prescribed refining process described above is preferably hydrorefining such as hydrocracking or hydrofinishing; solvent refining such as further solvent extraction; dewaxing such as solvent dewaxing or catalytic dewaxing; white clay refining with acidic white clay or active white clay, or chemical (acid or alkali) washing such as sulfuric acid treatment or caustic soda washing. According to the invention, any one of these refining processes may be used alone, or a combination of two or more thereof may be used in combination. When a combination of two or more refining processes is used, their order is not particularly restricted and may be selected as appropriate.

The lubricating base oil of the first embodiment is most preferably one of the following base oils (9) or (10) obtained by the prescribed treatment of a base oil selected from among base oils (1)-(8) above or a lube-oil distillate recovered from the base oil.

(9) Hydrocracked mineral oil obtained by hydrocracking of a base oil selected from among base oils (1)-(8) above or a lube-oil distillate recovered from the base oil, dewaxing treatment such as solvent dewaxing or catalytic dewaxing of the product or a lube-oil distillate recovered from distillation of the product, or further distillation after the dewaxing treatment.
(10) Hydroisomerized mineral oil obtained by hydroisomerization of a base oil selected from among base oils (1)-(8) above or a lube-oil distillate recovered from the base oil, and dewaxing treatment such as solvent dewaxing or catalytic dewaxing of the product or a lube-oil distillate recovered from distillation of the product, or further distillation after the dewaxing treatment.

In obtaining the lubricating base oil of (9) or (10) above, a solvent refining treatment and/or hydrofinishing treatment step may also be carried out by convenient steps if necessary.

There are no particular restrictions on the catalyst used for the hydrocracking and hydroisomerization, but there are preferably used hydrocracking catalysts comprising a hydrogenating metal (for example, one or more metals of Group VIa or metals of Group VIII of the Periodic Table) supported on a support which is a complex oxide with decomposing activity (for example, silica-alumina, alumina-boria, silica-zirconia or the like) or a combination of one or more of such complex oxides bound with a binder, or hydroisomerization catalysts obtained by supporting one or more metals of Group VIII having hydrogenating activity on a support comprising zeolite (for example, ZSM-5, zeolite beta, SAPO-11 or the like). The hydrocracking catalyst or hydroisomerization catalyst may be used as a combination of layers or a mixture.

The reaction conditions for hydrocracking and hydroisomerization are not particularly restricted, but preferably the hydrogen partial pressure is 0.1-20 MPa, the mean reaction temperature is 150-450° C., the LHSV is 0.1-3.0 $hr^{-1}$ and the hydrogen/oil ratio is 50-20,000 scf/b.

The following production process A may be mentioned as a preferred example of a production process for the lubricating base oil of the first embodiment.

Specifically, production process A according to the invention comprises:

a first step of preparing a hydrocracking catalyst comprising a support having the percentage of $NH_3$ desorption amount at 300-800° C. of not greater than 80% with respect to the total $NH_3$ desorption amount, based on $NH_3$ desorption temperature dependence evaluation, and at least one metal among metals of Group VIa and at least one metal among metals of Group VIII of the Periodic Table supported on the support, a second step of hydrocracking of a feedstock oil comprising 50% by volume or greater slack wax in the presence of a hydrocracking catalyst, at a hydrogen partial pressure of 0.1-14 MPa, a mean reaction temperature of 230-430° C., an LHSV of 0.3-3.0 $hr^{-1}$ and a hydrogen/oil ratio of 50-14,000 scf/b, a third step of distilling separation of the cracked product oil obtained in the second step to obtain a lube-oil distillate, and a fourth step of dewaxing treatment of the lube-oil distillate obtained in third step.

Production process A will now be explained in detail.

(Feedstock Oil)

For production process A, a feedstock oil comprising 50% by volume or greater slack wax is used. The phrase "feedstock oil comprising 50% by volume or greater slack wax" according to the invention refers to both feedstock oils composed entirely of slack wax, and feedstock oil that is a blended oil of slack wax and another feedstock oil, and comprises 50% by volume or greater slack wax.

Slack wax is the wax-containing component as a by-product of the solvent dewaxing step during production of a lubricating base oil from a paraffinic lube-oil distillate, and according to the invention the term includes slack wax obtained by further subjecting the wax-containing component to deoiling treatment. The major components of slack wax are n-paraffins and branched paraffins with few side chains (isoparaffins), and the naphthene and aromatic contents are low. The kinematic viscosity of the slack wax used for preparation of the feedstock oil may be selected as appropriate for the kinematic viscosity desired for the lubricating base oil, but for production of a low-viscosity base oil as a lubricating base oil for the first embodiment, a relatively low viscosity slack wax is preferred, with a kinematic viscosity at 100° C. of about 2-25 $mm^2/s$, preferably about 2.5-20 $mm^2/s$ and more preferably about 3-15 $mm^2/s$. The other properties of the slack wax may be as desired, although the melting point is preferably 35-80° C., more preferably 45-70° C. and even more preferably 50-60° C. The oil content of the slack wax is preferably not greater than by mass, more preferably not greater than 50% by mass, even more preferably not greater than 25% by mass and most preferably not greater than 10% by mass, and preferably 0.5% by mass or greater and more preferably 1% by mass or greater. The sulfur content of the slack wax is preferably not greater than 1% by mass and more preferably not greater than 0.5% by mass, and preferably 0.001% by mass or greater.

The oil content of the thoroughly deoiled slack wax (hereinafter referred to as "slack wax A") is preferably 0.5-10% by mass and more preferably 1-8% by mass. The sulfur content of slack wax A is preferably 0.001-0.2% by mass, more preferably 0.01-0.15% by mass and even more preferably 0.05-0.12% by mass. However, the oil content of slack wax that has either not been subjected to deoiling treatment or has been subjected only to incomplete deoiling treatment (hereinafter, "slack wax B") is preferably 10-60% by mass, more preferably 12-50% by mass and even more preferably 15-25% by mass. The sulfur content of slack wax B is preferably 0.05-1% by mass, more preferably 0.1-0.5% by mass and even more preferably 0.15-0.25% by mass. These slack waxes A and B may be subjected to desulfurization treatment depending on the type and properties of the hydrocracking/isomerization catalyst, and the sulfur content in such cases is preferably not greater than 0.01% by mass and more preferably not greater than 0.001% by mass.

By using slack wax A as a starting material for production process A, it is possible to satisfactorily obtain a lubricating base oil according to the first embodiment, wherein the saturated component content, the proportion of cyclic saturated components among the saturated components, the viscosity index and iodine value satisfy the conditions specified above. Also, production process A can yield a lubricating base oil with high added value, a high viscosity index and excellent low-temperature characteristics and heat and oxidation stability, even when an inexpensive slack wax B with a relatively high oil or sulfur content and relatively inferior quality is used as the starting material.

When the feedstock oil is a blended oil comprising slack wax and another feedstock oil, the feedstock oils are not particularly restricted so long as the proportion of slack wax in the total blended oil is 50% by volume or greater, but it is preferred to use a blended oil comprising a heavy atmospheric distilled oil and/or vacuum distilled oil obtained from crude oil.

When the feedstock oil is a blended oil comprising slack wax and another feedstock oil, the proportion of slack wax in the blended oil is more preferably 70% by volume or greater and even more preferably 75% by volume or greater from the viewpoint of production of a base oil with a high viscosity index. If the proportion is less than 50% by volume, the oil content including the aromatic and naphthene contents of the obtained lubricating base oil will be increased, thus tending to lower the viscosity index of the lubricating base oil.

On the other hand, in order to maintain a high viscosity index of the lubricating base oil, preferably the heavy atmospheric distilled oil and/or vacuum distilled oil from the crude oil, used in combination with the slack wax, is a fraction with a run-off of 60% by volume or greater in a distillation temperature range of 300-570° C.

(Hydrocracking Catalyst)

The hydrocracking catalyst used in production process A described above comprises at least one metal from among metals of Group VIa and at least one metal from among metals of Group VIII of the Periodic Table, supported on a support with the percentage of an $NH_3$ desorption amount at 300-800° C. with respect to the total $NH_3$ desorption amount of not greater than 80%, based on $NH_3$ desorption temperature dependence evaluation.

The "$NH_3$ desorption temperature dependence evaluation" referred to here is the method described in the literature (Sawa M., Niwa M., Murakami Y., Zeolites 1990, 10, 532; Karge H. G., Dondur V., J. Phys. Chem. 1990, 94, 765 and elsewhere), and it is carried out as follows. First, the catalyst support is pretreated under a nitrogen stream for 30 minutes or longer at a temperature of 400° C. or higher to remove the adsorbed molecules, and then adsorption is carried out at 100° C. until neutralization of the $NH_3$. Next, the temperature of the catalyst support is raised to 100-800° C. at a temperature-elevating rate of 10° C./min or less for $NH_3$ desorption, and the $NH_3$ separated by desorption is monitored at each prescribed temperature. The percentage of $NH_3$ desorption amount at 300° C.-800° C. with respect to the total $NH_3$ desorption amount (desorption amount at 100-800° C.) is then calculated.

The catalyst support used for production process A has an $NH_3$ desorption percentage at 300-800° C. of not greater than 80% with respect to the total $NH_3$ desorption amount based on $NH_3$ desorption temperature dependence evaluation, and it is preferably not greater than 70% and more preferably not greater than 60%. By using such a support to construct the hydrocracking catalyst, acidic substances that govern the cracking activity are sufficiently inhibited, so that it is possible to efficiently and reliably produce isoparaffins by decomposing isomerization of high-molecular-weight n-paraffins that derive from the slack wax in the feedstock oil by hydrocracking, and to satisfactorily inhibit excess cracking of the produced isoparaffin compounds. As a result, it is possible to obtain a sufficient amount of molecules with a high viscosity index having a suitably branched chemical structure, within a suitable molecular weight range.

As such supports there are preferred two-element oxides which are amorphous and acidic, and as examples there may be mentioned the two-element oxides cited in the literature (for example, "Metal Oxides and Their Catalytic Functions", Shimizu, T., Kodansha, 1978).

Preferred among these are amorphous complex oxides that contain acidic two-element oxides obtained as complexes of two oxides of elements selected from among Al, B, Ba, Bi, Cd, Ga, La, Mg, Si, Ti, W, Y, Zn and Zr. The proportion of each oxide in such acidic two-element oxides can be adjusted to obtain an acidic support suitable for the purpose in the aforementioned $NH_3$ adsorption/desorption evaluation. The acidic two-element oxide composing the support may be any one of the above, or a mixture of two or more thereof The support may also be composed of the aforementioned acidic two-element oxide, or it may be a support obtained by binding the acidic two-element oxide with a binder.

The support is preferably one containing at least one acidic two-element oxide selected from among amorphous silica-alumina, amorphous silica-zirconia, amorphous silica-magnesia, amorphous silica-titania, amorphous silica-boria, amorphous alumina-zirconia, amorphous alumina-magnesia, amorphous alumina-titania, amorphous alumina-boria, amorphous zirconia-magnesia, amorphous zirconia-titania, amorphous zirconia-boria, amorphous magnesia-titania, amorphous magnesia-boria and amorphous titania-boria. The acidic two-element oxide composing the support may be any one of the above, or a mixture of two or more thereof. The support may also be composed of the aforementioned acidic two-element oxide, or it may be a support obtained by binding the acidic two-element oxide with a binder. The binder is not particularly restricted so long as it is one commonly used for catalyst preparation, but those selected from among silica, alumina, magnesia, titania, zirconia and clay, or mixtures thereof, are preferred.

For production process A, the hydrocracking catalyst has a structure wherein at least one metal of Group VIa of the Periodic Table (molybdenum, chromium, tungsten or the like) and at least one metal of Group VIII (nickel, cobalt, palladium, platinum or the like) are loaded on the aforementioned support. These metals have a hydrogenating function, and on the acidic support they complete a reaction which causes cracking or branching of the paraffin compounds, thus performing an important role for production of isoparaffins with a suitable molecular weight and branching structure.

As regards the loading amount of the metals in the hydrocracking catalyst, the loading amount of metals of Group VIa is preferably 5-30% by mass for each metal, and the loading amount of metals of Group VIII is preferably 0.2-10% by mass for each metal.

The hydrocracking catalyst used for production process A more preferably comprises molybdenum in a range of 5-30% by mass as the one or more metals of Group VIa, and nickel in a range of 0.2-10% by mass as the one or more metals of Group VIII.

The hydrocracking catalyst composed of the support, at least one metal of Group VIa and at least one metal of Group VIII is preferably used in a sulfurized state for hydrocracking. The sulfurizing treatment may be carried out by a publicly known method.

(Hydrocracking Step)

For production process A, the feedstock oil containing 50% by volume or greater slack wax is hydrocracked in the presence of the hydrocracking catalyst, at a hydrogen partial pressure of 0.1-14 MPa, preferably 1-14 MPa and more preferably 2-7 MPa; a mean reaction temperature of 230-430° C., preferably 330-400° C. and more preferably 350-390° C.; an LHSV of 0.3-3.0 $hr^{-1}$ and preferably 0.5-2.0 $hr^{-1}$ and a hydrogen/oil ratio of 50-14,000 scf/b and preferably 100-5000 scf/b.

In the hydrocracking step, the n-paraffins derived from the slack wax in the feedstock oil are isomerized to isoparaffins during cracking, producing isoparaffin components with a low pour point and a high viscosity index, but it is possible to simultaneously decompose the aromatic compounds in the feedstock oil, which inhibit rise in the viscosity index, to monocyclic aromatic compounds, naphthene compounds and paraffin compounds, and to decompose the polycyclic naphthene compounds, which also inhibit rise in the viscosity index, to monocyclic naphthene compounds or paraffin compounds. From the viewpoint of increasing the viscosity index, it is preferred to minimize the high boiling point and low viscosity index compounds in the feedstock oil.

If the cracking severity as an evaluation of the extent of reaction is defined by the following formula:

(cracking severity (% by volume))=100−(proportion (% by volume) of fraction with boiling point of 360° C. or higher in product)

then the cracking severity is preferably 3-90% by volume. A cracking severity of less than 3% by volume is not preferred because it will result in insufficient production of isoparaffins by decomposing isomerization of high-molecular-weight n-paraffins with a high pour point in the feedstock oil and insufficient hydrocracking of the aromatic or polycyclic naphthene components with an inferior viscosity index, while a cracking severity of greater than 90% by volume is not preferred because it will reduce the lube-oil distillate yield.

(Distilling Separation Step)

The lube-oil distillate is then subjected to distilling separation from the cracked product oil obtained from the hydrocracking step described above. A fuel oil fraction is also sometimes obtained as the gas fraction.

The fuel oil fraction is the fraction obtained as a result of thorough desulfurization and denitrogenization, and thorough hydrogenation of the aromatic components. The naphtha fraction with a high isoparaffin content, the kerosene fraction with a high smoke point and the gas oil fraction with a high cetane number are all high quality products suitable as fuel oils.

On the other hand, even with insufficient hydrocracking of the lube-oil distillate, a portion thereof may be supplied for repeat of the hydrocracking step. In order to obtain a lube-oil distillate with the desired kinematic viscosity, the lube-oil distillate may also be subjected to vacuum distillation. The vacuum distillation separation may be carried out after the dewaxing treatment described below.

In the evaporating separation step, the cracked product oil obtained from the hydrocracking step may be subjected to vacuum distillation to satisfactorily obtain a lubricating base oil such as 70 Pale, SAE10 or SAE20.

A system using a lower viscosity slack wax as the feedstock oil is suitable for producing an increased 70 Pale or SAE10 fraction, while a system using a high viscosity slack wax in the range mentioned above as the feedstock oil is suitable for obtaining more SAE20. Even with high viscosity slack wax, however, conditions for producing significant amounts of 70 Pale and SAE10 may be selected depending on the extent of progression in the cracking reaction.

(Dewaxing Step)

The lube-oil distillate obtained by fractional distillation from the cracked product oil in the distilling separation step has a high pour point, and therefore dewaxing is carried out to obtain alubricating base oil with the desired pour point. The dewaxing treatment may be carried out by an ordinary method such as a solvent dewaxing method or catalytic dewaxing method. Solvent dewaxing methods generally employ MEK and toluene mixed solvents, but solvents such as benzene, acetone or MEK may also be used. In order to limit the pour point of the dewaxing oil to not higher than −10° C., such methods are preferably carried out under conditions with a solvent/oil ratio of 1-6 and a filtration temperature of −5 to −45° C. and preferably −10 to −40° C. In order to limit the freezing point of the dewaxing oil in the SAE10 class fraction to not higher than −25° C. for a lubricating base oil according to the first embodiment of the invention or second embodiment described hereunder, the solvent/oil ratio is preferably 1-6 and the filtration temperature is preferably not higher than −25° C., more preferably −26 to −45° C., even more preferably −27 to −40° C. and most preferably −28 to −35° C. The wax removed by filtration may be supplied again as slack wax to a hydrocracking step.

The production process described above may also include solvent refining treatment and/or hydrorefining treatment in addition to the dewaxing treatment. Such additional treatment is performed to improve the ultraviolet stability or oxidation stability of the lubricating base oil, and may be carried out by methods ordinarily used for lubricating oil refining steps.

The solvent used for solvent refining will usually be furfural, phenol, N-methylpyrrolidone or the like, in order to remove the small amounts of aromatic compounds and especially polycyclic aromatic compounds, remaining in the lube-oil distillate.

The hydrorefining is carried out for hydrogenation of the olefin compounds and aromatic compounds, and the catalyst therefor is not particularly restricted; there may be used alumina catalysts supporting at least one metal from among Group VIa metals such as molybdenum and at least one metal from among Group VIII metals such as cobalt and nickel, under conditions with a reaction pressure (hydrogen partial pressure) of 7-16 MPa, a mean reaction temperature of 300-390° C. and an LHSV of 0.5-4.0 $hr^{-1}$.

The following production process B may be mentioned as another preferred example of a production process for the lubricating base oil of the first embodiment.

Specifically, production process B according to the invention comprises:

a fifth step of hydrocracking and/or hydroisomerization of a feedstock oil containing paraffinic hydrocarbons in the presence of a catalyst, and a sixth step of dewaxing treatment of the product obtained from the fifth step or of the lube-oil distillate collected by distillation or the like from the product.

Production process B will now be explained in detail.

(Feedstock Oil)

For production process B, there is used a feedstock oil containing paraffinic hydrocarbons. The term "paraffinic hydrocarbons" according to the invention refers to hydrocarbons with a paraffin molecule content of 70% by mass or greater. The number of carbons of the paraffinic hydrocarbons is not particularly restricted but will normally be about 10-100. The method for producing the paraffinic hydrocarbons is not particularly restricted, and various petroleum-based and synthetic paraffinic hydrocarbons may be used, but as especially preferred paraffinic hydrocarbons there may be mentioned synthetic waxes (Fischer-Tropsch wax (FT wax), GTL wax, etc.) obtained by gas-to-liquid (GTL) processes, among which FT wax is preferred Synthetic wax is preferably wax composed mainly of normal paraffins with 15-80 and more preferably 20-50 carbon atoms.

The kinematic viscosity of the paraffinic hydrocarbons used for preparation of the feedstock oil may be appropriately selected according to the desired kinematic viscosity of the lubricating base oil, but for production of a low-viscosity base oil as a lubricating base oil of the first embodiment, relatively low-viscosity paraffinic hydrocarbons with a kinematic viscosity at 100° C. of about 2-25 $mm^2/s$, preferably about 2.5-20 $mm^2/s$ and more preferably about 3-15 $mm^2/s$, are preferred. The other properties of the paraffinic hydrocarbons may be as desired, but when the paraffinic hydrocarbons are synthetic wax such as FT wax, the melting point is preferably 35-80° C., more preferably 50-80° C. and even more preferably 60-80° C. The oil content of the synthetic wax is preferably not greater than 10% by mass, more preferably not greater than 5% by mass and even more preferably not greater than 2% by mass. The sulfur content of the synthetic wax is preferably not greater than 0.01% by mass, more preferably not greater than 0.001% by mass and even more preferably not greater than 0.0001% by mass.

When the feedstock oil is a blended oil comprising the aforementioned synthetic wax and another feedstock oil, the feedstock oils are not particularly restricted so long as the proportion of synthetic wax in the total blended oil is 50% by volume or greater, but it is preferred to use a blended oil comprising a heavy atmospheric distilled oil and/or vacuum distilled oil obtained from crude oil.

Also, when the feedstock oil is the blended oil comprising the aforementioned synthetic wax and another feedstock oil, the proportion of synthetic wax in the blended oil is more preferably 70% by volume or greater and even more preferably 75% by volume or greater from the viewpoint of production of a base oil with a high viscosity index. If the proportion is less than 70% by volume, the oil content including the aromatic and naphthene contents of the obtained lubricating base oil will be increased, thus tending to lower the viscosity index of the lubricating base oil.

On the other hand, in order to maintain a high viscosity index of the lubricating base oil, the heavy atmospheric distilled oil and/or vacuum distilled oil from the crude oil, used in combination with the synthetic wax, is preferably a fraction with a run-off of 60% by volume or greater in a distillation temperature range of 300-570° C.

(Catalyst)

There are no particular restrictions on the catalyst used for production process B, but it is preferably a catalyst comprising at least one metal selected from metals of Group VIb and Group VIII of the Periodic Table as an active metal component supported on a support containing an aluminosilicate.

An aluminosilicate is a metal oxide composed of the three elements aluminum, silicon and oxygen. Other metal elements may also be included in ranges that do not interfere with the effect of the invention. In this case, the amount of other metal elements is preferably not greater than 5% by mass and more preferably not greater than 3% by mass of the total amount of alumina and silica in terms of their oxides. As examples of metal elements that may be included there may be mentioned titanium, lanthanum and manganese.

The crystallinity of the aluminosilicate can be estimated by the proportion of tetracoordinated aluminum atoms among the total aluminum atoms, and this proportion can be measured by $^{27}Al$ solid NMR. The aluminosilicate used for the invention has a tetracoordinated aluminum proportion of preferably 50% by mass or greater, more preferably 70% by mass ore greater and even more preferably 80% by mass or greater based on the total amount of aluminum. Aluminosilicates with tetracoordinated aluminum contents of greater than 50% by mass based on the total amount of aluminum are known as "crystalline aluminosilicates".

Zeolite may be used as a crystalline aluminosilicate. As preferred examples there may be mentioned zeolite Y, ultrastable zeolite Y (USY zeolite), β-zeolite, mordenite and ZSM-5, among which USY zeolite is particularly preferred. According to the invention, one type of crystalline aluminosilicate may be used alone, or two or more may be used in combination.

The method of preparing the support containing the crystalline aluminosilicate may be a method in which a mixture of the crystalline aluminosilicate and binder is shaped and the shaped body is calcined. There are no particular restrictions on the binder used, but alumina, silica, silica-alumina, titania and magnesia are preferred, and alumina is particularly preferred. There are also no particular restrictions on the proportion of binder used, but normally it will be preferably 5-99% by mass and more preferably 20-99% by mass based on the total amount of the shaped body. The calcining temperature for the shaped body comprising the crystalline aluminosilicate and binder is preferably 430-470° C., more preferably 440-460° C. and even more preferably 445-455° C. The firing time is not particularly restricted but will normally be 1 minute to 24 hours, preferably 10 minutes to 20 hours and more preferably 30 minutes-10 hours. The calcining may be carried out in an atmosphere of air, but is preferably carried out in an oxygen-free atmosphere such as a nitrogen atmosphere.

The Group VIb metal supported on the support may be chromium, molybdenum, tungsten or the like, and the Group VIII metal may be, specifically, cobalt, nickel, rhodium, palladium, iridium, platinum or the like. These metals may be used as single metals alone, or two or more thereof may be used in combination. For a combination of two or more metals, precious metals such as platinum and palladium may be combined, base metals such as nickel, cobalt, tungsten and molybdenum may be combined, or a precious metal and a base metal may be combined.

The metal may be loaded onto the support by impregnation of the support with a solution containing the metal, or by a usual method such as ion exchange. The loading amount of the metal may be selected as appropriate, but it will usually be 0.05-2% by mass and preferably 0.1-1% by mass based on the total amount of the catalyst (Hydrocracking/Hydroisomerization Step)

Production process B includes hydrocracking/hydroisomerization step of a feedstock oil containing paraffnic hydrocarbons, in the presence of the aforementioned catalyst. The hydrocracking/hydroisomerization step may be carried out using a fixed bed reactor. The conditions for the hydrocracking/hydroisomerization are preferably, for example, a temperature of 250-400° C., a hydrogen pressure of 0.5-10 MPa and a feedstock oil liquid space velocity (LHSV) of 0.5-10 $h^{-1}$.

(Distilling Separation Step)

The lube-oil distillate is then subjected to distilling separation from the cracked product oil obtained from the hydrocracking/hydroisomerization step described above. The distilling separation step in production process 13 is the same as the distilling separation step in production process A and will not be explained again here.

(Dewaxing Step)

The lube-oil distillate obtained by fractional distillation from the cracked product oil in the distilling separation step described above is then subjected to dewaxing. The dewaxing step may be carried out by a conventionally known dewaxing process such as solvent dewaxing or catalytic dewaxing. When the substances with a boiling point of 370° C. or lower in the cracking/isomerization product oil have not been separated from the high-boiling-point substances before dewaxing, the entire hydroisomerization product may be dewaxed, or the fraction with a boiling point of 370° C. or higher may be dewaxed, depending on the intended purpose of the cracking/isomerization product oil.

For solvent dewaxing, the hydroisomerization product is contacted with cold ketone and acetone and another solvent such as MEK or MIBK, and then cooled for precipitation of the high pour point substances as solid wax, and the precipitate separated from the solvent-containing lube-oil distillate (raffinate). The raffinate is then cooled with a scraped surface chiller for removal of the solid wax. Low molecular hydrocarbons such as propane can also be used for the dewaxing, in which case the cracking/isomerization product oil and low molecular hydrocarbons are mixed and at least a portion thereof is gasified to further cool the cracking/isomerization product oil and precipitate the wax. The wax is separated from the raffinate by filtration, membrane separation or centrifugal separation. The solvent is then removed from the raffinate and the raffinate is subjected to fractional distillation to obtain the target lubricating base oil.

In the case of catalytic dewaxing (catalyst dewaxing), the cracking/isomerization product oil is reacted with hydrogen in the presence of a suitable dewaxing catalyst under conditions effective for lowering the pour point. For catalytic dewaxing, some of the high-boiling-point substances in the cracking/isomerization product are converted to low-boiling-point substances, and then the low-boiling-point substances are separated from the heavier base oil fraction and the base oil fraction is subjected to fractional distillation to obtain two or more lubricating base oils. The low-boiling-point substances may be separated either before obtaining the target lubricating base oil or during the fractional distillation.

The dewaxing catalyst is not particularly restricted so long as it can lower the pour point of the cracking/isomerization product oil, and it is preferably one that yields the target lubricating base oil at high yield from the cracking/isomerization product oil. As such dewaxing catalysts there are preferred shape-selective molecular sieves, and specifically there may be mentioned ferrierite, mordenite, ZSM-5, ZSM-11, ZSM-23, ZSM-35, ZSM-22 (also known as Theta-1 or TON), silicoaluminophosphates (SAPO) and the like. These molecular sieves are preferably used in combination with catalyst metal components and more preferably in combination with precious metals. An example of a preferred combination is a complex of platinum and H-mordenite.

The dewaxing conditions are not particularly restricted, but the temperature is preferably 200-500° C. and the hydrogen pressure is preferably 10-200 bar (1 MPa-20 MPa). For a flow-through reactor, the $H_2$ treatment speed is preferably 0.1-10 kg/l/hr and the LHSV is preferably 0.1-$10^{-1}$ and more preferably 0.2-2.0 $h^{-1}$. The dewaxing is preferably carried out in such a manner that substances with initial boiling points of 350-400° C., normally present at not greater than 40% by mass and preferably not greater than 30% by mass in the cracking/isomerization product oil, are converted to substances with boiling points of below their initial boiling points.

Production process A and production process B were explained above as preferred production processes for lubricating base oils of the first embodiment, but the production process for a lubricating base oil of the first embodiment is not limited thereto. For example, in production process A, a synthetic wax such as FT wax or GTL wax may be used instead of slack wax. Also, a feedstock oil comprising slack wax (preferably slack wax A, B) may be used in production process B. In addition, production processes A and B may employ both slack wax (preferably slack wax A, B) and synthetic wax (preferably FT wax, GTL wax).

When the feedstock oil used for production of the lubricating base oil of the first embodiment is a blended oil comprising the aforementioned slack wax and/or synthetic wax and a feedstock oil in addition to these waxes, the content of the slack wax and/or synthetic wax is preferably 50% by mass or greater based on the total amount of the feedstock oil.

As feedstock oils for production of a lubricating base oil according to the first embodiment there are preferred feedstock oils containing slack wax and/or synthetic wax, with oil contents of preferably not greater than 60% by mass, more preferably not greater than 50% by mass and even more preferably not greater than 25% by mass.

The saturated component content of the lubricating base oil of the first embodiment is 90% by mass or greater as mentioned above, but it is preferably 93% by mass or greater, more preferably 95% by mass or greater, even more preferably 96% by mass or greater and yet more preferably 97% by mass or greater, based on the total amount of the lubricating base oil. The saturated component content may be 100% by mass, but from the viewpoint of production cost and additive solubility, it is preferably not greater than 99.9% by mass, more preferably not greater than 99.5% by mass, even more preferably not greater than 99% by mass and most preferably not greater than 98.5% by mass. The proportion of cyclic saturated components among the saturated components is not greater than 40% by mass as mentioned above, but it is preferably 0.1-40% by mass, 2-30% by mass, more preferably 5-25% by mass and even more preferably 10-21% by mass. If the saturated component content and proportion of cyclic saturated components among the saturated components both satisfy these respective conditions and the viscosity index and iodine value also satisfactory their respective conditions, it will be possible to achieve adequate levels for the viscosity-temperature characteristic and heat and oxidation stability, while additives added to the lubricating base oil will be kept in a sufficiently stable dissolved state in the lubricating base oil so that the functions of the additives can be exhibited at a higher level. A lubricating base oil according to the first embodiment exhibits improved frictional properties of the lubricating base oil itself, and thus results in a greater friction reducing effect and therefore increased energy savings.

If the saturated component content is less than 90% by mass, the viscosity-temperature characteristic, heat and oxidation stability and frictional properties will be inadequate. If the proportion of cyclic saturated components among the saturated components is greater than 40% by mass, the efficacy of additives included in the lubricating base oil will be reduced. If the proportion of cyclic saturated components among the saturated components is less than 0.1% by mass, the solubility of the additives included in the lubricating base oil will be reduced, thus reducing the effective amount of additives kept dissolved in the lubricating base oil, and making it impossible to effectively achieve the functions of the additives. The saturated component content may be 100% by mass, but from the viewpoint of reducing production cost and improving the solubility of the additives, it is preferably not greater than 99.9% by mass, more preferably not greater than 99.5% by mass, even more preferably not greater than 99% by mass and most preferably not greater than 98.5% by mass.

A proportion of not greater than 40% by mass cyclic saturated components among the saturated components in the lubricating base oil of the first embodiment is equivalent to 60% by mass or greater acyclic saturated components among the saturated components. The term "acyclic saturated components" refers to both straight-chain paraffins and branched paraffins. There are no particular restrictions on the proportion of each paraffin in the lubricating base oil of the first embodiment, but the branched paraffin content is preferably 55-99% by mass, more preferably 57.5-96% by mass, even more preferably 60-95% by mass, yet more preferably 70-92% by mass and most preferably 80-90% by mass based on the total amount of the lubricating base oil. If the proportion of branched paraffins in the lubricating base oil satisfies the aforementioned conditions it will be possible to further improve the viscosity-temperature characteristic and heat and oxidation stability, while additives added to the lubricating base oil will be kept in a sufficiently stable dissolved state in the lubricating base oil so that the functions of the additives can be exhibited at an even higher level. The proportion of straight-chain paraffins in the lubricating base oil is preferably not greater than 1% by mass, more preferably not greater than 0.5% by mass and even more preferably not greater than 0.2% by mass based on the total amount of the lubricating base oil. If the straight-chain paraffin proportion satisfies this condition, it will be possible to obtain the lubricating base oil with a more excellent low-temperature viscosity characteristic.

The content of monocyclic saturated components and bicyclic or greater saturated components among the saturated components in the lubricating base oil of the first embodiment is not particularly restricted so long as the total is not greater than 40% by mass, but the proportion of bicyclic or greater saturated components among the saturated components is preferably 0.1% by mass or greater, more preferably 1% by mass or greater, even more preferably 3% by mass or greater, yet more preferably 5% by mass or greater and most preferably 6% by mass or greater, and preferably not greater than 40% by mass, more preferably not greater than 20% by mass, even more preferably not greater than 15% by mass and most preferably not greater than 11% by mass. The proportion of monocyclic saturated components among the saturated components may be 0% by mass, but it is preferably 1% by mass or greater, more preferably 2% by mass or greater, even more preferably 3% by mass or greater and most preferably 4% by mass or greater, and preferably not greater than 40% by mass, more preferably not greater than 20% by mass, even more preferably not greater than 15% by mass and most preferably not greater than 11% by mass.

The ratio of the mass of monocyclic saturated components ($M_A$) and the mass of bicyclic or greater saturated components ($M_B$) among the cyclic saturated components in the lubricating base oil of the first embodiment ($M_A/M_B$) is preferably not greater than 20, more preferably not greater than 3, even more preferably not greater than 2 and most preferably not greater than 1. $M_A/M_B$ may be 0, but it is preferably 0.1 or greater, more preferably 0.3 or greater and even more preferably 0.5 or greater. If $M_A/M_B$ satisfies these conditions, it will be possible to achieve even higher levels of both viscosity-temperature characteristic and heat and oxidation stability.

The ratio of the mass of monocyclic saturated components ($M_A$) and the mass of bicyclic saturated components (Mc) among the cyclic saturated components in the lubricating base oil of the first embodiment ($M_A/M_c$) is preferably not greater than 3, more preferably not greater than 1.5, even more preferably not greater than 1.3 and most preferably not greater than 1.2. $M_A/M_c$ may be 0, but it is preferably 0.1 or greater, more preferably 0.3 or greater and even more preferably 0.5 or greater. If $M_A/M_c$ satisfies these conditions, it will be possible to achieve even higher levels of both viscosity-temperature characteristic and heat and oxidation stability.

The saturated component content for the purpose of the invention is the value measured according to ASTM D 2007-93 (units: % by mass).

The proportions of the cyclic saturated components, monocyclic saturated components, bicyclic or greater saturated components and the acyclic saturated components among the saturated components for the purpose of the invention are the naphthene portion (measurement of monocyclic-hexacyclic naphthenes, units: % by mass) and alkane portion (units: % by mass), respectively, both measured according to ASTM D 2786-91.

The straight-chain paraffin content of the lubricating base oil for the purpose of the invention is the value obtained by subjecting the saturated portion that has been separated and fractionated by the method described in ASTM D 2007-93 mentioned above, to gas chromatography under the conditions described below, in order to identify and quantify the straight-chain paraffins among the saturated components, and expressing the measured value with respect to the total amount of the lubricating base oil. For identification and quantitation, a C5-C50 straight-chain paraffin mixture sample is used as the reference sample, and the straight-chain paraffin content among the saturated components is determined as the proportion of the total of the peak areas corresponding to each straight-chain paraffin, with respect to the total peak area of the chromatogram (subtracting the peak area for the diluent).

(Gas Chromatography Conditions)

Column: Liquid phase nonpolar column (length: 25 mm, inner diameter: 0.3 mmϕ, liquid phase film thickness: 0.1 μm).

Temperature elevating conditions: 50° C.-400° C. (temperature-elevating rate: 10° C./min).

Carrier gas: helium (linear speed: 40 cm/min)

Split ratio: 90/1

Sample injection amount: 0.5 μL (injection amount of sample diluted 20-fold with carbon disulfide).

The proportion of branched paraffins in the lubricating base oil is the difference between the acyclic saturated component content among the saturated components and the straight-chain paraffin content among the saturated components, and it is a value expressed with respect to the total amount of the lubricating base oil.

Other methods may be used for separation of the saturated components or for compositional analysis of the cyclic saturated components and acyclic saturated components, so long as they provide similar results. As examples of other methods there may be mentioned the method according to ASTM D 2425-93, the method according to ASTM D 2549-91, methods of high performance liquid chromatography (HPLC), and modified forms of these methods.

The aromatic content in the lubricating base oil of the first embodiment is not particularly restricted so long as the saturated component content, the proportion of cyclic saturated components among the saturated components, the viscosity index and iodine value satisfy the conditions specified above, but it is preferably not greater than 7% by mass, more preferably not greater than 5% by mass, even more preferably not greater than 4% by mass and most preferably not greater than 3% by mass, and preferably 0.1% by mass or greater, more preferably 0.5% by mass or greater, even more preferably 1% by mass or greater and most preferably 1.5% by mass or greater, based on the total amount of the lubricating base oil. If the aromatic components content exceeds the aforementioned upper limit, the viscosity-temperature characteristic, heat and oxidation stability, frictional properties, low volatility and low-temperature viscosity characteristic will tend to be reduced, while the efficacy of additives when added to the lubricating base oil will also tend to be reduced. The lubricating base oil of the first embodiment may be free of aromatic components, but the solubility of additives can be further increased with an aromatic components content of the aforementioned lower limit or greater.

The aromatic components content, according to the invention, is the value measured according to ASTM D 2007-93. The aromatic portion normally includes alkylbenzenes and alkylnaphthalenes, as well as anthracene, phenanthrene and their alkylated forms, compounds with four or more fused benzene rings, and heteroatom-containing aromatic compounds such as pyridines, quinolines, phenols, naphthols and the like.

The viscosity index of the lubricating base oil according to the first embodiment is 110 or higher, as mentioned above. If the viscosity index is less than the aforementioned lower limit, the viscosity-temperature characteristic, heat and oxidation stability and low volatility will tend to be reduced. Since the preferred range for the viscosity index of the lubricating base oil according to the first embodiment will depend on the viscosity grade of the lubricating base oil, it will be explained in detail below.

The iodine value of the lubricating base oil of the first embodiment is not greater than 2.5 as mentioned above, but it is preferably not greater than 1.5, more preferably not greater than 1 and even more preferably not greater than 0.8, and while it may be less than 0.01, it is preferably 0.01 or greater, more preferably 0.1 or greater and even more preferably 0.5 or greater, in order to obtain a commensurate effect and for increased economy. Limiting the iodine value of the lubricating base oil to not greater than 2.5 can drastically improve the heat and oxidation stability. The "iodine value" for the purpose of the invention is the iodine value measured by the indicator titration method according to JIS K 0070, "Acid Values, Saponification Values, Iodine Values, Hydroxyl Values And Unsaponification Values Of Chemical Products".

The other properties of the lubricating base oil of the first embodiment are not particularly restricted so long as the saturated component content, the proportion of cyclic saturated components among the saturated components, the viscosity index and the iodine value satisfy the conditions specified above, but the lubricating base oil of the first embodiment preferably has the properties that are specified below.

The lubricating base oil of the first embodiment preferably satisfies the condition represented by the following inequality (2).

$$1.435 \leqq n_{20} - 0.002 \times kv100 \leqq 1.453 \quad (2)$$

Wherein $n_{20}$ represents the 20° C. refractive index of the lubricating base oil, and kv100 represents the kinematic viscosity at 100° C. ($mm^2/s$) of the lubricating base oil.

For a lubricating oil wherein the lubricating base oil of the first embodiment contains 95% by mass or greater saturated components and the proportion of cyclic saturated components among the saturated components is 0.1-15% by mass and preferably 1-10% by mass, $n_{20}$-0.002×kv100 is preferably 1.435-1.450, more preferably 1.440-1.449, even more preferably 1.442-1.448 and most preferably 1.444-1.447. For production of a lubricating base oil having such properties, it is preferred to use a starting material composed mainly of the aforementioned synthetic wax and/or slack wax as the starting material introduced for the hydrocracking and/or hydroisomerization step, and it is more preferred to use a starting material composed mainly of the aforementioned synthetic wax and/or slack wax A. In this case, the proportion of branched paraffins in the lubricating base oil is more preferably 95-99% by mass and even more preferably 97-99% by mass, while for a lubricating base oil obtained using the aforementioned slack wax A as the starting material, the proportion of branched paraffins in the lubricating base oil is more preferably 82-98% by mass and even more preferably 90-95% by mass.

For a lubricating base oil wherein the lubricating base oil of the first embodiment contains 90% by mass or greater saturated components and the proportion of cyclic saturated components among the saturated components is 5-40% by mass and preferably 10-25% by mass, $n_{20}$-0.002×kv100 is 1.435-1.453, preferably 1.440-1.452, more preferably 1.442-1.451 and even more preferably 1.444-1.450. For production of a lubricating base oil having such properties, it is preferred to use a starting material composed mainly of the aforementioned synthetic wax and/or slack wax as the starting material introduced for the hydrocracking and/or hydroisomerization step, and it is more preferred to use a starting material composed mainly of the aforementioned slack wax B. In this case, the proportion of branched paraffins in the lubricating base oil is more preferably 54-95% by mass, even more preferably 58-92% by mass, yet more preferably 70-90% by mass and most preferably 80-90% by mass.

If $n_{20}$-0.002×kv100 is within the range specified above it will be possible to achieve high levels of both viscosity-temperature characteristic and heat and oxidation stability, while additives added to the lubricating base oil will be kept in a sufficiently stable dissolved state in the lubricating base oil so that the functions of the additives can be exhibited at an even higher level. A $n_{20}$-0.002×kv100 value within the aforementioned range can also improve the frictional properties of the lubricating base oil itself, resulting in a greater friction reducing effect and thus increased energy savings.

If the $n_{20}$-0.002×kv100 value exceeds the aforementioned upper limit, the viscosity-temperature characteristic, heat and oxidation stability and frictional properties will tend to be insufficient, and the efficacy of additives when added to the lubricating base oil will tend to be reduced. If the $n_{20}$-0.002×kv100 value is less than the aforementioned lower limit, the solubility of the additives included in the lubricating base oil will be insufficient and the effective amount of additives kept dissolved in the lubricating base oil will be reduced, making it impossible to effectively achieve the functions of the additives.

The 20° C. refractive index (no) for the purpose of the invention is the refractive index measured at 20° C. according to ASTM D1218-92. The kinematic viscosity at 100° C. (kv100) for the purpose of the invention is the kinematic viscosity measured at 100° C. according to JIS K 2283-1993.

The % $C_P$ value of the lubricating base oil of the first embodiment is preferably 80 or greater, more preferably 82-99, even more preferably 85-95, yet more preferably 87-93 and most preferably 90-93. If the % $C_P$ value of the lubricating base oil is less than the aforementioned lower limit, the viscosity-temperature characteristic, heat and oxidation stability and frictional properties will tend to be reduced, while the efficacy of additives when added to the lubricating base oil will also tend to be reduced. If the % $C_P$ value of the lubricating base oil is greater than the aforementioned upper limit, on the other hand, the additive solubility will tend to be lower.

The % $C_N$ value of the lubricating base oil of the first embodiment is preferably 3-19, more preferably 5-15, even more preferably 7-13 and most preferably 7.5-12. If the % $C_N$ value of the lubricating base oil exceeds the aforementioned upper limit, the viscosity-temperature characteristic, heat and oxidation stability and frictional properties will tend to be reduced. If the % $C_N$ is less than the aforementioned lower limit, the additive solubility will tend to be lower.

The % $C_A$ of the lubricating base oil of the first embodiment is preferably not greater than 5, more preferably not greater than 2, more preferably not greater than 1.5 and even more preferably not greater than 1. If the % $C_A$ value of the lubricating base oil exceeds the aforementioned upper limit, the viscosity-temperature characteristic, heat and oxidation stability and frictional properties will tend to be reduced. The % $C_A$ value of the lubricating base oil of the first embodiment may be zero, but the solubility of additives can be further increased with a % $C_A$ value of 0.1 or greater.

The ratio of the % $C_P$ and % $C_N$ values for the lubricating base oil of the first embodiment is % $C_P$/% $C_N$ of preferably 5 or greater, more preferably 6 or greater and even more preferably 7 or greater. If the % $C_P$/% $C_N$ ratio is less than the aforementioned lower limit, the viscosity-temperature characteristic, heat and oxidation stability and frictional properties will tend to be reduced, while the efficacy of additives when added to the lubricating base oil will also tend to be reduced. The % $C_P$/% $C_N$ ratio is preferably not greater than 35, more preferably not greater than 20, even more preferably not greater than 14 and most preferably not greater than 13. The additive solubility can be further increased if the % $C_P$/% $C_N$ ratio is not greater than the aforementioned upper limit.

The % $C_P$, % $C_N$ and % $C_A$ values for the purpose of the invention are, respectively, the percentage of paraffinic carbon atoms number with respect to total carbon atoms number, the percentage of naphthenic carbon atoms number with respect to total carbon atoms number and the percentage of aromatic carbon atoms number with respect to total carbon atoms number, as determined by the methods of ASTM D 3238-85 (n-d-M ring analysis). That is, the preferred ranges for % $C_P$, % $C_N$ and % $C_A$ are based on values determined by these methods, and for example, % $C_N$ may be a value exceeding 0 according to these methods even if the lubricating base oil contains no naphthene portion.

The sulfur content in the lubricating base oil of the first embodiment will depend on the sulfur content of the starting material. For example, when using a substantially sulfur-free starting material as for synthetic wax components obtained by Fischer-Tropsch reaction, it is possible to obtain a substantially sulfur-free lubricating base oil. When using a sulfur-containing starting material, such as slack wax obtained by a lubricating base oil refining process or microwax obtained by a wax refining process, the sulfur content of the obtained lubricating base oil will normally be 100 ppm by mass or greater. The lubricating base oil of the first embodiment preferably has a sulfur content of not greater than 100 ppm by mass, more preferably not greater than 50 ppm by mass, even more preferably not greater than 10 ppm by mass and most preferably not greater than 5 ppm by mass, from the viewpoint of further improving the heat and oxidation stability and achieving low sulfurization.

From the viewpoint of cost reduction it is preferred to use a slack wax or the like as the starting material, in which case the sulfur content of the obtained lubricating base oil is preferably not greater than 50 ppm by mass and more preferably not greater than 10 ppm by mass. The sulfur content for the purpose of the invention is the sulfur content measured according to JIS K 2541-1996.

The nitrogen content in the lubricating base oil of the first embodiment is not particularly restricted, but is preferably not greater than 5 ppm by mass, more preferably not greater than 3 ppm by mass and even more preferably not greater than 1 ppm by mass. If the nitrogen content exceeds 5 ppm by mass, the heat and oxidation stability will tend to be reduced. The nitrogen content for the purpose of the invention is the nitrogen content measured according to JIS K 2609-1990.

The kinematic viscosity of the lubricating base oil according to the first embodiment is not particularly restricted so long as the saturated component content, the proportion of cyclic saturated components among the saturated components, the viscosity index and the iodine value satisfy the respective conditions specified above, but the kinematic viscosity at 100° C. is preferably 1.5-20 $mm^2/s$ and more preferably 2.0-11 $mm^2/s$. A kinematic viscosity at 100° C. for the lubricating base oil of less than 1.5 $mm^2/s$ is not preferred from the standpoint of evaporation loss. If it is attempted to obtain a lubricating base oil having a kinematic viscosity at 100° C. of greater than 20 $mm^2/s$, the yield will be reduced and it will be difficult to increase the cracking severity even when using a heavy wax as the starting material.

According to the first embodiment, a lubricating base oil having a kinematic viscosity at 100° C. in one of the following ranges is preferably used after fractionation by distillation or the like.

(I) A lubricating base oil with a kinematic viscosity at 100° C. of 1.5 $mm^2/s$ or greater and less than 3.5 $mm^2/s$, and more preferably 2.0-3.0 $mm^2/s$.

(II) A lubricating base oil with a kinematic viscosity at 100° C. of 3.0 $mm^2/s$ or greater and less than 4.5 $mm^2/s$, and more preferably 3.5-4.1 $mm^2/s$.

(III) A lubricating base oil with a kinematic viscosity at 100° C. of 4.5-20 $mm^2/s$, more preferably 4.8-11 $mm^2/s$ and most preferably 5.5-8.0 $mm^2/s$.

The kinematic viscosity at 40° C. of the lubricating base oil of the first embodiment is preferably 6.0-80 $mm^2/s$ and more preferably 8.0-50 $mm^2/s$. According to the first embodiment, a lube-oil distillate having a kinematic viscosity at 40° C. in one of the following ranges is preferably used after fractionation by distillation or the like.

(IV) A lubricating base oil with a kinematic viscosity at 40° C. of 6.0 $mm^2/s$ or greater and less than 12 $mm^2/s$, and more preferably 8.0-12 $mm^2/s$.

(V) A lubricating base oil with a kinematic viscosity at 40° C. of 12 $mm^2/s$ or greater and less than 28 $mm^2/s$, and more preferably 13-19 $mm^2/s$.

(VI) A lubricating base oil with a kinematic viscosity at 40° C. of 28-50 $mm^2/s$, more preferably 29-45 $mm^2/s$ and most preferably 30-40 $mm^2/s$.

By satisfying the aforementioned respective conditions for the saturated component content, the proportion of cyclic saturated components among the saturated components, the viscosity index and iodine value, the lubricating base oils (I) and (IV) can provide a superior low-temperature viscosity characteristic and notably lower the viscous resistance and stirring resistance compared to conventional lubricating base oils of the same viscosity grade. Moreover, by including a pour point depressant it is possible to lower the BF viscosity at −40° C. to not greater than 2000 mPa·s. The BF viscosity at −40° C. is the viscosity measured according to JPI-5S-26-99.

Also, by satisfying the aforementioned respective conditions for the saturated component content, the proportion of cyclic saturated components among the saturated components, the viscosity index and iodine value, the lubricating base oils (II) and (V) can provide a superior low-temperature viscosity characteristic and improved low volatility and lubricity, compared to conventional lubricating base oils of the same viscosity grade. For example, with lubricating base oils (II) and (V) it is possible to lower the CCS viscosity at −35° C. to not greater than 3000 mPa·s.

Also, by satisfying the aforementioned respective conditions for the saturated component content, the proportion of cyclic saturated components among the saturated components, the viscosity index and iodine value, the lubricating base oils (III) and (VI) can provide a superior low-temperature viscosity characteristic and improved low volatility, heat and oxidation stability and lubricity, compared to conventional lubricating base oils of the same viscosity grade.

The viscosity index of the lubricating base oil of the first embodiment will depend on the viscosity grade of the lubricating base oil, but the viscosity index may be 110 or higher for all of the lubricating base oils (I)-(VI). The viscosity index for the lubricating oils (I) and (IV) is preferably 110-135, more preferably 115-130 and even more preferably 120-130. The viscosity index for the lubricating base oils (II) and (V) is preferably 125-160, more preferably 130-150 and even more preferably 135-150. Also, the viscosity index for the lubricating base oils (III) and (VI) is preferably 135-180 and more preferably 140-160. If the viscosity index is less than the aforementioned lower limit, the viscosity-temperature characteristic, heat and oxidation stability and low volatility will tend to be reduced. If the viscosity index exceeds the aforementioned upper limit, the low-temperature viscosity characteristic will tend to be reduced.

The viscosity index for the purpose of the invention is the viscosity index measured according to JIS K 2283-1993.

The 20° C. refractive index of the lubricating base oil of the first embodiment will depend on the viscosity grade of the lubricating base oil, but the 20° C. refractive index of the lubricating base oils (I) and (IV) mentioned above, for example, is preferably 1.440-1.461, more preferably 1.442-1.460 and even more preferably 1.445-1.459. The 20° C. refractive index of the lubricating base oils (II) and (V) is preferably 1.450-1.465, more preferably 1.452-1.463 and even more preferably 1.453-1.462. The 20° C. refractive index of the lubricating base oils (III) and (VI) is preferably 1.455-1.469, more preferably 1.456-1.468 and even more preferably 1.457-1.467. If the refractive index exceeds the aforementioned upper limit, the viscosity-temperature characteristic, heat and oxidation stability, low volatility and low-temperature viscosity characteristic of the lubricating base oil will tend to be reduced, while the efficacy of additives when added to the lubricating base oil will also tend to be reduced.

The pour point of the lubricating base oil of the first embodiment will depend on the viscosity grade of the lubricating base oil, but the pour point of the lubricating base oils (I) and (IV) mentioned above, for example, is preferably not higher than −10° C., more preferably not higher than −12.5° C. and even more preferably not higher than −15° C. The pour point of the lubricating base oils (II) and (V) is preferably not higher than −10° C., more preferably not higher than −15° C. and even more preferably not higher than −17.5° C. The pour point of the lubricating base oils (III) and (VI) is preferably not higher than −10° C., more preferably not higher than −12.5° C. and even more preferably not higher than −15° C. If the pour point exceeds the upper limit specified above, the low-temperature flow properties of a lubricating oil employing the lubricating base oil will tend to be reduced. The pour point for the purpose of the invention is the pour point measured according to JIS K 2269-1987.

The CCS viscosity at −35° C. of the lubricating base oil of the first embodiment will depend on the viscosity grade of the lubricating base oil, but the CCS viscosity at −35° C. for the lubricating base oils (I) and (IV) mentioned above, for example, is preferably not greater than 1000 mPa·s. The CCS viscosity at −35° C. for the lubricating base oils (II) and (V) is preferably not greater than 3000 mPa·s, more preferably not greater than 2400 mPa·s, even more preferably not greater than 2200 mPa·s and most preferably not greater than 2000 mPa·s. The CCS viscosity at −35° C. for the lubricating base oils (III) and (VI) is preferably not greater than 15,000 mPa·s, more preferably not greater than 10,000 mPa·s and even more preferably not greater than 8000 mPa·s. If the CCS viscosity at −35° C. exceeds the upper limit specified above, the low-temperature flow properties of a lubricating oil employing the lubricating base oil will tend to be reduced. The −CCS viscosity at −35° C. for the purpose of the invention is the viscosity measured according to JIS K 2010-1993.

The density at 15° C. ($\rho_{15}$, units: g/cm$^3$) of the lubricating base oil of the first embodiment will also depend on the viscosity grade of the lubricating base oil, but it is preferably not greater than the value of ρ as represented by the following formula (3), i.e., $\rho_{15} \leqq \rho$.

$$\rho=0.0025\times kv100+0.820 \quad (3)$$

[In this equation, kv100 represents the kinematic viscosity at 100° C. (mm$^2$/s) of the lubricating base oil.]

If $\rho_{15}>\rho$, the viscosity-temperature characteristic, heat and oxidation stability, low volatility and low-temperature viscosity characteristic of the lubricating base oil will tend to be reduced, while the efficacy of additives when added to the lubricating base oil will also tend to be reduced.

For example, the value of $\rho_{15}$ for lubricating base oils (I) and (IV) is preferably not greater than 0.825 g/cm$^3$ and more preferably not greater than 0.820 g/cm$^3$. The value of $\rho_{15}$ for lubricating base oils (II) and (V) is preferably not greater than 0.835 g/cm$^3$ and more preferably not greater than 0.830 g/cm$^3$. The value of $\rho_{15}$ for lubricating base oils (III) and (VI) is preferably not greater than 0.840 g/cm$^3$ and more preferably not greater than 0.835 g/cm$^3$.

The density at 15° C. for the purpose of the invention is the density measured at 15° C. according to JIS K 2249-1995

The aniline point (AP (° C.)) of the lubricating base oil of the first embodiment will also depend on the viscosity grade of the lubricating base oil, but it is preferably greater than or equal to the value of A as represented by the following formula (4), i.e., $AP \leqq A$.

$$A=4.1\times kv100+97 \quad (4)$$

[In this equation, kv1000 represents the kinematic viscosity at 100° C. (mm$^2$/s) of the lubricating base oil.]

If AP<A, the viscosity-temperature characteristic, heat and oxidation stability, low volatility and low-temperature viscosity characteristic of the lubricating base oil will tend to be reduced, while the efficacy of additives when added to the lubricating base oil will also tend to be reduced.

The value of AP for the lubricating base oils (I) and (IV) is preferably 108° C. or higher, more preferably 110° C. or higher and even more preferably 112° C. or higher. The value of AP for the lubricating base oils (II) and (V) is preferably 113° C. or higher, more preferably 116° C. or higher, even more preferably 118° C. or higher and most preferably 120° C. or higher. The value of AP for the lubricating base oils (III) and (VI) is preferably 125° C. or higher, more preferably 127° C. or higher and even more preferably 128° C. or higher. The aniline point for the purpose of the invention is the aniline point measured according to JIS K 2256-1985

The NOACK evaporation amount of the lubricating base oil of the first embodiment is not particularly restricted, and for example, the NOACK evaporation amount for lubricating base oils (I) and (IV) is preferably 20% by mass or greater, more preferably 25% by mass or greater and even more preferably 30 or greater, and preferably not greater than 50% by mass, more preferably not greater than 45% by mass and even more preferably not greater than 42% by mass. The NOACK evaporation amount for lubricating base oils (II) and (V) is preferably 6% by mass or greater, more preferably 8% by mass or greater and even more preferably 10% by mass or greater, and preferably not greater than 20% by mass, more preferably not greater than 16% by mass, even more preferably not greater than 15% by mass and most preferably not greater than 14% by mass. The NOACK evaporation amount for lubricating base oils (III) and (VI) is preferably 1% by mass or greater and more preferably 2% by mass or greater, and preferably not greater than 8% by mass, more preferably not greater than 6% by mass and even more preferably not greater than 4% by mass. If the NOACK evaporation amount is below the aforementioned lower limit it will tend to be difficult to improve the low-temperature viscosity characteristic. If the NOACK evaporation amount is above the respective upper limit, the evaporation loss of the lubricating oil will be increased when the lubricating base oil is used as a lubricating oil for an internal combustion engine, and catalyst poisoning will be undesirably accelerated as a result. The NOACK evaporation amount for the purpose of the invention is the evaporation loss as measured according to ASTM D 5800-95.

The distillation properties of the lubricating base oil of the first embodiment are preferably an initial boiling point (IBP) of 290-440° C. and a final boiling point (FBP) of 430-580° C. in gas chromatography distillation, and rectification of one or more fractions selected from among fractions in this distillation range can yield lubricating base oils (I)-(III) and (IV)-(VI) having the aforementioned preferred viscosity ranges.

For example, for the distillation properties of the lubricating base oils (I) and (IV), the initial boiling point (IBP) is preferably 260-360° C., more preferably 300-350° C. and even more preferably 310-350° C. The 10% distillation temperature (T10) is preferably 320-400° C., more preferably 340-390° C. and even more preferably 350-380° C. The 50% distillation temperature (T50) is preferably 350-430° C., more preferably 360-410° C. and even more preferably 370-400° C. The 90% distillation temperature (T90) is preferably 380-460° C., more preferably 390-450° C. and even more preferably 400-440° C. The final boiling point (FBP) is preferably 420-520° C., more preferably 430-500° C. and even more preferably 440-480° C. T90-T10 is preferably 50-100° C., more preferably 55-85° C. and even more preferably 60-70° C. FBP-IBP is preferably 100-250° C., more preferably 110-220° C. and even more preferably 120-200° C. T10-IBP is preferably 10-80° C., more preferably 15-60° C. and even more preferably 20-50° C. FBP-T90 is preferably 10-80° C., more preferably 15-70° C. and even more preferably 20-60° C.

For the distillation properties of the lubricating base oils (II) and (V), the initial boiling point (IBP) is preferably 300-380° C., more preferably 320-370° C. and even more preferably 330-360° C. The 10% distillation temperature (T10) is preferably 340-420° C., more preferably 350-410° C. and even more preferably 360-400° C. The 50% distillation temperature (T50) is preferably 380-460° C., more preferably 390-450° C. and even more preferably 400-460° C. The 90% distillation temperature (T90) is preferably 440-500° C., more preferably 450-490° C. and even more preferably 460-480° C. The final boiling point (FBP) is preferably 460-540° C., more preferably 470-530° C. and even more preferably 480-520° C. T90-T10 is preferably 50-100° C., more preferably 60-95° C. and even more preferably 80-90° C. FBP-IBP is preferably 100-250° C., more preferably 120-180° C. and even more preferably 130-160° C. T10-IBP is preferably 10-70° C., more preferably 15-60° C. and even more preferably 20-50° C. FBP-T90 is preferably 10-50° C., more preferably 20-40° C. and even more preferably 25-35° C.

For the distillation properties of the lubricating base oils (III) and (VI), the initial boiling point (IBP) is preferably 320-480° C., more preferably 350-460° C. and even more preferably 380-440° C. The 10% distillation temperature (T10) is preferably 420-500° C., more preferably 430-480° C. and even more preferably 440-460° C. The 50% distillation temperature (T50) is preferably 440-520° C., more preferably 450-510° C. and even more preferably 460-490° C. The 90% distillation temperature (T90) is preferably 470-550° C., more preferably 480-540° C. and even more preferably 490-520° C. The final boiling point (FBP) is preferably 500-580° C., more preferably 510-570° C. and even more preferably 520-560° C. T90-T10 is preferably 50-120° C., more preferably 55-100° C. and even more preferably 55-90° C. FBP-IBP is preferably 100-250° C., more preferably 110-220° C. and even more preferably 115-200° C. T10-IBP is preferably 10-100° C., more preferably 15-90° C. and even more preferably 20-50° C. FBP-T90 is preferably 10-50° C., more preferably 20-40° C. and even more preferably 25-35° C.

By setting IBP, T10, T50, T90, FBP, T90-T10, FBP-IBP, T10-IBP and FBP-T90 within the preferred ranges specified above for lubricating base oils (I)-(VI), it is possible to further improve the low temperature viscosity and further reduce the evaporation loss. If the distillation ranges for T90-T10, FBP-IBP, T10-IBP and FBP-T90 are too narrow, the lubricating base oil yield will be poor resulting in low economy.

The IBP, T10, T50, T90 and FBP values for the purpose of the invention are the running points measured according to ASTM D 2887-97.

The residual metal content in the lubricating base oil of the first embodiment derives from metals in the catalyst or starting materials that have become unavoidable contaminants during the production process, and it is preferred to thoroughly remove such residual metal contents. For example, the Al, Mo and Ni contents are preferably not greater than 1 ppm by mass each. If the metal contents exceed the aforementioned upper limit, the functions of additives in the lubricating base oil will tend to be inhibited.

The residual metal content for the purpose of the invention is the metal content as measured according to JPI-5S-38-2003.

The lubricating base oil of the first embodiment, which satisfies the conditions for the saturated component content, the proportion of cyclic saturated components among the saturated components, the viscosity index and the iodine value, allows excellent heat and oxidation stability to be achieved, but it also preferably exhibits a RBOT life as described below, depending on the kinematic viscosity. For example, the RBOT life for the lubricating base oils (I) and (IV) is preferably 300 min or greater, more preferably 320 min or greater and even more preferably 330 min or greater. Also, the RBOT life for the lubricating base oils (II) and (V) is preferably 350 min or greater, more preferably 370 min or greater and even more preferably 380 min or greater. The RBOT life for the lubricating base oils (III) and (VI) is preferably 400 min or greater, more preferably 410 min or greater and even more preferably 420 min or greater. If the RBOT life of the lubricating base oil is less than the specified lower limit, the viscosity-temperature characteristic and heat and oxidation stability of the lubricating base oil will tend to be reduced, while the efficacy of additives when added to the lubricating base oil will also tend to be reduced.

The RBOT life for the purpose of the invention is the RBOT value as measured according to JIS K 2514-1996, for a composition obtained by adding a phenol-based antioxidant (2,6-di-tert-butyl-p-cresol: DBPC) at 0.2% by mass to the lubricating base oil.

The freezing point of the lubricating base oil of the first embodiment will depend on the viscosity grade of the lubricating base oil, but as a preferred example of a lubricating base oil according to the first embodiment there may be mentioned a lubricating base oil with a kinematic viscosity at 100° C. of 3.5-6 $mm^2/s$, a viscosity index of 130 or greater and a freezing point of not higher than −25° C. The freezing point in this case is more preferably not higher than −26° C. and even more preferably not higher than −28° C. Under temperature conditions of about −30° C. it is possible to obtain sufficient low-temperature characteristics even if the freezing point of the lubricating base oil is above −25° C., but in order to realize a lubricating oil with an excellent low-temperature viscosity characteristic at −35° C. or lower (CCS viscosity, MRV viscosity, BF viscosity) and especially a lubricating oil with vastly improved MRV viscosity at −40° C., it is important for the freezing point to be not higher than −25° C., and preferably not higher than −26° C. Although the low-temperature performance can be improved by lowering the freezing point of the lubricating base oil, the freezing point is preferably −45° C. or higher, more preferably −40° C. or higher and even more preferably −35° C. or higher from the viewpoint of lowering the viscosity index and increasing economy. According to the invention it is possible to achieve high levels of both high viscosity index and low-temperature characteristics by limiting the freezing point of the lubricating base oil to −35 to −26° C., which is also particularly preferred to obtain a highly economical lubricating base oil. A lubricating base oil with a freezing point of not higher than −25° C. can be obtained by dewaxing treatment by the aforementioned solvent dewaxing method or catalytic dewaxing method, but any dewaxing treatment process may be applied so long as the freezing point of the lubricating base oil after dewaxing treatment is −25° C. or lower.

The "freezing point" according to the invention is a temperature 1° C. lower than the minimum temperature at which flow of the sample is observed, as measured with the pour point measurement interval according to JIS K 2269-1987 (JIS Pour Point) (2.5° C.) set to 1° C. Results with an interval of 2.5° C. are obtained by the JIS Pour Point method, but considering the measurement error and reproducibility of this method, it is not suitable for the present invention which requires strict control of the critical point for the low-temperature characteristic.

For a lubricating oil composition containing the lubricating base oil of the first embodiment, the MRV viscosity at −40° C. may be preferably not greater than 60,000 mPa·s, more preferably not greater than 30,000 mPa·s, even more preferably not greater than 20,000 mPa·s and most preferably not greater than 15,000 mPa·s, and the yield stress may be 0 Pa (no yield stress). The MRV viscosity at −40° C. and yield stress according to the invention are, respectively, the viscosity and yield stress measured according to ASTM D 4684.

Second Embodiment

The lubricating base oil according to the second embodiment of the invention is characterized by having a kinematic viscosity at 100° C. of 3.5-6 $mm^2/s$, a viscosity index of 130 or higher and a freezing point of not higher than −25° C.

The lubricating base oil of the second embodiment is not particularly restricted so long as the kinematic viscosity at 100° C., viscosity index and freezing point satisfy these conditions. Specifically, there may be mentioned purified paraffinic mineral oils produced by subjecting a lube-oil distillate obtained by atmospheric distillation and/or vacuum distillation of crude oil to a single treatment or two or more treatments from among refining treatments such as solvent deasphalting, solvent extraction, hydrocracking, solvent dewaxing, catalytic dewaxing, hydrorefining, sulfuric acid treatment or white clay treatment, or normal paraffin base oils, isoparaffinic base oils and the like, whose kinematic viscosity at 100° C., viscosity index and freezing point satisfy the aforementioned conditions. These lubricating base oils may be used alone or in combinations of two or more.

As a preferred example for the lubricating base oil of the second embodiment there may be mentioned a base oil obtained by using one of the base oils (1)-(8) explained for the first embodiment as the raw material and purifying this feedstock oil and/or the lube-oil distillate recovered from the feedstock oil by a prescribed refining process, and recovering the lube-oil distillate. As particularly preferred lubricating base oils there may be mentioned base oils (9) and (10) mentioned above in the explanation of the first embodiment.

The processes for production and treatment of the lubricating base oil of the second embodiment are the same as for the first embodiment described above and will not be repeated here. Production processes A and B for the first embodiment are preferably applied for production of a lubricating base oil of the second embodiment.

A lubricating base oil according to the second embodiment will now be explained in further detail.

The kinematic viscosity at 100° C. of the lubricating base oil of the second embodiment is 3.5-6 $mm^2/s$ as mentioned above, but it is preferably 3.7-4.5 $mm^2/s$ and more preferably 3.9-4.2 $mm^2/s$. If the kinematic viscosity at 100° C. of the lubricating base oil is less than 3.5 $mm^2/s$, the evaporation loss will be increased, while if it exceeds 6 $mm^2/s$ the low-temperature viscosity characteristic at −40° C. will be significantly impaired.

There are no particular restrictions on the kinematic viscosity at 40° C. of the lubricating base oil of the second embodiment, but it is preferably 12-32 $mm^2/s$, more preferably 13-19 $mm^2/s$ and even more preferably 15-17.5 $mm^2/s$. If the kinematic viscosity at 40° C. of the lubricating base oil is less than 12 $mm^2/s$, the evaporation loss will tend to be increased, while if it exceeds 32 $mm^2/s$ the −40° C. low-temperature viscosity characteristic will tend to be significantly impaired.

The viscosity index of the lubricating base oil of the second embodiment is 130 or higher as mentioned above, but it is preferably 135 or higher and more preferably 138 or higher. If the viscosity index is less than 130, the viscosity-temperature characteristic will be inadequate. The viscosity index of the lubricating base oil of the second embodiment is preferably not greater than 160 and more preferably not greater than 150. If the viscosity index exceeds 160, the low-temperature viscosity characteristic will tend to be inadequate.

The freezing point of the lubricating base oil of the second embodiment is not higher than −25° C. as mentioned above, but it is preferably not higher than −26° C. and more preferably not higher than −28° C. Under temperature conditions of about −30° C. it is possible to obtain sufficient low-temperature characteristics even if the freezing point of the lubricating base oil is above −25° C., but in order to realize a lubricating oil with an excellent low-temperature viscosity characteristic at below −35° C. (CCS viscosity, MRV viscosity, BF viscosity) and especially a lubricating oil with vastly improved MRV viscosity at −40° C., it is important for the freezing point to be not higher than −25° C., and preferably not higher than −26° C. Although the low-temperature performance can be improved by lowering the freezing point of the lubricating base oil, the freezing point is preferably −45° C. or higher, more preferably −40° C. or higher and even more preferably −35° C. or higher from the viewpoint of lowering the viscosity index and increasing economy. According to the invention it is possible to achieve high levels of both high viscosity index and low-temperature characteristics by limiting the freezing point of the lubricating base oil to −35 to −26° C., which is also particularly preferred to obtain a highly economical lubricating base oil. A lubricating base oil with a freezing point of not higher than −25° C. can be obtained by dewaxing treatment by the aforementioned solvent dewaxing method or catalytic dewaxing method, but any dewaxing treatment process may be applied so long as the freezing point of the lubricating base oil after dewaxing treatment is −25° C. or lower.

According to the second embodiment, the CCS viscosity at −35° C. of the lubricating base oil may be preferably not greater than 2800 mPa·s, more preferably not greater than 2200 mPa·s and even more preferably not greater than 2000 mPa·s.

For a lubricating oil composition containing the lubricating base oil of the second embodiment, the MRV viscosity at −40° C. may be preferably not greater than 60,000 mPa·s, more preferably not greater than 30,000 mPa·s, even more preferably not greater than 20,000 mPa·s and most preferably not greater than 15,000 mPa·s, and the yield stress may be 0 Pa (no yield stress).

For a lubricating oil composition containing the lubricating base oil of the second embodiment, the BF viscosity at −40° C. may be preferably not greater than 20,000 mPa·s, more preferably not greater than 15,000 mPa·s, even more preferably not greater than 10,000 mPa·s and most preferably not greater than 8000 mPa·s.

There are no particular restrictions on the other physical properties and composition of the lubricating base oil of the second embodiment (the saturated component content of the lubricating base oil, the proportion of cyclic saturated components among the saturated components, the proportion of branched paraffins and straight-chain paraffins in the lubricating base oil, the content of monocyclic saturated components and bicyclic saturated components among the saturated components, the ratio ($M_A/M_B$, $M_A/M_C$) of the mass ($M_A$) of monocyclic saturated components, the mass ($M_B$) of bicyclic or greater saturated components, and the mass ($M_C$) of bicyclic saturated components in the saturated components, the aromatic components content of the lubricating base oil, the iodine value of the lubricating base oil, the conditions represented by formula (2) above, and the % $C_P$, % $C_N$, % $C_A$ %, $C_P$/% $C_N$, sulfur content and nitrogen content of the lubricating base oil), so long as the kinematic viscosity at 100° C., viscosity index and freezing point satisfy the conditions specified above, but the physical properties and composition explained above for the lubricating base oil of the first embodiment are preferred. Their explanation will be omitted here.

The 20° C. refractive index of the lubricating base oil of the second embodiment is preferably 1.450-1.465, more preferably 1.452-1.463 and even more preferably 1.453-1.462, in order to satisfy formula (2) above.

The pour point for the lubricating base oil of the second embodiment is preferably not higher than −20° C., more preferably not higher than −22.5° C., even more preferably not higher than −25° C., yet more preferably not higher than −27.5° C. and most preferably not higher than −30° C. If the pour point exceeds the aforementioned upper limit, the lubricating base oil and lubricating oil compositions containing the lubricating base oil will tend to have a reduced low-temperature viscosity characteristic at −35° C. or lower.

The density at 15° C. ($\rho_{15}$, units: $g/cm^3$) of the lubricating base oil of the second embodiment is preferably not greater than 0.835 $g/cm^3$, more preferably not greater than 0.830 $g/cm^3$, even more preferably not greater than 0.825 $g/cm^3$, and preferably 0.810 $g/cm^3$ or greater.

The NOACK evaporation amount of the lubricating base oil of the second embodiment is not particularly restricted, but it is preferably not greater than 20% by mass, more preferably not greater than 16% by mass and even more preferably not greater than 15% by mass, and preferably 6% by mass or greater, more preferably 8% by mass or greater and even more preferably 10% by mass or greater. If the NOACK evaporation amount is below the aforementioned lower limit it will tend to be difficult to improve the low-temperature viscosity characteristic. If the NOACK evaporation amount is above the respective upper limit, the evaporation loss of the lubricating oil will be increased when the lubricating base oil is used as a lubricating oil for an internal combustion engine, and catalyst poisoning will be undesirably accelerated as a result.

The aniline point (AP (° C.)) of the lubricating base oil of the second embodiment is preferably 113° C. or higher, more preferably 116° C. or higher, even more preferably 118° C. or higher and most preferably 120° C. or higher.

As regards the distillation property of the lubricating base oil of the second embodiment, the initial boiling point (IBP) by gas chromatography distillation is preferably 300-380° C., more preferably 320-370° C. and even more preferably 330-360° C. The 10% distillation temperature (T10) is preferably 340-420° C., more preferably 350-410° C. and even more preferably 360-400° C. The 50% distillation temperature (T50) is preferably 380-460° C., more preferably 390-450° C. and even more preferably 400-460° C. The 90% distillation temperature (T90) is preferably 440-500° C., more preferably 450-490° C. and even more preferably 460-480° C. The final boiling point (FBP) is preferably 460-540° C., more preferably 470-530° C. and even more preferably 480-520° C. T90-T10 is preferably 50-100° C., more preferably 60-95° C. and even more preferably 80-90° C. FBP-IBP is preferably 100-250° C., more preferably 120-180° C. and even more preferably 130-160° C. T10-IBP is preferably 10-70° C., more preferably 15-60° C. and even more preferably 20-50° C. FBP-T90 is preferably 10-50° C., more preferably 20-40° C. and even more preferably 25-35° C. By setting IBP, T10, T50, T90, FBP, T90-T10, FBP-IBP, T10-IBP and FBP-T90 within the preferred ranges specified above, it is possible to further improve the low temperature viscosity and further reduce the evaporation loss. If the distillation ranges for T90-T10, FBP-IBP, T10-IBP and FBP-T90 are too narrow, the lubricating base oil yield will be poor resulting in low economy.

The lubricating base oil of the second embodiment can exhibit excellent heat and oxidation stability since its kinematic viscosity at 100° C., viscosity index and freezing point satisfy the conditions specified above, but its RBOT life is preferably 350 min or longer, more preferably 370 min or longer and even more preferably 380 min or longer. If the RBOT life of the lubricating base oil is less than the specified lower limit, the viscosity-temperature characteristic and heat and oxidation stability of the lubricating base oil will tend to be reduced, while the efficacy of additives when added to the lubricating base oil will also tend to be reduced.

The lubricating oil composition of the second embodiment preferably contains a pour point depressant and/or viscosity index improver among the aforementioned additives, from the viewpoint of drastically improving the BF viscosity at −40° C. or MRV viscosity. The pour point of the lubricating oil composition containing a pour point depressant and/or viscosity index improver is preferably −60 to −35° C. and more preferably −50 to −40° C.

The lubricating base oils according to the first embodiment and second embodiment exhibit excellent viscosity-temperature characteristics and heat and oxidation stability, as well as improved frictional properties of the lubricating base oils themselves, making it possible to achieve an increased friction reducing effect and thus improved energy savings. When additives are included in the lubricating base oils of the first embodiment and second embodiment, the functions of the additives (improving heat and oxidation stability by antioxidants, increased friction reducing effect by friction modifiers, improved wear resistance by anti-wear agents, etc.) are exhibited at a higher level. The lubricating base oils of the first embodiment and second embodiment can be applied as base oils for a variety of lubricating oils. The specific uses of the lubricating base oils of the first embodiment and second embodiment may be as lubricating oils for an internal combustion engine such as a passenger vehicle gasoline engine, two-wheel vehicle gasoline engine, diesel engine, gas engine, gas heat pump engine, ship engine, electric power engine or the like (internal combustion engine lubricating oil), as a lubricating oil for a drive-train such as an automatic transmission, manual transmission, continuously variable transmission, final reduction gear or the like (drive-train oil), as a hydraulic oil for a hydraulic power unit such as a damper, construction machine or the like, or as a compressor oil, turbine oil, industrial gear oil, refrigerator oil, rust preventing oil, heating medium oil, gas holder seal oil, bearing oil, paper machine oil, machine tool oil, sliding guide surface oil, electrical insulation oil, shaving oil, press oil, rolling oil, heat treatment oil or the like, and using the lubricating base oils of the first embodiment and second embodiment for these purposes will allow the improved characteristics of the lubricating oil including the viscosity-temperature characteristic, heat and oxidation stability, energy savings and fuel efficiency to be exhibited at a high level, together with a longer lubricating oil life and lower levels of environmentally unfriendly substances.

When a lubricating base oil according to the first embodiment or second embodiment is used as the base oil for a lubricating oil, the lubricating base oil of the first embodiment or second embodiment may be used alone, or the lubricating base oil of the first embodiment or second embodiment may be used in combination with one or more other base oils. When a lubricating base oil of the first embodiment or second embodiment is combined with another base oil, the proportion of the lubricating base oil of the first embodiment or second embodiment in the total mixed base oil is preferably 30% by mass or greater, more preferably 50% by mass or greater and even more preferably 70% by mass or greater.

There are no particular restrictions on the other base oil used in combination with the lubricating base oil of the first embodiment or second embodiment, and as examples of mineral oil base oils there may be mentioned solvent refined mineral oils, hydrocracked mineral oils, hydrorefined mineral oils and solvent dewaxed base oils having 100° C. dynamic viscosities of 1-100 $mm^2/s$.

As synthetic base oils there may be mentioned poly-α-olefins and their hydrides; isobutene oligomers and their hydrides; isoparaffins, alkylbenzenes, alkylnaphthalenes, diesters (ditridecyl glutarate, di-2-ethylhexyl adipate, diisodecyl adipate, ditridecyl adipate, di-2-ethylhexyl sebacate and the like), polyol esters (trimethylolpropane caprylate, trimethylolpropane pelargonate, pentaerythritol 2-ethyl hexanoate, pentaerythritol pelargonate and the like), polyoxyalkylene glycols, dialkyldiphenyl ethers and polyphenyl ethers, among which poly-α-olefins are preferred. As typical poly-α-olefins there may be mentioned C2-C32 and preferably C6-C16 α-olefin oligomers or co-oligomers (1-octene oligomer, decene oligomer, ethylene-propylene co-oligomers and the like), and their hydrides.

There are no particular restrictions on the process for producing poly-α-olefins, and as examples there may be mentioned a process wherein an α-olefin is polymerized in the presence of a polymerization catalyst such as a Friedel-Crafts catalyst comprising a complex of aluminum trichloride or boron trifluoride with water, an alcohol (ethanol, propanol, butanol or the like) and a carboxylic acid or ester.

The additives included in the lubricating base oil of the first embodiment or second embodiment are not particularly restricted, and any additives that are commonly employed in the field of lubricating oils may be used. As specific lubricating oil additives there may be mentioned antioxidants, ashless despersants, metal-based detergents, extreme-pressure agents, anti-wear agents, viscosity index improvers, pour point depressants, friction modifiers, oiliness improvers, corrosion inhibitors, rust-preventive agents, demulsifiers, metal deactivators, seal swelling agents, antifoaming agents, coloring agents, and the like. These additives may be used alone or in combinations of two or more.

Third Embodiment

The lubricating oil composition for an internal combustion engine according to the third embodiment is characterized by comprising a lubricating base oil according to the first embodiment or second embodiment described above, (A-1) a phosphorus-based anti-wear agent at 0.02-0.08% by mass in terms of phosphorus element, (B-1) an ashless antioxidant at 0.5-3% by mass and (C-1) an ashless dispersant at 3-12% by mass, based on the total amount of the composition. The descriptions of the lubricating base oils according to the first embodiment and second embodiment will not be repeated here. The lubricating oil composition for an internal combustion engine of the third embodiment may further contain the mineral base oils and synthetic base oils mentioned above in the explanation of the first embodiment, in addition to the lubricating base oil according to the first embodiment or second embodiment, and those mineral base oils and synthetic base oils will not be repeated here.

The lubricating oil composition for an internal combustion engine of the third embodiment comprises a phosphorus-based anti-wear agent as component (A-1). As phosphorus-based anti-wear agents there may be mentioned phosphorus-based anti-wear agents containing no sulfur as a constituent element, and anti-wear agents containing both phosphorus and sulfur (phosphorus-sulfur-based anti-wear agents).

As phosphorus-based anti-wear agents containing no sulfur as a structural element there may be mentioned phosphoric acid, phosphorous acid, phosphoric acid esters (including phosphoric acid monoesters, phosphoric acid diesters and phosphoric acid triesters), phosphorous acid esters (including phosphorous acid monoesters, phosphorous acid diesters and phosphorous acid triesters), and salts of the foregoing (such as amine salts or metal salts). As phosphoric acid esters and phosphorous acid esters there may generally be used those with C2-C30 and preferably C3-C20 hydrocarbon groups.

As phosphorus-sulfur-based extreme-pressure agents there may be mentioned thiophosphoric acid, thiophosphorous acid, thiophosphoric acid esters (including thiophosphoric acid monoesters, thiophosphoric acid diesters and thiophosphoric acid triesters), thiophosphorous acid esters (including thiophosphorous acid monoesters, thiophosphorous acid diesters and thiophosphorous acid triesters), salts of the foregoing, and zinc dithiophosphate. As thiophosphoric acid esters and thiophosphorous acid esters there may generally be used those with C2-C30 and preferably C3-C20 hydrocarbon groups.

As phosphorus-based anti-wear agents there are preferred one or more phosphorus-based anti-wear agents selected from the group consisting of phosphorus compounds represented by the following general formula (4-a), phosphorus compounds represented by the following general formula (4-b), and metal salts (excluding tungsten salts) or amine salts thereof, as well as derivatives of the foregoing.

[Chemical Formula 1]

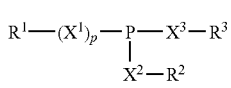

(4-a)

[In the formula, $R^1$ represents a C1-C30 hydrocarbon group, $R^2$ and $R^3$ each independently represent hydrogen or a C1-C30 hydrocarbon group, $X^1$, $X^2$ and $X^3$ each represent an oxygen atom or sulfur atom, and p represents 0 or 1.]

[Chemical Formula 2]

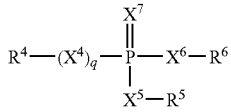

(4-b)

[In the formula, $R^4$ represents a C1-C30 hydrocarbon group, $R^5$ and $R^6$ each independently represent hydrogen or a C1-C30 hydrocarbon group, $X^4$, $X^5$, $X^6$ and $X^7$ each represent an oxygen atom or sulfur atom, and q represents 0 or 1.]

As C1-C30 hydrocarbon groups for $R^1$-$R^6$ in general formulas (4-a) and (4-b) there may be mentioned, specifically, alkyl, cycloalkyl, alkenyl, alkyl-substituted cycloalkyl, aryl, alkyl-substituted aryl and arylalkyl groups.

As examples of alkyl groups there may be mentioned alkyl groups such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl and octadecyl (which alkyl groups may be straight-chain or branched).

As cycloalkyl groups there may be mentioned C5-C7 cycloalkyl groups such as cyclopentyl, cyclohexyl and cycloheptyl. As examples of alkylcycloalkyl groups there may be mentioned C6-C11 alkylcycloalkyl groups such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl and diethylcycloheptyl (where the alkyl groups may be substituted at any position on the cycloalkyl groups).

As examples of alkenyl groups there may be mentioned alkenyl groups such as butenyl, pentenyl, hexenyl, heptenyl, octenyl, nonenyl, decenyl, undecenyl, dodecenyl, tridecenyl, tetradecenyl, pentadecenyl, hexadecenyl, heptadecenyl and octadecenyl (where the alkenyl groups may be straight-chain or branched, and the double bonds may be at any positions).

As examples of aryl groups there may be mentioned aryl groups such as phenyl and naphthyl. As examples of alkylaryl groups there may be mentioned C7-C18 alkylaryl groups such as tolyl, xylyl, ethylphenyl, propylphenyl, butylphenyl, pentylphenyl, hexylphenyl, heptylphenyl, octylphenyl, nonylphenyl, decylphenyl, undecylphenyl and dodecylphenyl (where the alkyl groups may be straight-chain or branched and substituted at any positions on the aryl groups).

As examples of arylalkyl groups there may be mentioned C7-C12 arylalkyl groups such as benzyl, phenylethyl, phenylpropyl, phenylbutyl, phenylpentyl and phenylhexyl (where the alkyl groups may be either straight-chain or branched).

The C1-C30 hydrocarbon groups represented by $R^1$-$R^6$ are preferably C1-C30 alkyl or C6-C24 aryl groups, more preferably C3-C18 and even more preferably C4-C12 alkyl groups.

As examples of phosphorus compounds represented by general formula (4-a) there may be mentioned phosphorous acid monoesters, monothiophosphorous acid monoesters, dithiophosphorous acid monoesters, (hydrocarbyl)phosphonous acid, (hydrocarbyl)monothiophosphonous acid and (hydrocarbyl)dithiophosphonic acid having one C1-C30 hydrocarbon group; phosphorous acid diesters, monothiophosphorous acid diesters, dithiophosphorous acid diesters, (hydrocarbyl)phosphonous acid monoesters, (hydrocarbyl)monothiophosphonous acid monoesters and (hydrocarbyl)dithiophosphonous acid monoesters having two C1-C30 hydrocarbon groups; phosphorous acid triesters, monothiophosphorous acid triesters, dithiophosphorous acid triesters, (hydrocarbyl)phosphonous acid diesters, (hydrocarbyl)monothiophosphonous acid diesters and (hydrocarbyl) dithiophosphonous acid diesters having three C1-C30 hydrocarbon groups, and their derivatives, i.e. compounds containing hetero elements such as N, O and S in the hydrocarbon groups, and tri(hexylthioethoxy)phosphorous acid esters, tri(octylthioethoxy)phosphorous acid esters, tri(dodecylthioethoxy)phosphorous acid esters, tri(hexadecylthioethoxy)phosphorous acid esters, di(hexylthioethoxy)phosphorous acid esters, di(octylthioethoxy)phosphorous acid esters, di(dodecylthioethoxy)phosphorous acid esters, di(hexadecylthioethoxy)phosphorous acid esters, mono(hexylthioethoxy)phosphorous acid esters, mono(octylthioethoxy)phosphorous acid esters, mono(dodecylthioethoxy)phosphorous acid esters and mono(hexadecylthioethoxy)phosphorous acid esters; as well as mixtures of the foregoing.

According to the invention, the compound represented by general formula (4-a) is preferably a compound wherein at least one of $X^1$-$X^3$ is an oxygen atom, and more preferably a compound wherein all of $X^1$-$X^3$ are oxygen atoms, i.e. a compound represented by the following general formula (4-c).

[Chemical Formula 3]

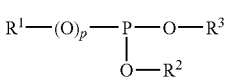

(4-c)

[In the formula, $R^1$ represents a C1-C30 hydrocarbon group, $R^2$ and $R^3$ may be the same or different and each represents hydrogen or a C1-C30 hydrocarbon group, and p represents 0 or 1.]

As examples of phosphorus compounds represented by general formula (4-b) there may be mentioned phosphoric acid monoesters, monothiophosphoric acid monoesters, dithiophosphoric acid monoesters, (hydrocarbyl)phosphonic acid, (hydrocarbyl)monothiophosphonic acid and (hydrocarbyl)dithiophosphonic acid, having one C1-C30 hydrocarbon group; phosphoric acid diesters, monothiophosphoric acid diesters, dithiophosphoric acid diesters, (hydrocarbyl)phosphonic acid monoesters, (hydrocarbyl)monothiophosphonic acid monoesters and (hydrocarbyl)dithiophosphonic acid monoesters having two C1-C30 hydrocarbon groups; phosphoric acid triesters, monothiophosphoric acid triesters, dithiophosphoric acid triesters, (hydrocarbyl)phosphonic acid diesters and (hydrocarbyl)monothiophosphonic acid diesters and (hydrocarbyl)dithiophosphonic acid diesters having C1-C30 hydrocarbon groups, and their derivatives, i.e. compounds containing hetero elements such as N, O and S in the hydrocarbon groups, and tri(hexylthioethoxy)phosphoric acid esters, tri(octylthioethoxy)phosphoric acid esters, tri(dodecylthioethoxy)phosphoric acid esters, tri(hexadecylthioethoxy)phosphoric acid esters, di(hexylthioethoxy)phosphoric acid esters, di(octylthioethoxy)phosphoric acid esters, di(dodecylthioethoxy)phosphoric acid esters, di(hexadecylthioethoxy)phosphoric acid esters, mono(hexylthioethoxy)phosphoric acid esters, mono(octylthioethoxy)phosphoric acid esters, mono(dodecylthioethoxy)phosphoric acid esters and mono(hexadecylthioethoxy)phosphoric acid esters; as well as mixtures of the foregoing.

According to the invention, the compound represented by general formula (4-b) is preferably a compound wherein at least two of $X^4$-$X^7$ are oxygen atoms, and more preferably a compound wherein all of $X^4$-$X^7$ are oxygen atoms, i.e. a compound represented by the following general formula (4-d).

[Chemical Formula 4]

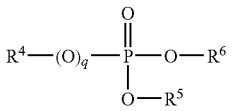

(4-d)

[In the formula, $R^4$ represents a C1-C30 hydrocarbon group, $R^5$ and $R^6$ may be the same or different and each represents hydrogen or a C1-C30 hydrocarbon group, and q represents 0 or 1.]

Metal salts or amine salts of phosphorus compounds represented by general formula (4-a) or (4-b) may be obtained by reacting metal bases such as metal oxides, metal hydroxides, metal carbonates, metal chlorides and the like, or nitrogen compounds such as ammonia and amine compounds containing only C1-C30 hydrocarbon or hydroxyl group-containing hydrocarbon groups in the molecule, with the phosphorus compounds represented by general formula (4-a) or (4-b), and neutralizing all or a portion of the residual acidic hydrogens.

As metals for the metal base there may be mentioned, specifically, alkali metals such as lithium, sodium, potassium and cesium, alkaline earth metals such as calcium, magnesium and barium, and heavy metals such as zinc, copper, iron, lead, nickel, silver, molybdenum and manganese. Preferred among these are alkaline earth metals such as calcium and magnesium, and molybdenum and zinc, with zinc being particularly preferred.

These metal salts of phosphorus compounds will have different structures depending on the valency of the metals and on the number of OH or SH groups in the phosphorus compounds, and therefore no limitations are placed on the structures of the phosphorus compound metal salts. For example, when 1 mol of zinc oxide is reacted with 2 mol of phosphoric acid diester (a compound with one OH group), a compound having the structure represented by the following formula (4-e) may be obtained as the major component, although polymerized molecules may also be present.

[Chemical Formula 5]

(4-e)

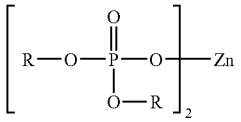

[In the formula, each R independently represents hydrogen or a C1-C30 hydrocarbon group.]

Or when, for example, 1 mol of zinc oxide is reacted with 1 mol of phosphoric acid monoester (a compound with two OH groups), a compound having the structure represented by the following formula (4-f) may be obtained as the major component, although polymerized molecules may also be present.

[Chemical Formula 6]

(4-f)

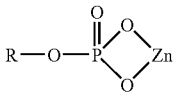

[In the formula, each R represents hydrogen or a C1-C30 hydrocarbon group.]

As specific nitrogen compounds there may be mentioned the monoamines, diamines, polyamines and alkanolamines mentioned above in the explanation for tungsten-amine complexes. Heterocyclic compounds such as N-hydroxyethyloleylimidazoline and aminealkylene oxide addition products onto amine compounds may also be used.

Of these nitrogen compounds there may be mentioned as preferred examples aliphatic amines with C10-C20 alkyl or alkenyl groups such as decylamine, dodecylamine, tridecylamine, heptadecylamine, octadecylamine, oleylamine and stearylamine (which may be straight-chain or branched).

According to the invention, the aforementioned phosphorus-based anti-wear agents may be used alone or in combinations of two or more.

As phosphorus-based anti-wear agents for the invention there are preferred phosphorus compounds represented by general formula (4-c) and (4-d) above and their metal salts, and particularly preferred are zinc or calcium salts of phosphorous acid diesters with two C3-C18 alkyl or aryl groups, phosphorous acid triesters with three C3-C18 alkyl or aryl groups and especially C6-C12 alkyl groups, zinc or calcium salts of phosphoric acid monoesters with one C3-C18 alkyl or aryl group, zinc or calcium salts of phosphoric acid diesters with two C3-C18 alkyl or aryl groups, phosphoric acid triesters with three C3-C18 alkyl or aryl groups and preferably C6-C12 alkyl groups, zinc or calcium salts of (hydrocarbyl) phosphonous acid with one C1-C18 alkyl or aryl group, zinc or calcium salts of (hydrocarbyl)phosphonous acid monoesters with two C1-C18 alkyl or aryl groups, (hydrocarbyl)phosphonous acid diesters with three C1-18 alkyl or aryl groups, zinc or calcium salts of (hydrocarbyl)phosphonic acid with one C1-C18 alkyl or aryl group, zinc or calcium salts of (hydrocarbyl)phosphonic acid monoesters with two C1-C18 alkyl or aryl groups, and (hydrocarbyl)phosphonic acid diesters with three C1-C18 alkyl or aryl groups.

The aforementioned (hydrocarbyl)phosphonic (phosphonous) acids, their metal salts, (hydrocarbyl)phosphonic (phosphonous) acid monoesters, their metal salts and (hydrocarbyl)phosphonic (phosphonous) acid diesters preferably have a total of C12-C30, more preferably C14-C24 and even more preferably C16-C20 hydrocarbon groups, from the viewpoint of oil solubility and extreme-pressure property.

The phosphorus-based anti-wear agent content in the lubricating oil composition for an internal combustion engine according to the third embodiment is 0.02-0.08% by mass as mentioned above, but it is preferably 0.02-0.06% by mass and most preferably 0.04-0.05% by mass in terms of phosphorus element based on the total amount of the composition. If the phosphorus-based anti-wear agent content is less than 0.02% by mass in terms of phosphorus element, the anti-wear property will tend to be insufficient. On the other hand, if the phosphorus-based anti-wear agent content exceeds 0.08% by mass in terms of phosphorus element, it will be difficult to maintain the performance of exhaust gas aftertreatment devices for long periods.

The lubricating oil composition for an internal combustion engine of the third embodiment comprises an ashless antioxidant as component (B-1). As ashless antioxidants there may be used any chain terminated ashless antioxidants commonly employed in lubricating oils, such as phenol-based antioxidants or amine-based anti oxidants.

As preferred examples of phenol-based antioxidants there may be mentioned 4,4'-methylenebis(2,6-di-tert-butylphenol), 4,4'-bis(2,6-di-tert-butylphenol), 4,4'-bis(2-methyl-6-tert-butylphenol), 2,2'-methylenebis(4-ethyl-6-tert-butylphenol), 2,2'-methylenebis(4-methyl-6-tert-butylphenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidenebis(4,6-dimethylphenol), 2,2'-methylenebis(4-methyl-6-cyclohexylphenol), 2,6-di-tert-butyl-4-methylphenol, 2,6-di-tert-butyl-4-ethylphenol, 2,4-dimethyl-6-tert-butylphenol, 2,6-di-tert-α-dimethylamino-p-cresol, 2,6-di-tert-butyl-4(N,N-dimethylaminomethylphenol), 4,4'-thiobis(2-methyl-6-tert-butylphenol), 4,4'-thiobis(3-methyl-6-tert-butylphenol), 2,2'-thiobis(4-methyl-6-tert-butylphenol), bis(3-methyl-4-hydroxy-5-tert-butylbenzyl)sulfide, bis(3,5-di-tert-butyl-4-hydroxybenzyl)sulfide, 2,2'-thio-diethylenebis[3-(3,5-di-tert-butyl-4-hydroxyphenyl)propionate], tridecyl-3-(3,5-di-tert-butyl-4-hydroxyphenyl)propionate, pentaerythrityl-tetrakis[3-(3,5-di-tert-butyl-4-hydroxyphenyl)propionate], octyl-3-(3,5-di-tert-butyl-4-hydroxyphenyl)propionate, octadecyl-3-(3,5-di-tert-butyl-4-hydroxyphenyl)propionate, 3-methyl-5-tert-butyl-4-hydroxyphenyl-substituted fatty acid esters and the like. Any of these compounds may be used alone, or two or more thereof may be used in combination.

As examples of amine-based antioxidants there may be mentioned phenyl-α-naphthylamine, alkylphenyl-α-naphthylamine and dialkyldiphenylamine. Any of these compounds may be used alone, or two or more thereof may be used in combination.

The aforementioned phenol-based antioxidants and amine-based antioxidants may also be used in combination.

The ashless antioxidant content in the lubricating oil composition for an internal combustion engine according to the third embodiment is 0.5-3% by mass as mentioned above, but it is preferably 0.8-2% by mass, based on the total amount of the composition. If the ashless antioxidant content is less than 0.5% by mass, the oxidation life will be inadequate. If the ashless antioxidant content exceeds 3% by mass, there will be no effect of improved oxidation life commensurate with the increased addition.

The lubricating oil composition for an internal combustion engine of the third embodiment comprises an ashless dispersant as component (C-1). It also preferably contains an additional ashless dispersant. As such ashless dispersants there may be mentioned alkenylsucciniimides and alkylsucciniimide s derived from polyolefins, and their derivatives. A typical succiniimide can be obtained by reacting succinic anhydride substituted with a high molecular amount alkenyl group or alkyl group, with a polyalkylenepolyamine containing an average of 4-10 (preferably 5-7) nitrogen atoms per molecule. The high molecular weight alkenyl group or alkyl group is preferably polybutene (polyisobutene) with a number-average molecular weight of 700-5000, and more preferably polybutene (polyisobutene) with a number-average molecular weight of 900-3000.

As examples of preferred polybutenylsucciniimides to be used in the lubricating oil composition for an internal combustion engine according to the third embodiment there may be mentioned compounds represented by the following general formulas (5-a) and (5-b).

[Chemical Formula 7]

(5-a)

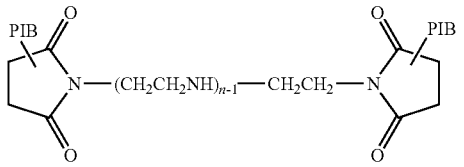

[Chemical Formula 8]

(5-b)

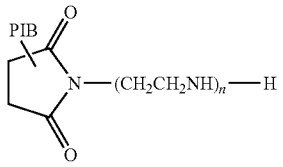

The PIB in general formulas (5-a) and (5-b) represent polybutenyl groups, which are obtained from polybutene produced by polymerizing high purity isobutene or a mixture of 1-butene and isobutene with a boron fluoride-based catalyst or aluminum chloride-based catalyst, and the polybutene mixture will usually include 5-100% by mole molecules with vinylidene structures at the ends. Also, from the viewpoint of obtaining a sludge-inhibiting effect, n is an integer of 2-5 and preferably an integer of 3-4.

There are no particular restrictions on the method of producing the succiniimide represented by general formula (5-a) or (5-b), and for example, polybutenylsuccinic acid obtained by reacting a chlorinated product of the aforementioned polybutene, preferably highly reactive polybutene polyisobutene) obtained by polymerization of the aforementioned high purity isobutene with a boron fluoride-based catalyst, and more preferably polybutene that has been thoroughly depleted of chlorine or fluorine, with maleic anhydride at 100-200° C., may be reacted with a polyamine such as diethylenetriamine, triethylenetetramine, tetraethylenepentamine or pentaethylenehexamine. The polybutenylsuccinic acid may be reacted with a two-fold (molar ratio) amount of polyamine for production of bissucciniimide, or the polybutenylsuccinic acid may be reacted with an equivalent (equimolar) amount of polyamine for production of a monosucciniimide. From the viewpoint of achieving excellent sludge dispersibility, a polybutenylbissucciniimide is preferred.

Since trace amounts of fluorine or chlorine can remain in the polybutene used in the production process described above as a result of the catalyst used in the process, it is preferred to use polybutene that has been thoroughly depleted of fluorine or chlorine by an appropriate method such as adsorption or thorough washing with water. The fluorine or chlorine content is preferably not greater than 50 ppm by mass, more preferably not greater than 10 ppm by mass, even more preferably not greater than 5 ppm by mass and most preferably not greater than 1 ppm by mass.

In processes where polybutene is reacted with maleic anhydride to obtain polybutenylsuccinic anhydride, it has been the common practice to employ a chlorination method using chlorine. However, such methods result in significant chlorine residue (for example, approximately 2000-3000 ppm) in the final succiniimide product. On the other hand, methods that employ no chlorine, such as methods using highly reactive polybutene and/or thermal reaction processes, can limit residual chlorine in the final product to extremely low levels (for example, 0-30 ppm). In order to reduce the chlorine content in the lubricating oil composition to within a range of 0-30 ppm by mass, therefore, it is preferred to use polybutenylsuccinic anhydride obtained not by the aforementioned chlorination method but by a method using the aforementioned highly reactive polybutene and/or a thermal reaction process.

As polybutenylsucciniimide derivatives there may be used "modified" succiniimides obtained by reacting boron compounds such as boric acid or oxygen-containing organic compounds such as alcohols, aldehydes, ketones, alkylphenols, cyclic carbonates, organic acids and the like with compounds represented by general formula (5-a) or (5-b) above, and neutralizing or amidating all or a portion of the residual amino groups and/or imino groups. Particularly advantageous from the viewpoint of heat and oxidation stability are boron-containing alkenyl (or alkyl) succiniimides obtained by reaction with boron compounds such as boric acid.

As boron compounds to be reacted with the compound represented by general formula (5-a) or (5-b) there may be mentioned boric acids, boric acid salts, boric acid esters and the like. As specific examples of boric acids there may be mentioned orthoboric acid, metaboric acid and tetraboric acid. As boric acid salts there may be mentioned alkali metal salts, alkaline earth metal salts and ammonium salts of boric acid, and as more specific examples there may be mentioned lithium borates such as lithium metaborate, lithium tetraborate, lithium pentaborate and lithium perborate; sodium borates such as sodium metaborate, sodium diborate, sodium tetraborate, sodium pentaborate, sodium hexaborate and sodium octaborate; potassium borates such as potassium metaborate, potassium tetraborate, potassium pentaborate, potassium hexaborate and potassium octaborate; calcium borates such as calcium metaborate, calcium diborate, tricalcium tetraborate, pentacalcium tetraborate and calcium hexaborate; magnesium borates such as magnesium metaborate, magnesium diborate, trimagnesium tetraborate, pentamagnesium tetraborate and magnesium hexaborate; and ammonium borates such as ammonium metaborate, ammonium tetraborate, ammonium pentaborate and ammonium octaborate. As boric acid esters there may be mentioned esters of boric acid and preferably C1-C6 alkyl alcohols, and as more specific examples there may be mentioned monomethyl borate, dimethyl borate, trimethyl borate, monoethyl borate, diethyl borate, triethyl borate, monopropyl borate, dipropyl borate, tripropyl borate, monobutyl borate, dibutyl borate, tributyl borate and the like. Succiniimide derivatives reacted with such boron compounds are preferred for superior heat resistance and oxidation stability.

As examples of oxygen-containing organic compounds to be reacted with the compound represented by general formula (5-a) or (5-b) there may be mentioned, specifically, C1-C30 monocarboxylic acids such as formic acid, acetic acid, glycolic acid, propionic acid, lactic acid, butyric acid, valeric acid, caproic acid, enanthic acid, caprylic acid, pelargonic acid, capric acid, undecylic acid, lauric acid, tridecanoic acid, myristic acid, pentadecanoic acid, palmitic acid, margaric acid, stearic acid, oleic acid, nonadecanoic acid and eicosanoic acid, C2-C30 polycarboxylic acids such as oxalic acid, phthalic acid, trimellitic acid and pyromellitic acid or their anhydrides or ester compounds, and C2-C6 alkylene oxides, hydroxy(poly)oxyalkylene carbonates and the like. Presumably, reaction of such oxygen-containing organic compounds produces a compound wherein all or a portion of the amino groups or imino groups in the compound represented by general formula (5-a) or (5-b) have the structure represented by general formula (5-c) below.

[Chemical Formula 9]

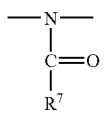

(5-c)

$R^7$ in general formula (5-c) represents hydrogen, C1-C24 alkyl, C1-C24 alkenyl, C1-C24 alkoxy or a hydroxy(poly)oxyalkylene group represented by —O—$(R^8O)_m$H, $R^8$ represents C1-C4 alkylene, and m represents an integer of 1-5. Preferred among these from the viewpoint of excellent sludge dispersibility are polybutenylbissuccinimides, composed mainly of product from reaction of these oxygen-containing organic compounds with all of the amino groups or imino groups. Such compounds can be obtained by reacting, for example, (n−1) moles of oxygen-containing organic compound with 1 mol of the compound represented by general formula (5-a), for example. Succiniimide derivatives obtained by reaction with such oxygen-containing organic compounds have excellent sludge dispersibility, and those reacted with hydroxy(poly)oxyalkylene carbonate are especially preferred.

The weight-average molecular weight of the polybutenylsucciniimide and/or its derivative as an ashless dispersant used for the invention is preferably 3000 or greater, more preferably 5000 or greater, even more preferably 6500 or greater, yet more preferably 7000 or greater and most preferably 8000 or greater. With a weight-average molecular weight of less than 5000, the molecular weight of the non-polar group polybutenyl groups will be low and the sludge dispersibility will be poor, while the oxidation stability will be inferior due to a higher proportion of amine portions of the polar groups, which can act as active sites for oxidative degradation, such that the usable life-lengthening effect of the invention may not be achieved. On the other hand, from the viewpoint of preventing reduction of the low-temperature viscosity characteristic, the weight-average molecular weight of the polybutenylsucciniimide and/or its derivative is preferably not greater than 20,000 and most preferably not greater than 15,000. The weight-average molecular weight referred to here is the weight-average molecular weight based on polystyrene, as measured using a 150-CALC/GPC by Japan Waters Co., equipped with two GMHHR-M (7.8 mmID×30 cm) columns by Tosoh Corp. in series, with tetrahydrofuran as the solvent, a temperature of 23° C., a flow rate of 1 mL/min, a sample concentration of 1% by mass, a sample injection rate of 75 μL and a differential refractometer (RI) as the detector.

According to the invention, the ashless dispersant used may be, in addition to the aforementioned succiniimide and/or its derivative, an alkyl or alkenylpolyamine, alkyl or alkenylbenzylamine, alkyl or alkenylsuccinic acid ester, Mannich base, or a derivative thereof.

The ashless dispersant content in the lubricating oil composition for an internal combustion engine according to the third embodiment is 3-12% by mass as mentioned above, but it is preferably 4-10% by mass, based on the total amount of the composition. If the ashless dispersant content is less than 3% by mass the dispersibility of the combustion product will be insufficient, and if it is greater than 12% by mass the viscosity-temperature characteristic will be insufficient The lubricating oil composition for an internal combustion engine according to the third embodiment may consist entirely of the lubricating base oil, phosphorus-based anti-wear agent, ashless antioxidant and ashless dispersant described above, but it may further contain the additives described below as necessary for further performance enhancement.

The lubricating oil composition for an internal combustion engine according to the third embodiment preferably contains a friction modifier to allow further improvement in the frictional properties. The friction modifier used may be any compound ordinarily used as a friction modifier for lubricating oils, and as examples there may be mentioned ashless friction modifiers that are amine compounds, fatty acid esters, fatty acid amides, fatty acids, aliphatic alcohols, aliphatic ethers, hydrazides (such as oleyl hydrazide), semicarbazides, ureas, ureidos, biurets and the like having one or more C6-C30 alkyl or alkenyl and especially C6-C30 straight-chain alkyl or straight-chain alkenyl groups in the molecule.

The friction modifier content of the lubricating oil composition for an internal combustion engine according to the third embodiment is preferably 0.01% by mass or greater, more preferably 0.1% by mass or greater and even more preferably 0.3% by mass or greater, and preferably not greater than 3% by mass, more preferably not greater than 2% by mass and even more preferably not greater than 1% by mass, based on the total amount of the composition. If the friction modifier content is less than the aforementioned lower limit the friction reducing effect by the addition will tend to be insufficient, while if it is greater than the aforementioned upper limit, the effects of the phosphorus-based anti-wear agent may be inhibited, or the solubility of the additives may be reduced.

The lubricating oil composition for an internal combustion engine according to the third embodiment preferably further contains a metal-based detergent from the viewpoint of cleanability. The metal-based detergent used is preferably at least one alkaline earth metal-based cleaning agent selected from among alkaline earth metal sulfonates, alkaline earth metal phenates and alkaline earth metal salicylates.

As alkaline earth metal sulfonates there may be mentioned alkaline earth metal salts, especially magnesium salts and/or calcium salts, and preferably calcium salts, of alkylaromatic sulfonic acids obtained by sulfonation of alkyl aromatic compounds with a molecular weight of 300-1,500 and preferably 400-700. As such alkylaromatic sulfonic acids there may be mentioned, specifically, petroleum sulfonic acids and synthetic sulfonic acids. As petroleum sulfonic acids there may be used sulfonated alkyl aromatic compounds from mineral oil lube-oil distillates, or "mahogany acids" that are by-products of white oil production. Examples of synthetic sulfonic acids that may be used include sulfonated products of alkylbenzenes with straight-chain or branched alkyl groups, either as by-products of alkylbenzene production plants that are used as starting materials for detergents or obtained by alkylation of polyolefins onto benzene, or sulfonated alkylnaphthalenes such as sulfonated dinonylnaphthalenes. There are no particular restrictions on the sulfonating agent used for sulfonation of these alkyl aromatic compounds, but for most purposes fuming sulfuric acid or sulfuric anhydride may be used.

As alkaline earth metal phenates there may be mentioned alkaline earth metal salts, and especially magnesium salts and/or calcium salts, of alkylphenols, alkylphenol sulfides and alkylphenol Mannich reaction products, examples of which include compounds represented by the following general formulas (6-a), (6-b) and (6-c).

[Chemical Formula 10]

(6-a)

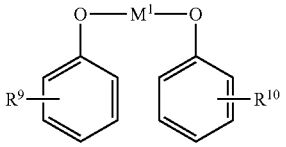

[Chemical Formula 11]

(6-b)

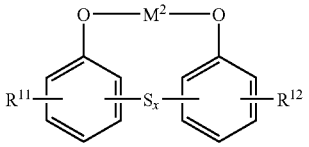

[Chemical Formula 12]

(6-c)

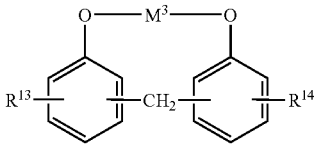

In general formulas (6-a)-(6-c), $R^9$, $R^{10}$, $R^{11}$, $R^{12}$, $R^{13}$ and $R^{14}$ may be the same or different and each represents a C4-C30 and preferably C6-C18 straight-chain or branched alkyl group, $M^1$, $M^2$ and $M^3$ each represent an alkaline earth metal and preferably calcium and/or magnesium, and x represents 1 or 2. As specific examples for $R^9$, $R^{10}$, $R^{11}$, $R^{12}$, $R^{13}$ and $R^{14}$ in the above formulas there may be mentioned butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl and triacontyl, which may be straight-chain or branched. These may be primary alkyl, secondary alkyl or tertiary alkyl groups.

As alkaline earth metal salicylates there may be mentioned alkaline earth metal salts, and especially magnesium salts and/or calcium salts, of alkylsalicylic acids, examples of which include compounds represented by the following general formula (6-d).

[Chemical Formula 13]

(6-d)

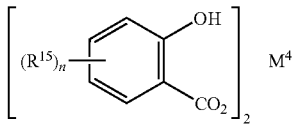

In general formula (6-d), $R^{15}$ represents a C1-C30 and preferably C6-C18 straight-chain or branched alkyl group, n represents an integer of 1-4 and preferably 1 or 2, and $M^4$ represents an alkaline earth metal and preferably calcium and/or magnesium. As specific examples for $R^{15}$ there may be mentioned butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl and triacontyl, which may be straight-chain or branched. These may be primary alkyl, secondary alkyl or tertiary alkyl groups.

Alkaline earth metal sulfonates, alkaline earth metal phenates and alkaline earth metal salicylates include not only neutral (normal salt) alkaline earth metal sulfonates, neutral (normal salt) alkaline earth metal phenates and neutral (normal salt) alkaline earth metal salicylates obtained by reacting the aforementioned alkylaromatic sulfonic acids, alkylphenols, alkylphenol sulfides, alkylphenol Mannich reaction products and alkylsalicylic acids directly with alkaline earth metal bases such as oxides or hydroxides of alkaline earth metals such as magnesium and/or calcium, or by first forming alkali metal salts such as sodium salts or potassium salts and then replacing them with alkaline earth metal salts, but also basic alkaline earth metal sulfonates, basic alkaline earth metal phenates and basic alkaline earth metal salicylates obtained by heating neutral alkaline earth metal sulfonates, neutral alkaline earth metal phenates and neutral alkaline earth metal salicylates with an excess of alkaline earth metal salts or alkaline earth metal bases in the presence of water, and overbased(superbased) alkaline earth metal sulfonates, overbased(superbased) alkaline earth metal phenates and overbased(superbased) alkaline earth metal salicylates obtained by reacting alkaline earth metal hydroxides with carbon dioxide gas or boric acid in the presence of neutral alkaline earth metal sulfonates, neutral alkaline earth metal phenates and neutral alkaline earth metal salicylates.

According to the invention, the aforementioned neutral alkaline earth metal salts, basic alkaline earth metal salts, overbased(superbased) alkaline earth metal salts or mixtures thereof may be used. Of these, combinations of overbased calcium sulfonate and overbased calcium phenate, or overbased calcium salicylate, are preferably used and overbased calcium salicylate is most preferably used, from the viewpoint of maintaining cleanability for prolonged periods. Metal-based detergents are generally marketed or otherwise available in forms diluted with gas lubricating base oils, and for most purposes the metal content will be 1.0-20% by mass and preferably 2.0-16% by mass. The alkaline earth metal-based detergent used for the invention may have any total base value, but for most purposes the total base value is not greater than 500 mgKOH/g and preferably 150-450 mgKOH/g. The total base value referred to here is the total base value determined by the perchloric acid method, as measured according to JIS K2501(1992): "Petroleum Product And Lubricants—Determination of Neutralization Number", Section 7.

The metal-based detergent content of the lubricating oil composition for an internal combustion engine according to the third embodiment may be as desired, but it is preferably 0.1-10% by mass, more preferably 0.5-8% by mass and even more preferably 1-5% by mass based on the total amount of the composition. The content is preferably greater than 10% by mass because no commensurate effect will be obtained with the increased addition.

The lubricating oil composition for an internal combustion engine according to the third embodiment preferably contains a viscosity index improver to allow further improvement in the viscosity-temperature characteristic. As viscosity index improvers there may be mentioned non-dispersant or dispersant polymethacrylates, dispersant ethylene-α-olefin copolymers and their hydrides, polyisobutylene and its hydride, styrene-diene hydrogenated copolymers, styrene-maleic anhydride ester copolymers and polyalkylstyrenes, among which non-dispersant viscosity index improvers and/or dispersant viscosity index improvers with weight-average molecular weights of 10,000-1,000,000, preferably 100,000-900,000, more preferably 150,000-500,000 and even more preferably 180,000-400,000 are preferred.

As specific examples of non-dispersant viscosity index improvers there may be mentioned homopolymers of a monomer (hereinafter referred to as "monomer (M-1)") selected from among compounds represented by the following general formulas (7-a), (7-b) and (7-c), and copolymers of two or more of monomer (M-1), or hydrides thereof. As specific examples of dispersant viscosity index improvers, on the other hand, there may be mentioned compounds obtained by introducing an oxygen-containing group into a copolymer of two or more monomers (hereinafter referred to as "monomer (M-2)") selected from among compounds represented by general formulas (7-d) and (7-e) or their hydrides, and copolymers of one or more of monomer (M-1) selected from among compounds represented by general formulas (7-a)-(7-c) with one or more of monomer (M-2) selected from among compounds represented by general formulas (7-d) and (7-e), or hydrides thereof.

[Chemical Formula 14]

(7-a)

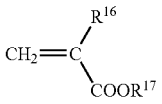

In general formula (7-a), $R^{16}$ represents hydrogen or methyl and $R^{17}$ represents hydrogen or a C1-18 alkyl group. Specific examples of C1-18 alkyl groups represented by $R^{17}$ include methyl, ethyl, propyl, butyl, pentyl, hexyl, heptyl, octyl, nonyl, decyl, decyl, undecyl, dodecyl, tridecyl, tetradecyl, pentadecyl, hexadecyl, heptadecyl and octadecyl (where the alkyl groups may be straight-chain or branched).

[Chemical Formula 15]

(7-b)

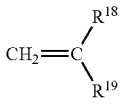

In general formula (7-b), $R^{18}$ represents hydrogen or methyl and $R^{19}$ represents hydrogen or a C1-12 hydrocarbon group. Specific examples of C1-12 hydrocarbon groups represented by $R^{19}$ include alkyl groups such as methyl, ethyl, propyl, butyl, pentyl, hexyl, heptyl, octyl, nonyl, decyl, undecyl and dodecyl (which alkyl groups may be straight-chain or branched); C5-7 cycloalkyl groups such as cyclopentyl, cyclohexyl and cycloheptyl; C6-11 alkylcycloalkyl groups such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl and diethylcycloheptyl (where the alkyl groups may be substituted at any position on the cycloalkyl groups); alkenyl groups such as butenyl, pentenyl, hexenyl, heptenyl, octenyl, nonenyl, decenyl, undecenyl and dodecenyl (where the alkenyl groups may be straight-chain or branched, and the double bonds may be at any position); aryl groups such as phenyl and naphthyl; C7-C12 alkylaryl groups such as tolyl, xylyl, ethylphenyl, propylphenyl, butylphenyl, pentylphenyl and hexylphenyl (where the alkyl groups may be straight-chain or branched, and substituted at any position of the aryl groups); and C7-C12 arylalkyl groups such as benzyl, phenylethyl, phenylpropyl, phenylbutyl, phenylpentyl and phenylhexyl (where the alkyl groups may be straight-chain or branched).

[Chemical Formula 16]

(7-c)

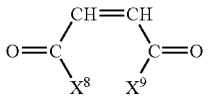

In general formula (7-c), $X^8$ and $X^9$ each separately represent hydrogen, a C1-18 alkoxy group (—$OR^{20}$:$R^{20}$=C1-18 alkyl group) or a C1-18 monoalkylamino group (–$NHR^{21}$: $R^{21}$=C1-18 alkyl group).

[Chemical Formula 17]

(7-d)

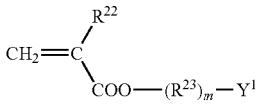

In general formula (7-d), $R^{22}$ represents hydrogen or methyl, $R^{23}$ represents a C1-C18 alkylene group, $Y^1$ represents an amine residue or heterocyclic residue containing 1-2 nitrogen atoms and 0-2 oxygen atoms, and m is 0 or 1. Specific examples of C1-C18 alkylene groups represented by $R^{23}$ include ethylene, propylene, butylene, pentylene, hexylene, heptylene, octylene, nonylene, decylene, undecylene, dodecylene, tridecylene, tetradecylene, pentadecylene, hexadecylene, heptadecylene and octadecylene (which alkylene groups may be straight-chain or branched). Specific examples of groups represented by $Y^1$ include dimethylamino, diethylamino, dipropylamino, dibutylamino, anilino, toluidino, xylidino, acetylamino, benzoylamino, morpholino, pyrolyl, pyrrolino, pyridyl, methylpyridyl, pyrrolidinyl, piperidinyl, quinonyl, pyrrolidonyl, pyrrolidono, imidazolino and pyrazino.

[Chemical Formula 18]

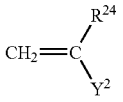

(7-e)

In general formula (7-e), $R^{24}$ represents hydrogen or methyl and $Y^2$ represents an amine residue or heterocyclic residue containing 1-2 nitrogen atoms and 0-2 oxygen atoms. Specific examples of groups represented by $Y^2$ include dimethylamino, diethylamino, dipropylamino, dibutylamino, anilino, toluidino, xylidino, acetylamino, benzoylamino, morpholino, pyrolyl, pyrrolino, pyridyl, methylpyridyl, pyrrolidinyl, piperidinyl, quinonyl, pyrrolidonyl, pyrrolidono, imidazolino and pyrazino.

Specific preferred examples for monomer (M-1) include C1-C18 alkyl acrylates, C1-C18 alkyl methacrylates, C2-C20 olefins, styrenes, methylstyrenes, maleic anhydride esters, maleic anhydride amides, and mixtures of the foregoing.

Specific preferred examples for monomer (M-2) include dimethylaminomethyl methacrylate, diethylaminomethyl methacrylate, dimethylaminoethyl methacrylate, diethylaminoethyl methacrylate, 2-methyl-5-vinylpyridine, morpholinomethyl methacrylate, morpholinoethyl methacrylate, N-vinylpyrrolidone, and mixtures of the foregoing.

The molar ratio of copolymerization for the copolymer of the one or more monomers selected from among (M-1) compounds and one or more monomers selected from among (M-2) compounds will generally be, approximately, monomer (M-1):monomer (M-2)=80:20-95:5. Any production process may be employed, but usually a copolymer can be easily obtained by radical solution polymerization of the monomer (M-1) and monomer (M-2) in the presence of a polymerization initiator such as benzoyl peroxide.

Of the viscosity index improvers mentioned above, polymethacrylate-based viscosity index improvers are preferred from the viewpoint of a superior cold flow property.

The viscosity index improver content of the lubricating oil composition for an internal combustion engine according to the third embodiment is preferably 0.1-15% by mass and more preferably 0.5-5% by mass based on the total amount of the composition. If the viscosity index improver content is less than 0.1% by mass, the improving effect on the viscosity-temperature characteristic by its addition will tend to be insufficient, while if it exceeds 15% by mass it will tend to be difficult to maintain the initial extreme-pressure property for long periods.

If necessary in order to improve performance, other additives in addition to those mentioned above may be added to the lubricating oil composition for an internal combustion engine according to the third embodiment, and such additives may include anti-wear agents other than component (A-1), antioxidants other than component (B-1), corrosion inhibitors, rust-preventive agents, demulsifiers, metal deactivators, pour point depressants, rubber swelling agents, antifoaming agents, coloring agents and the like, either alone or in combinations of two or more.

As anti-wear agents other than component (A-1) there may be mentioned sulfur-based anti-wear agents such as dithiocarbamate, zinc dithiocarbamate, molybdenum dithiocarbamate, disulfides, olefin sulfides and sulfurized fats and oils.

As examples of antioxidants other than component (B-1) there may be mentioned copper-based and molybdenum-based metal anti oxidants.

As examples of corrosion inhibitors there may be mentioned benzotriazole-based, tolyltriazole-based, thiadiazole-based and imidazole-based compounds.

As examples of rust-preventive agents there may be mentioned petroleum sulfonates, alkylbenzene sulfonates, dinonylnaphthalene sulfonates, alkenylsuccinic acid esters and polyhydric alcohol esters.

As examples of demulsifiers there may be mentioned polyalkylene glycol-based nonionic surfactants such as polyoxyethylenealkyl ethers, polyoxyethylenealkylphenyl ethers and polyoxyethylenealkylnaphthyl ethers.

As examples of metal deactivators there may be mentioned imidazolines, pyrimidine derivatives, alkylthiadiazoles, mercaptobenzothiazoles, benzotriazole and its derivatives, 1,3,4-thiadiazolepolysulfide, 1,3,4-thiadiazolyl-2,5-bisdialkyl dithiocarbamate, 2-(alkyldithio)benzimidazole and β-(o-carboxybenzylthio)propionitrile.

Any publicly known pour point depressants may be selected as pour point depressants depending on the properties of the lubricating base oil, but preferred are polymethacrylates with weight-average molecular weights of greater than 50,000 and not greater than 150,000, and preferably 80,000-120,000.

As antifoaming agents there may be used any compounds commonly employed as antifoaming agents for lubricating oils, and as examples there may be mentioned silicones such as dimethylsilicone and fluorosilicone. Any one or more selected from these compounds may be added in any desired amount.

As coloring agents there may be used any normally employed compounds and in any desired amounts, although the contents will usually be 0.001-1.0% by mass based on the total amount of the composition.

When such additives are added to a lubricating oil composition of the invention, the contents will normally be selected in ranges of 0.01-2% by mass for anti-wear agents other than component (A-1), 0.01-2% by mass for antioxidants other than component (B-1), 0.005-5% by mass for corrosion inhibitors, rust-preventive agents and demulsifiers, 0.005-1% by mass for metal deactivators, 0.05-1% by mass for pour point depressants, 0.0005-1% by mass for antifoaming agents and 0.001-1.0% by mass for coloring agents, based on the total amount of the composition.

The lubricating oil composition for an internal combustion engine according to the third embodiment may include additives containing sulfur as a constituent element as mentioned above, but the total sulfur content of the lubricating oil composition (the total of sulfur from the lubricating base oil and additives) is preferably 0.05-0.3% by mass, more preferably 0.08-0.25% by mass, even more preferably 0.1-0.2% by mass and most preferably 0.12-0.18% by mass from the viewpoint of solubility of the additives and of exhausting the base value resulting from production of sulfur oxides under high-temperature oxidizing conditions.

The kinematic viscosity at 100° C. of the lubricating oil composition for an internal combustion engine according to the third embodiment will normally be 4-24 $mm^2/s$, but from the viewpoint of maintaining the oil film thickness which prevents seizing and wear and the viewpoint of inhibiting increase in stirring resistance, it is preferably 5-18 $mm^2/s$, more preferably 6-15 $mm^2/s$ and even more preferably 7-12 $mm^2/s$.

The sulfated ash content in the lubricating oil composition for an internal combustion engine of the third embodiment is preferably not greater than 1.2% by mass, more preferably not greater than 1.0% by mass and even more preferably not greater than 0.9% by mass from the viewpoint of maintaining the exhaust gas aftertreatment device performance, while it is preferably 0.1% by mass or greater, more preferably 0.4% by mass or greater, even more preferably 0.7% by mass or greater and most preferably 0.8% by mass or greater, in order to maintain engine cleanability and oxidation stability. The "sulfated ash content" according to the invention is the sulfated ash content measured according to "5. Sulfated Ash Test Method" of JIS K 2272-1985, "Crude Oil and Petroleum Products—Determination of Ash and Sulfated Ash".

The lubricating oil composition for an internal combustion engine according to the third embodiment having the construction described above has a satisfactorily long oxidation life and can adequately maintain the performance of exhaust gas aftertreatment devices for prolonged periods, while exhibiting excellent viscosity-temperature characteristics, frictional properties and low volatility. A lubricating oil composition for an internal combustion engine according to the third embodiment having such excellent properties may be suitably used as a lubricating oil for internal combustion engines including gasoline engines, diesel engines, engines for fuels comprising oxygen-containing compounds and gas engines, for two-wheel vehicles, four-wheel vehicles, electric power generation and marine use, and the like, and particularly, as a lubricating oil for internal combustion engines with exhaust gas aftertreatment devices, specifically gasoline engines of vehicles with three-way catalysts, or as a lubricating oil for diesel engines of vehicles with diesel particulate filters (DPF). It is also particularly suitable for use as a lubricating oil for internal combustion engines that run on low sulfur fuel, such as gasoline, gas oil or kerosene with a low sulfur content of 50 ppm by mass or lower, even more preferably 30 ppm by mass or lower and most preferably 10 ppm by mass or lower, or fuels with sulfur contents of 1 ppm by mass or lower (LPG, natural gas, essentially sulfur-free hydrogen, dimethyl ether, alcohol, GTL (gas-to-liquid fuels) and the like).

Fourth Embodiment

The lubricating oil composition for an internal combustion engine according to the fourth embodiment comprises a lubricating base oil of the first embodiment or second embodiment described above, (A-2) an ashless antioxidant containing no sulfur as a constituent element, and (B-2) at least one compound selected from among ashless antioxidants containing sulfur as a constituent element and organic molybdenum compounds. The descriptions of the lubricating base oils according to the first embodiment and second embodiment will not be repeated here. The lubricating oil composition for an internal combustion engine of the fourth embodiment may further contain the mineral base oils and synthetic base oils mentioned above in the explanation of the first embodiment, in addition to the lubricating base oil according to the first embodiment or second embodiment, and those mineral base oils and synthetic base oils will not be repeated here.

The lubricating oil composition for an internal combustion engine according to the fourth embodiment comprises, as component (A-2), an ashless antioxidant containing no sulfur as a constituent element. Component (A-2) is preferably a phenol-based or amine-based ashless antioxidant containing no sulfur as a constituent element.

As specific examples of phenol-based ashless antioxidants containing no sulfur as a constituent element there may be mentioned 4,4'-methylenebis(2,6-di-tert-butylphenol), 4,4'-bis(2,6-di-tert-butylphenol), 4,4'-bis(2-methyl-6-tert-butylphenol), 2,2'-methylenebis(4-ethyl-6-tert-butylphenol), 2,2'-methylenebis(4-methyl-6-tert-butylphenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidenebis(4,6-dimethylphenol), 2,2'-methylenebis(4-methyl-6-cyclohexylphenol), 2,6-di-tert-butyl-4-methylphenol, 2,6-di-tert-butyl-4-ethylphenol, 2,4-dimethyl-6-tert-butylphenol, 2,6-di-tert-α-dimethylamino-p-cresol, 2,6-di-tert-butyl-4(N,N'-dimethylaminomethylphenol), octyl-3-(3,5-di-tert-butyl-4-hydroxyphenyl)propionate, tridecyl-3-(3,5-di-tert-butyl-4-hydroxyphenyl)propionate, pentaerythrityl-tetrakis[3-(3,5-di-tert-butyl-4-hydroxyphenyl)propionate], octadecyl-3-(3,5-di-tert-butyl-4-hydroxyphenyl)propionate, octyl-3-(3,5-di-tert-butyl-4-hydroxyphenyl)propionate, octyl-3-(3-methyl-5-tert-butyl-4-hydroxyphenyl)propionate, and mixtures of the foregoing. Among these there are preferred hydroxyphenyl group-substituted esteric antioxidants that are esters of hydroxyphenyl group-substituted fatty acids and C4-12 alcohols ((octyl-3-(3,5-di-tert-butyl-4-hydroxyphenyl)propionate, octyl-3-(3-methyl-5-tert-butyl-4-hydroxyphenyl)propionate and the like) and bisphenol-based antioxidants, with hydroxyphenyl group-substituted esteric antioxidants being more preferred. Phenol-based compounds with a molecular weight of 240 or greater are preferred for their high decomposition temperatures which allow them to exhibit their effects even under high-temperature conditions.

As specific amine-based ashless antioxidants containing no sulfur as a constituent element there may be mentioned phenyl-α-naphthylamine, alkylphenyl-α-naphthylamines, alkyldiphenylamines, dialkyldiphenylamines, N,N'-diphenyl-p-phenylenediamine, and mixtures of the foregoing. The alkyl groups in these amine-based ashless antioxidants are preferably C1-C20 straight-chain or branched alkyl groups, and more preferably C4-C12 straight-chain or branched alkyl groups.

There are no particular restrictions on the content of component (A-2) in the lubricating oil composition for an internal combustion engine according to the fourth embodiment, but it is preferably 0.01% by mass or greater, more preferably 0.1% by mass or greater, even more preferably 0.5% by mass or greater and most preferably 1.0% by mass or greater, and preferably not greater than 5% by mass, more preferably not greater than 3% by mass and most preferably not greater than 2% by mass, based on the total amount of the composition. If the content is less than 0.01% by mass the heat and oxidation stability of the lubricating oil composition will be insufficient, and it may not be possible to maintain superior cleanability for prolonged periods. On the other hand, if the content of component (A-2) is greater than 5% by mass no further effect will be achieved commensurate with the increased amount, and the storage stability of the lubricating oil composition will tend to be reduced.

According the invention, a combination of 0.4-2% by mass of a phenol-based ashless antioxidant and 0.4-2% by mass of an amine-based ashless antioxidant, based on the total amount of the composition, may be used in combination as component (A-2) in the lubricating oil composition for an internal combustion engine according to the fourth embodiment, or most preferably, an amine-based antioxidant may be used alone at 0.5-2% by mass and more preferably 0.6-1.5% by mass, which will allow excellent cleanability to be maintained for long periods.

The lubricating oil composition for an internal combustion engine according to the fourth embodiment comprises, as component (B-2), at least one selected from (B-2-1) an ashless antioxidant containing sulfur as a constituent element and (B-2-2) an organic molybdenum compound.

As (B-2-1) the ashless antioxidant containing sulfur as a constituent element there may be suitably used sulfurized fats and oils, sulfurized olefins, dihydrocarbyl polysulfide, dithiocarbamates, thiadiazoles and phenol-based ashless antioxidants containing sulfur as a constituent element.

As examples of sulfurized fats and oils there may be mentioned oils such as sulfurized lard, sulfurized rapeseed oil, sulfurized castor oil, sulfurized soybean oil and sulfurized rice bran oil; disulfide fatty acids such as oleic sulfide; and sulfurized esters such as sulfurized methyl oleate.

As examples of sulfurized olefins there may be mentioned compounds represented by the following general formula (8).

$$R^{25}—S_x—R^{26} \quad (8)$$

[In general formula (8), $R^{25}$ represents a C2-C15 alkenyl group, $R^{26}$ represents a C2-C15 alkyl group or alkenyl group and x represents an integer of 1-8.]

The compounds represented by general formula (8) above may be obtained by reacting a C2-C15 olefin or its 2-4 mer with a sulfidizing agent such as sulfur or sulfur chloride. Examples of olefins that are preferred for use include propylene, isobutene and diisobutene.

Dihydrocarbyl polysulfides are compounds represented by the following general formula (9).

$$R^{27}—S_y—R^{28} \quad (9)$$

(In general formula (9), $R^{27}$ and $R^{28}$ each separately represent a C1-C20 alkyl group (including cycloalkyl groups), C6-C20 aryl or C7-C20 arylalkyl group, which may be the same or different, and y represents an integer of 2-8)

As specific examples for $R^{27}$ and $R^{28}$ there may be mentioned methyl, ethyl, n-propyl, isopropyl, n-butyl, isobutyl, sec-butyl, tert-butyl, pentyls, hexyls, heptyls, octyls, nonyls, decyls, dodecyls, cyclohexyl, phenyl, naphthyl, tolyl, xylyl, benzyl and phenethyl.

As specific preferred examples of dihydrocarbyl polysulfides there may be mentioned dibenzyl polysulfide, di-tert-nonyl polysulfide, didodecyl polysulfide, di-tert-butyl polysulfide, dioctyl polysulfide, diphenyl polysulfide and dicyclohexyl polysulfide.

As dithiocarbamates there may be mentioned, as preferred examples, compounds represented by the following general formula (10) or (11).

[Chemical Formula 19]

(10)

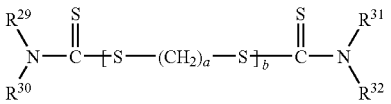

[Chemical Formula 20]

(11)

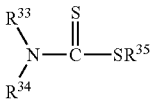

In general formulas (10) and (11), $R^{29}$, $R^{30}$, $R^{31}$, $R^{32}$, $R^{33}$ and $R^{34}$ each separately represent a C1-C30 and preferably C1-C20 hydrocarbon group, $R^{35}$ represents hydrogen or a C1-C30 hydrocarbon group and preferably hydrogen or a C1-C20 hydrocarbon group, a represents an integer of 0-4, and b represents an integer of 0-6.

As examples of C1-C30 hydrocarbon groups there may be mentioned alkyl, cycloalkyl, alkylcycloalkyl, alkenyl, aryl, alkylaryl and arylalkyl groups.

As examples of thiadiazoles there may be mentioned 1,3,4-thiadiazole compounds represented by the following general formula (12), 1,2,4-thiadiazole compounds represented by general formula (13), and 1,4,5-thiadiazole compounds represented by general formula (14).

[Chemical Formula 21]

(12)

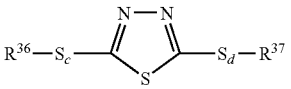

[Chemical Formula 22]

(13)

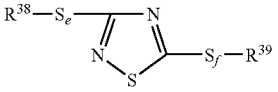

[Chemical Formula 23]

(14)

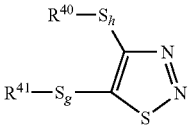

In general formulas (12)-(14), $R^{36}$, $R^{37}$, $R^{38}$, $R^{39}$, $R^{40}$ and $R^{41}$ may be the same or different and each separately represents hydrogen or a C1-C30 hydrocarbon group, and c, d, e, f, g and h each separately represent an integer of 0-8.

As examples of C1-C30 hydrocarbon groups there may be mentioned alkyl, cycloalkyl, alkylcycloalkyl, alkenyl, aryl, alkylaryl and arylalkyl groups.

As phenol-based ashless antioxidants containing sulfur as a constituent element there may be mentioned 4,4'-thiobis(2-methyl-6-tert-butylphenol), 4,4'-thiobis(3-methyl-6-tert-butylphenol), 2,2'-thiobis(4-methyl-6-tert-butylphenol), bis(3-methyl-4-hydroxy-5-tert-butylbenzyl)sulfide, bis(3,5-di-tert-butyl-4-hydroxybenzyl)sulfide, 2,2'-thio-diethylenebis[3-(3,5-di-tert-butyl-4-hydroxyphenyl)propionate] and the like.

Dihydrocarbyl polysulfides, dithiocarbamates and thiadiazoles are preferably used as component (B-2-1) from the viewpoint of achieving more excellent heat and oxidation stability.

When (B-2-1) an ashless antioxidant containing sulfur as a constituent element is used as component (B-2) according to the fourth embodiment, there are no particular restrictions on the content, but it is preferably 0.001% by mass or greater, more preferably 0.005% by mass or greater and even more preferably 0.01% by mass or greater, and preferably not greater than 0.2% by mass, more preferably not greater than 0.1% by mass and most preferably not greater than 0.04% by mass, in terms of sulfur element based on the total amount of the composition. If the content is less than the aforementioned lower limit, the heat and oxidation stability of the lubricating oil composition will be insufficient, and it may not be possible to maintain superior cleanability for prolonged periods. On the other hand, if it exceeds the aforementioned upper limit the adverse effects on exhaust gas purification apparatuses by the high sulfur content of the lubricating oil composition will tend to be increased.

The (B-2-2) organic molybdenum compounds that may be used as component (B-2) include (B-2-2a) organic molybdenum compounds containing sulfur as a constituent element and (B-2-2b) organic molybdenum compounds containing no sulfur as a constituent element.

As examples of (B-2-2a) organic molybdenum compounds containing sulfur as a constituent element there may be mentioned organic molybdenum complexes such as molybdenum dithiophosphates and molybdenum dithiocarbamates.

As specific examples of molybdenum dithiophosphates there may be mentioned compounds represented by the following general formula (15).

[Chemical Formula 24]

(15)

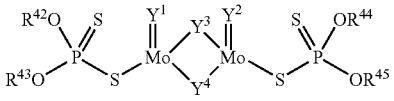

In general formula (15), $R^{42}$, $R^{43}$, $R^{44}$ and $R^{45}$ may be the same or different and each represents a hydrocarbon group such as a C2-C30, preferably C5-C18 and more preferably C5-C12 alkyl group or a C6-C18 and preferably C10-C15 (alkyl)aryl group. $Y^1$, $Y^2$, $Y^3$ and $Y^4$ each represent a sulfur aton or oxygen atom.

As preferred examples of alkyl groups there may be mentioned ethyl, propyl, butyl, pentyl, hexyl, heptyl, octyl, nonyl, decyl, undecyl, dodecyl, tridecyl, tetradecyl, pentadecyl, hexadecyl, heptadecyl and octadecyl, which may be primary alkyl, secondary alkyl or tertiary alkyl groups, and either straight-chain or branched.

As preferred examples of (alkyl)aryl groups there may be mentioned phenyl, tolyl, ethylphenyl, propylphenyl, butylphenyl, pentylphenyl, hexylphenyl, octylphenyl, nonylphenyl, decylphenyl, undecylphenyl and dodecylphenyl, where the alkyl groups may be primary alkyl, secondary alkyl or tertiary alkyl groups, and either straight-chain or branched. These (alkyl)aryl groups include all substituted isomers with different substitution positions of the alkyl groups on the aryl groups.

Preferred examples of molybdenum dithiophosphates include, specifically, molybdenum sulfide-diethyl dithiophosphate, molybdenum sulfide-dipropyl dithiophosphate, molybdenum sulfide-dibutyl dithiophosphate, molybdenum sulfide-dipentyl dithiophosphate, molybdenum sulfide-dihexyl dithiophosphate, molybdenum sulfide-dioctyl dithiophosphate, molybdenum sulfide-didecyl dithiophosphate, molybdenum sulfide-didodecyl dithiophosphate, molybdenum sulfide-di(butylphenyl)dithiophosphate, molybdenum sulfide-di(nonylphenyl)dithiophosphate, oxymolybdenum sulfide-diethyl dithiophosphate, oxymolybdenum sulfide-dipropyl dithiophosphate, oxymolybdenum sulfide-dibutyl dithiophosphate, oxymolybdenum sulfide-dipentyl dithiophosphate, oxymolybdenum sulfide-dihexyl dithiophosphate, oxymolybdenum sulfide-dioctyl dithiophosphate, oxymolybdenum sulfide-didecyl dithiophosphate, oxymolybdenum sulfide-didodecyl dithiophosphate, oxymolybdenum sulfide-di(butylphenyl)dithiophosphate, oxymolybdenum sulfide-di(nonylphenyl)dithiophosphate (where the alkyl groups may be straight-chain or branched, and the alkylphenyl groups may be bonded at any position of the alkyl groups), as well as mixtures of the foregoing. Also preferred as molybdenum dithiophosphates are compounds with different numbers of carbon atoms or structural hydrocarbon groups in the molecule.

As specific examples of molybdenum dithiocarbamates there may be used compounds represented by the following general formula (16).

[Chemical Formula 25]

(16)

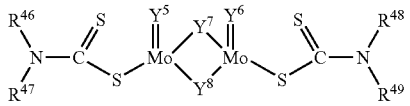

In general formula (16), $R^{46}$, $R^{47}$, $R^{48}$ and $R^{49}$ may be the same or different and each represents a hydrocarbon group such as a C2-C24 and preferably C4-C13 alkyl group, or a C6-C24 and preferably C10-C15 (alkyl)aryl. $Y^5$, $Y^6$, $Y^7$ and $Y^8$ each represent a sulfur atom or oxygen atom.

As preferred examples of alkyl groups there may be mentioned ethyl, propyl, butyl, pentyl, hexyl, heptyl, octyl, nonyl, decyl, undecyl, dodecyl, tridecyl, tetradecyl, pentadecyl, hexadecyl, heptadecyl and octadecyl, which may be primary alkyl, secondary alkyl or tertiary alkyl groups, and either straight-chain or branched.

As preferred examples of (alkyl)aryl groups there may be mentioned phenyl, tolyl, ethylphenyl, propylphenyl, butylphenyl, pentylphenyl, hexylphenyl, octylphenyl, nonylphenyl, decylphenyl, undecylphenyl and dodecylphenyl, where the alkyl groups may be primary alkyl, secondary alkyl or tertiary alkyl groups, and either straight-chain or branched. These (alkyl)aryl groups include all substituted isomers with different substitution positions of the alkyl groups on the aryl groups. As molybdenum dithiocarbamates having structures other than those described above there may be mentioned compounds with structures in which dithiocarbamate groups are coordinated with thio- or polythio-trimeric molybdenum, as disclosed in WO98/26030 and WO99/31113.

As examples of preferred molybdenum dithiocarbamates there may be mentioned, specifically, molybdenum sulfide-diethyl dithiocarbamate, molybdenum sulfide-dipropyl dithiocarbamate, molybdenum sulfide-dibutyl dithiocarbamate, molybdenum sulfide-dipentyl dithiocarbamate, molybdenum sulfide-dihexyl dithiocarbamate, molybdenum sulfide-dioctyl dithiocarbamate, molybdenum sulfide-didecyl dithiocarbamate, molybdenum sulfide-didodecyl dithiocarbamate, molybdenum sulfide-di(butylphenyl)dithiocarbamate, molybdenum sulfide-di(nonylphenyl)dithiocarbamate, oxymolybdenum sulfide-diethyl dithiocarbamate, oxymolybdenum sulfide-dipropyl dithiocarbamate, oxymolybdenum sulfide-dibutyl dithiocarbamate, oxymolybdenum sulfide-dipentyl dithiocarbamate, oxymolybdenum sulfide-dihexyl dithiocarbamate, oxymolybdenum sulfide-dioctyl dithiocarbamate, oxymolybdenum sulfide-didecyl dithiocarbamate, oxymolybdenum sulfide-didodecyl dithiocarbamate, oxymolybdenum sulfide-di(butylphenyl)dithiocarbamate, oxymolybdenum sulfide-di(nonylphenyl)dithiocarbamate (where the alkyl groups may be linear or branched, and the alkyl groups may be bonded at any position of the alkylphenyl groups), as well as mixtures of the foregoing. Also preferred as molybdenum dithiocarbamates are compounds with different numbers of carbon atoms or structural hydrocarbon groups in the molecule.

As other sulfur-containing organic molybdenum complexes there may be mentioned complexes of molybdenum compounds (for example, molybdenum oxides such as molybdenum dioxide and molybdenum trioxide, molybdic acids such as orthomolybdic acid, paramolybdic acid and (poly)molybdic sulfide acid, molybdic acid salts such as metal salts or ammonium salts of these molybdic acids, molybdenum sulfides such as molybdenum disulfide, molybdenum trisulfide, molybdenum pentasulfide and polymolybdenum sulfide, molybdic sulfide, metal salts or amine salts of molybdic sulfide, halogenated molybdenums such as molybdenum chloride, and the like), with sulfur-containing organic compounds (for example, alkyl(thio)xanthate, thiadiazole, mercaptothiadiazole, thio carbonate, tetrahydrocarbylthiuram disulfide, bis(di(thio)hydrocarbyldithio phosphonate) disulfide, organic (poly)sulfides, sulfurized esters and the like), or other organic compounds, or complexes of sulfur-containing molybdenum compounds such as molybdenum sulfide and molybdic sulfide with alkenylsuccinimides.

Component (B-2) according to the fourth embodiment is preferably the (B-2-2a) organic molybdenum compound containing sulfur as a constituent element, in order to obtain a friction reducing effect in addition to improving the heat and oxidation stability, with molybdenum dithiocarbamates being particularly preferred.

As the (B-2-2b) organic molybdenum compounds containing no sulfur as a constituent element there may be mentioned, specifically, molybdenum-amine complexes, molybdenum-succiniimide complexes, organic acid molybdenum salts, alcohol molybdenum salts and the like, among which molybdenum-amine complexes, organic acid molybdenum salts and alcohol molybdenum salts are preferred.

As molybdenum compounds in the aforementioned molybdenum-amine complexes there may be mentioned sulfur-free molybdenum compounds such as molybdenum trioxide or its hydrate ($MoO_3.nH_2O$), molybdic acid ($H_2MoO_4$), alkali metal salts of molybdic acid ($M_2MoO_4$; where M represents an alkali metal), ammonium molybdate ($(NH_4)_2MoO_4$ or $(NH_4)_6[Mo_7O_{24}].4H_2O$), $MoCl_5$, $MoOCl_4$, $MoO_2Cl_2$, $MoO_2Br_2$, $Mo_2O_3Cl_6$ or the like. Of these molybdenum compounds, hexavalent molybdenum compounds are preferred from the viewpoint of yield of the molybdenum-amine complex. From the viewpoint of availability, the preferred hexavalent molybdenum compounds are molybdenum trioxide or its hydrate, molybdic acid, molybdic acid alkali metal salts and ammonium molybdate.

There are no particular restrictions on nitrogen compounds for the molybdenum-amine complex, but as specific nitrogen compounds there may be mentioned ammonia, monoamines, diamines, polyamines, and the like. As more specific examples there may be mentioned alkylamines with C1-C30 alkyl groups (where the alkyl groups may be straight-chain or branched) such as methylamine, ethylamine, propylamine, butylamine, pentylamine, hexylamine, heptylamine, octylamine, nonylamine, decylamine, undecylamine, dodecylamine, tridecylamine, tetradecylamine, pentadecylamine, hexadecylamine, heptadecylamine, octadecylamine, dimethylamine, diethylamine, dipropylamine, dibutylamine, dipentylamine, dihexylamine, diheptylamine, dioctylamine, dinonylamine, didecylamine, diundecylamine, didodecylamine, ditridecylamine, ditetradecylamine, dipentadecylamine, dihexadecylamine, diheptadecylamine, dioctadecylamine, methylethylamine, methylpropylamine, methylbutylamine, ethylpropylamine, ethylbutylamine and propylbutylamine; alkenylamines with C2-C30 alkenyl groups (where the alkenyl groups may be straight-chain or branched) such as ethenylamine, propenylamine, butenylamine, octenylamine and oleylamine; alkanolamines with C1-C30 alkanol groups (where the alkanol groups may be straight-chain or branched) such as methanolamine, ethanolamine, propanolamine, butanolamine, pentanolamine, hexanolamine, heptanolamine, octanolamine, nonanolamine, methanolethanolamine, methanolpropanolamine, methanolbutanolamine, ethanolpropanolamine, ethanolbutanolamine and propanolbutanolamine; alkylenediamines with C1-C30 alkylene groups such as methylenediamine, ethylenediamine, propylenediamine and butylenediamine; polyamines such as diethylenetriamine, triethylenetetramine, tetraethylenepentamine and pentaethylenehexamine; compounds with C8-C20 alkyl or alkenyl groups on the aforementioned monoamines, diamines or polyamines such as undecyldiethylamine, undecyldiethanolamine, dodecyldipropanolamine, oleyldiethanolamine, oleylpropylenediamine and stearyltetraethylenepentamine; heterocyclic compounds such as N-hydroxyethyloleylimidazoline; alkylene oxide addition products of the foregoing, and mixtures of the foregoing. Primary amines, secondary amines and alkanolamines are preferred among those mentioned above.

The number of carbon atoms in the hydrocarbon group of the amine compound composing the molybdenum-amine complex is preferably 4 or greater, more preferably 4-30 and most preferably 8-18. If the hydrocarbon group of the amine compound has less than 4 carbon atoms, the solubility will tend to be poor. Limiting the number of carbon atoms in the amine compound to not greater than 30 will allow the molybdenum content in the molybdenum-amine complex to be relatively increased, so that the effect of the invention can be enhanced with a small amount of addition.

As molybdenum-succiniimide complexes there may be mentioned complexes of the sulfur-free molybdenum compounds mentioned above for the molybdenum-amine complexes, and succiniimides with C4 or greater alkyl or alkenyl groups. As succiniimides there may be mentioned succiniimides having at least one C40-C400 alkyl or alkenyl group in the molecule, or their derivatives, and preferably succiniimides with C4-C39 and more preferably C8-C18 alkyl or alkenyl groups. If the number of carbon atoms of the alkyl or alkenyl group of the succiniimide is less than 4, the solubility will tend to be impaired. Although a succiniimide with an alkyl or alkenyl group having more than 30 and 400 or less carbon atoms may be used, the number of carbon atoms of the alkyl or alkenyl group is preferably not greater than 30 in order to obtain a relatively higher molybdenum content in the molybdenum-succiniimide complex, and allow a greater effect according to the invention to be achieved with a smaller amount of addition.

As molybdenum salts of organic acids there may be mentioned salts of organic acids with molybdenum bases such as molybdenum oxides or molybdenum hydroxides, molybdenum carbonates or molybdenum chlorides, mentioned above as examples for the molybdenum-amine complexes. As organic acids there are preferred the phosphorus compounds represented by general formula (4-c) or (4-d) mentioned in the explanation of the third embodiment, and carboxylic acids.

The carboxylic acid in a molybdenum salt of a carboxylic acid may be either a monobasic acid or polybasic acid.

As monobasic acids there may be used C2-C30 and preferably C4-C24 fatty acids, which may be straight-chain or branched and saturated or unsaturated. As specific examples there may be mentioned saturated fatty acids such as acetic acid, propionic acid, straight-chain or branched butanoic acid, straight-chain or branched pentanoic acid, straight-chain or branched hexanoic acid, straight-chain or branched heptanoic acid, straight-chain or branched octanoic acid, straight-chain or branched nonanoic acid, straight-chain or branched decanoic acid, straight-chain or branched undecanoic acid, straight-chain or branched dodecanoic acid, straight-chain or branched tridecanoic acid, straight-chain or branched tetradecanoic acid, straight-chain or branched pentadecanoic acid, straight-chain or branched hexadecanoic acid, straight-chain or branched heptadecanoic acid, straight-chain or branched octadecanoic acid, straight-chain or branched hydroxyoctadecanoic acid, straight-chain or branched nonadecanoic acid, straight-chain or branched eicosanoic acid, straight-chain or branched heneicosanoic acid, straight-chain or branched docosanoic acid, straight-chain or branched tricosanoic acid and straight-chain or branched tetracosanoic acid, and unsaturated fatty acids such as acrylic acid, straight-chain or branched butenoic acid, straight-chain or branched pentenoic acid, straight-chain or branched hexenoic acid, straight-chain or branched heptenoic acid, straight-chain or branched octenoic acid, straight-chain or branched nonenoic acid, straight-chain or branched decenoic acid, straight-chain or branched undecenoic acid, straight-chain or branched dodecenoic acid, straight-chain or branched tridecenoic acid, straight-chain or branched tetradecenoic acid, straight-chain or branched pentadecenoic acid, straight-chain or branched hexadecenoic acid, straight-chain or branched heptadecenoic acid, straight-chain or branched octadecenoic acid, straight-chain or branched hydroxyoctadecenoic acid, straight-chain or branched nonadecenoic acid, straight-chain or branched eicosenoic acid, straight-chain or branched heneicosenoic acid, straight-chain or branched docosenoic acid, straight-chain or branched tricosenoic acid and straight-chain or branched tetracosenoic acid, as well as mixtures of the foregoing.

The monobasic acid may be a monocyclic or polycyclic carboxylic acid (optionally with hydroxyl groups) in addition to any of the aforementioned fatty acids, and the number of carbon atoms is preferably 4-30 and more preferably 7-30. As monocyclic or polycyclic carboxylic acids there may be mentioned aromatic carboxylic acids or cycloalkylcarboxylic acids with 0-3 and preferably 1-2 C1-C30 and preferably C1-C20 straight-chain or branched alkyl groups, and more specifically, (alkyl)benzenecarboxylic acids, (alkyl)naphthalenecarboxylic acid, (alkyl)cycloalkylcarboxylic acids and the like. As preferred examples of monocyclic or polycyclic carboxylic acids there may be mentioned benzoic acid, salicylic acid, alkylbenzoic acids, alkylsalicylic acids, cyclohexanecarboxylic acid and the like.

As polybasic acids there may be mentioned dibasic acids, tribasic acids and tetrabasic acids. The polybasic acids may be straight-chain polybasic acids or cyclic polybasic acids. In the case of a linear polybasic acid, it may be straight-chain or branched and either saturated or unsaturated. As straight-chain polybasic acids there are preferred C2-C16 straight-chain dibasic acids, and as specific examples there may be mentioned ethanedioic acid, propanedioic acid, straight-chain or branched butanedioic acid, straight-chain or branched pentanedioic acid, straight-chain or branched hexanedioic acid, straight-chain or branched heptanedioic acid, straight-chain or branched octanedioic acid, straight-chain or branched nonanedioic acid, straight-chain or branched decanedioic acid, straight-chain or branched undecanedioic acid, straight-chain or branched dodecanedioic acid, straight-chain or branched tridecanedioic acid, straight-chain or branched tetradecanedioic acid, straight-chain or branched heptadecanedioic acid, straight-chain or branched hexadecanedioic acid, straight-chain or branched hexenedioic acid, straight-chain or branched heptenedioic acid, straight-chain or branched octenedioic acid, straight-chain or branched nonenedioic acid, straight-chain or branched decenedioic acid, straight-chain or branched undecenedioic acid, straight-chain or branched dodecenedioic acid, straight-chain or branched tridecenedioic acid, straight-chain or branched tetradecenedioic acid, straight-chain or branched heptadecenedioic acid, straight-chain or branched hexadecenedioic acid, alkenylsuccinic acid, and mixtures of the foregoing. As cyclic polybasic acids there may be mentioned alicyclic dicarboxylic acids such as 1,2-cyclohexanedicarboxylic acid and 4-cyclohexene-1,2-dicarboxylic acid, aromatic dicarboxylic acids such as phthalic acid, aromatic tricarboxylic acids such as trimellitic acid and aromatic tetracarboxylic acids such as pyromellitic acid.

As molybdenum salts of alcohols there may be mentioned salts of alcohols with the sulfur-free molybdenum compounds mentioned above for the molybdenum-amine complexes, and the alcohols may be monohydric alcohol, polyhydric alcohol or polyhydric alcohol partial ester or partial ester compounds or hydroxyl group-containing nitrogen compounds (alkanolamines and the like). Molybdic acid is a strong acid and forms esters by reaction with alcohols, and esters of molybdic acid with alcohols are also included within the molybdenum salts of alcohols according to the invention.

As monohydric alcohols there may be used C1-C24, preferably C1-C12 and more preferably C1-C8 monohydric alcohols, and such alcohols may be straight-chain or branched, and either saturated or unsaturated. As specific examples of C1-C24 alcohols there may be mentioned methanol, ethanol, straight-chain or branched propanol, straight-chain or branched butanol, straight-chain or branched pentanol, straight-chain or branched hexanol, straight-chain or branched heptanol, straight-chain or branched octanol, straight-chain or branched nonanol, straight-chain or branched decanol, straight-chain or branched undecanol, straight-chain or branched dodecanol, straight-chain or branched tridecanol, straight-chain or branched tetradecanol, straight-chain or branched pentadecanol, straight-chain or branched hexadecanol, straight-chain or branched heptadecanol, straight-chain or branched octadecanol, straight-chain or branched nonadecanol, straight-chain or branched eicosanol, straight-chain or branched heneicosanol, straight-chain or branched tricosanol, straight-chain or branched tetracosanol, and mixtures of the foregoing.

As polyhydric alcohols there may be used polyhydric alcohols having 2-10 hydroxyl groups and preferably 2-6. As specific examples of polyhydric alcohols having 2-10 hydroxyl groups there may be mentioned dihydric alcohols such as ethylene glycol, diethylene glycol, polyethylene glycols (3-15 mers of ethylene glycol), propylene glycol, dipropylene glycol, polypropylene glycols (3-15 mers of propylene glycol), 1,3-propanediol, 1,2-propanediol, 1,3-butanediol, 1,4-butanediol, 2-methyl-1,2-propanediol, 2-methyl-1,3-propanediol, 1,2-pentanediol, 1,3-pentanediol, 1,4-pentanediol, 1,5-pentanediol and neopentyl glycol; polyhydric alcohols such as glycerin, polyglycerins (2-8 mers of glycerin such as diglycerin, triglycerin and tetraglycerin), trimethylolalkanes (trimethylolethane, trimethylolpropane, trimethylolbutane, etc.) and their 2-8 mers, pentaerythritols and their 2-4 mers, 1,2,4-butanetriol, 1,3,5-pentanetriol, 1,2,6-hexanetriol, 1,2,3,4-butanetetrol, sorbitol, sorbitan, sorbitol-glycerin condensation product, adonitol, arabitol, xylitol and mannitol; saccharides such as xylose, arabinose, ribose, rhamnose, glucose, fructose, galactose, mannose, sorbose, cellobiose, maltose, isomaltose, trehalose and sucrose, and mixtures of the foregoing.

As partial esters of polyhydric alcohols there may be mentioned the polyhydric alcohols mentioned above as polyhydric alcohols having some of the hydroxyl groups hydrocarbylesterified, among which glycerin monooleate, glycerin dioleate, sorbitan monooleate, sorbitan dioleate, pentaerythritol monooleate, polyethyleneglycol monooleate and polyglycerin monooleate are preferred.

As partial ethers of polyhydric alcohols there may be mentioned the polyhydric alcohols mentioned above as polyhydric alcohols having some of the hydroxyl groups hydrocarbyletherified, and compounds having ether bonds formed by condensation between polyhydric alcohols (sorbitan condensation products and the like), among which 3-octadecyloxy-1,2-propanediol, 3-octadecenyloxy-1,2-propanediol, polyethyleneglycol alkyl ethers are preferred.

As hydroxyl group-containing nitrogen compounds there may be mentioned the examples of alkanolamines for the molybdenum-amine complexes referred to above, as well as alkanolamides wherein the amino groups on the alkanols are amidated (diethanolamide and the like), among which stearyldiethanolamine, polyethyleneglycol stearylamine, polyethyleneglycol dioleylamine, hydroxyethyllaurylamine, diethanolamide oleate and the like are preferred.

When a (B-2-2b) organic molybdenum compound containing no sulfur as a constituent element is used as component (B-2) according to the fourth embodiment, it is possible to increase the high-temperature cleanability and base value retention of the lubricating oil composition, and this is preferred for maintaining the initial friction reducing effect for longer periods, while molybdenum-amine complexes are especially preferred among such compounds.

The (B-2-2a) organic molybdenum compound containing sulfur as a constituent element and (B-2-2b) organic molybdenum compound containing no sulfur as a constituent element may also be used in combination for the fourth embodiment.

When an organic molybdenum compound is used as component (B-2) according to the fourth embodiment, there are no particular restrictions on the content, but it is preferably 0.001% by mass or greater, more preferably 0.005% by mass or greater and even more preferably 0.01% by mass or greater, and preferably not greater than 0.2% by mass, more preferably not greater than 0.1% by mass and most preferably not greater than 0.04% by mass, in terms of molybdenum element based on the total amount of the composition. If the content is less than 0.001% by mass the heat and oxidation stability of the lubricating oil composition will be insufficient, and it may not be possible to maintain superior cleanability for prolonged periods. On the other hand, if the content is greater than 0.2% by mass the effect will not be commensurate with the increased amount, and the storage stability of the lubricating oil composition will tend to be reduced.

The lubricating oil composition for an internal combustion engine according to the fourth embodiment may consist entirely of the lubricating base oil and components (A-2) and (B-2) described above, but it may further contain the additives described below as necessary for further enhancement of function.

The lubricating oil composition for an internal combustion engine according to the fourth embodiment preferably also further contains an anti-wear agent from the viewpoint of greater enhancement of the wear resistance. As extreme-pressure agents there are preferably used phosphorus-based extreme-pressure agents and phosphorus-sulfur-based extreme-pressure agents.

As phosphorus-based extreme-pressure agents there may be mentioned phosphoric acid, phosphorous acid, phosphoric acid esters (including phosphoric acid monoesters, phosphoric acid diesters and phosphoric acid triesters), phosphorous acid esters (including phosphorous acid monoesters, phosphorous acid diesters and phosphorous acid triesters), and salts of the foregoing (such as amine salts or metal salts). As phosphoric acid esters and phosphorous acid esters there may generally be used those with C2-C30 and preferably C3-C20 hydrocarbon groups.

As phosphorus-sulfur-based extreme-pressure agents there may be mentioned thiophosphoric acid, thiophosphorous acid, thiophosphoric acid esters (including thiophosphoric acid monoesters, thiophosphoric acid diesters and thiophosphoric acid triesters), thiophosphorous acid esters (including thiophosphorous acid monoesters, thiophosphorous acid diesters and thiophosphorous acid triesters), salts of the foregoing, and zinc dithiophosphate. As thiophosphoric acid esters and thiophosphorous acid esters there may generally be used those with C2-C30 and preferably C3-C20 hydrocarbon groups.

There are no particular restrictions on the extreme-pressure agent content, but it is preferably 0.01-5% by mass and more preferably 0.1-3% by mass based on the total amount of the composition.

Among the extreme-pressure agents mentioned above, zinc dithiophosphates are especially preferred for the lubricating oil composition for an internal combustion engine according to the fourth embodiment. As examples of zinc dithiophosphates there may be mentioned compounds represented by the following general formula (17).

[Chemical Formula 26]

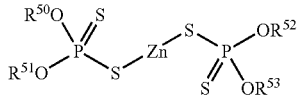

(17)

$R^{50}$, $R^{51}$, $R^{52}$ and $R^{53}$ in general formula (17) each separately represent a C1-C24 hydrocarbon group. The hydrocarbon groups are preferably C1-C24 straight-chain or branched alkyl, C3-C24 straight-chain or branched alkenyl, C5-C13 cycloalkyl or straight-chain or branched alkylcycloalkyl, C6-C18 aryl or straight-chain or branched alkylaryl, and C7-C19 arylalkyl groups. The alkyl groups or alkenyl groups may be primary, secondary or tertiary.

Specific examples for $R^{50}$, $R^{51}$, $R^{52}$ and $R^{53}$ include alkyl groups such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl and tetracosyl; alkenyl groups such as propenyl, isopropenyl, butenyl, butadienyl, pentenyl, hexenyl, heptenyl, octenyl, nonenyl, decenyl, undecenyl, dodecenyl, tridecenyl, tetradecenyl, pentadecenyl, hexadecenyl, heptadecenyl, octadecenyl (such as oleyl), nonadecenyl, eicosenyl, heneicosenyl, docosenyl, tricosenyl and tetracosenyl; cycloalkyl groups such as cyclopentyl, cyclohexyl and cycloheptyl; alkylcycloalkyl groups such as methylcyclopentyl, dimethylcyclopentyl, ethylcyclopentyl, propylcyclopentyl, ethylmethylcyclopentyl, trimethylcyclopentyl, diethylcyclopentyl, ethyldimethylcyclopentyl, propylmethylcyclopentyl, propylethylcyclopentyl, dipropylcyclopentyl, propylethylmethylcyclopentyl, methylcyclohexyl, dimethylcyclohexyl, ethylcyclohexyl, propylcyclohexyl, ethylmethylcyclohexyl, trimethylcyclohexyl, diethylcyclohexyl, ethyldimethylcyclohexyl, propylmethylcyclohexyl, propylethylcyclohexyl, di-propylcyclohexyl, propylethylmethylcyclohexyl, methylcycloheptyl, dimethylcycloheptyl, ethylcycloheptyl, propylcycloheptyl, ethylmethylcycloheptyl, trimethylcycloheptyl, diethylcycloheptyl, ethyldimethylcycloheptyl, propylmethylcycloheptyl, propylethylcycloheptyl, di-propylcycloheptyl and propylethylmethylcycloheptyl; aryl groups such as phenyl and naphthyl; alkylaryl groups such as tolyl, xylyl, ethylphenyl, propylphenyl, ethylmethylphenyl, trimethylphenyl, butylphenyl, propylmethylphenyl, diethylphenyl, ethyldimethylphenyl, tetramethylphenyl, pentylphenyl, hexylphenyl, heptylphenyl, octylphenyl, nonylphenyl, decylphenyl, undecylphenyl and dodecylphenyl; and arylalkyl groups such as benzyl, methylbenzyl, dimethylbenzyl, phenethyl, methylphenethyl and dimethylphenethyl. The aforementioned hydrocarbon groups include all possible straight-chain and branched structures, and the positions of the double bonds of the alkenyl groups, the bonding positions of the alkyl groups on the cycloalkyl groups, the bonding positions of the alkyl groups on the aryl groups and the bonding positions of the aryl groups on the alkyl groups may be as desired.

As specific preferred examples of the aforementioned zinc dithiophosphates there may be mentioned zinc diisopropyldithiophosphate, zinc diisobutyldithiophosphate, zinc di-sec-butyldithiophosphate, zinc di-sec-pentyldithiophosphate, zinc di-n-hexyldithiophosphate, zinc di-sec-hexyldithiophosphate, zinc di-octyldithiophosphate, zinc di-2-ethylhexyldithiophosphate, zinc di-n-decyldithiophosphate, zinc di-n-dodecyldithiophosphate and zinc diisotridecyldithiophosphate, as well as mixtures thereof in any desired combination.

The process for production of the zinc dithiophosphate is not particularly restricted, and it may be produced by any desired conventional method. Specifically, it may be synthesized, for example, by reacting an alcohol or phenol containing hydrocarbon groups corresponding to $R^{50}$, $R^{51}$, $R^{52}$ and $R^{53}$ in formula (17) above with diphosphorus pentasulfide to produce a dithiophosphoric acid, and neutralizing it with zinc oxide. The structure of the zinc dithiophosphate will differ depending on the starting alcohol used.

The content of the zinc dithiophosphate is not particularly restricted, but from the viewpoint of inhibiting catalyst poisoning of the exhaust gas purification device, it is preferably not greater than 0.2% by mass, more preferably not greater than 0.1% by mass, even more preferably not greater than 0.08% by mass and most preferably not greater than 0.06% by mass in terms of phosphorus element based on the total amount of the composition. From the viewpoint of forming a metal salt of phosphoric acid that will exhibit a function and effect as an anti-wear additive, the content of the zinc dithiophosphate is preferably 0.01% by mass or greater, more preferably 0.02% by mass or greater and even more preferably 0.04% by mass or greater in terms of phosphorus element based on the total amount of the composition. If the zinc dithiophosphate content is less than the aforementioned lower limit, the wear resistance improving effect of its addition will tend to be insufficient.

The lubricating oil composition for an internal combustion engine according to the fourth embodiment preferably further contains an ashless dispersant from the viewpoint of cleanability and sludge dispersibility. Specific and preferred examples of ashless dispersants are the same as the ashless dispersants mentioned as examples for component (C-1) in the explanation of the third embodiment, and will not be repeated here.

The ashless dispersant content of the lubricating oil composition for an internal combustion engine according to the fourth embodiment is preferably 0.005% by mass or greater, more preferably 0.01% by mass or greater and even more preferably 0.05% by mass or greater, and preferably not greater than 0.3% by mass, more preferably not greater than 0.2% by mass and even more preferably not greater than 0.015% by mass, as nitrogen element based on the total amount of the composition. If the ashless dispersant content is not above the aforementioned lower limit, a sufficient effect on cleanability will not be exhibited, while the content preferably does not exceed the aforementioned upper limit in order to avoid impairing the low-temperature viscosity characteristic and demulsifying property. When using an imide-based succinate ashless dispersant with a weight-average molecular weight of 6500 or greater, the content is preferably 0.005-0.05% by mass and more preferably 0.01-0.04% by mass in terms of nitrogen element based on the total amount of the composition, from the viewpoint of exhibiting sufficient sludge dispersibility and achieving an excellent low-temperature viscosity characteristic.

When a high molecular weight ashless dispersant is used, the content is preferably 0.005% by mass or greater and more preferably 0.01% by mass or greater, and preferably not greater than 0.1% by mass and more preferably not greater than 0.05% by mass, in terms of nitrogen element based on the total amount of the composition. If the high molecular weight ashless dispersant content is not above the aforementioned lower limit, a sufficient effect on cleanability will not be exhibited, while the content preferably does not exceed the aforementioned upper limit in order to avoid impairing the low-temperature viscosity characteristic and demulsifying property.

When a boron compound-modified ashless dispersant is used, the content is preferably 0.005% by mass or greater, more preferably 0.01% by mass or greater and even more preferably 0.02% by mass or greater, and preferably not greater than 0.2% by mass and more preferably not greater than 0.1% by mass, as boron element based on the total amount of the composition. If the boron compound-modified ashless dispersant content is not above the aforementioned lower limit, a sufficient effect on cleanability will not be exhibited, while the content preferably does not exceed the aforementioned upper limit in order to avoid impairing the low-temperature viscosity characteristic and demulsifying property.

The lubricating oil composition for an internal combustion engine according to the fourth embodiment preferably contains an ashless friction modifier to allow further improvement in the frictional properties. Specific examples, preferred examples and contents for ashless friction modifiers are the same as for ashless friction modifiers according to the third embodiment described above, and will not be repeated here.

The lubricating oil composition for an internal combustion engine according to the fourth embodiment preferably further contains a metal-based detergent from the viewpoint of cleanability. Specific examples, preferred examples and contents for metal-based detergents are also the same as for metal-based detergents according to the third embodiment described above, and will not be repeated here.

The lubricating oil composition for an internal combustion engine according to the fourth embodiment preferably contains a viscosity index improver to allow further improvement in the viscosity-temperature characteristic. The specific examples and contents for viscosity index improvers are the same as for the viscosity index improvers of the third embodiment, but for the fourth embodiment it is preferred to use a non-dispersant viscosity index improver and/or a dispersant viscosity index improver with a weight-average molecular weight of not greater than 50,000, preferably not greater than 40,000 and most preferably 10,000-35,000. Polymethacrylate-based viscosity index improvers are preferred from the viewpoint of a superior cold flow property.

If necessary in order to improve performance, other additives in addition to those mentioned above may be added to the lubricating oil composition for an internal combustion engine according to the fourth embodiment, and such additives may include corrosion inhibitors, rust-preventive agents, demulsifiers, metal deactivators, pour point depressants, rubber swelling agents, antifoaming agents, coloring agents and the like, either alone or in combinations of two or more. Specific examples of these additives are the same as for the third embodiment and will not be repeated here.

The lubricating oil composition for an internal combustion engine according to the fourth embodiment may include additives containing sulfur as a constituent element, but the total sulfur content of the lubricating oil composition (the total of sulfur from the lubricating base oil and additives) is preferably 0.05-0.3% by mass, more preferably 0.1-0.2% by mass and most preferably 0.12-0.18% by mass, from the viewpoint of solubility of the additives and of exhausting the base value resulting from production of sulfur oxides under high-temperature oxidizing conditions.

The kinematic viscosity at 100° C. of the lubricating oil composition for an internal combustion engine according to the fourth embodiment will normally be 4-24 $mm^2/s$, but from the viewpoint of maintaining the oil film thickness which prevents seizing and wear and the viewpoint of inhibiting increase in stirring resistance, it is preferably 5-18 $mm^2/s$, more preferably 6-15 $mm^2/s$ and even more preferably 7-12 $mm^2/s$.

The lubricating oil composition for an internal combustion engine according to the fourth embodiment having the construction described above has excellent heat and oxidation stability, as well as superiority in terms of viscosity-temperature characteristic, frictional properties and low volatility, and therefore exhibits an adequate long drain property and energy savings when used as a lubricating oil for an internal combustion engine, such as a gasoline engine, diesel engine, oxygen-containing compound-containing fuel engine or gas engine for two-wheel vehicles, four-wheel vehicles, electric power generation, ships and the like.

Fifth Embodiment

The lubricating oil composition for a wet clutch according to the fifth embodiment is characterized by comprising a lubricating base oil according to the first embodiment or second embodiment described above, (A-3) an ashless antioxidant at 0.5-3% by mass and (B-3) an ashless dispersant at 3-12% by mass, based on the total amount of the composition. The descriptions of the lubricating base oils according to the first embodiment and second embodiment will not be repeated here. The lubricating oil composition for an internal combustion engine of the fifth embodiment may further contain the mineral base oils and synthetic base oils mentioned above in the explanation of the first embodiment, in addition to the lubricating base oil according to the first embodiment or second embodiment, and those mineral base oils and synthetic base oils will not be repeated here.

As the (A-3) ashless antioxidant in the lubricating oil composition for a wet clutch according to the fifth embodiment there may be used any chain terminated ashless antioxidants commonly employed in lubricating oils, such as phenol-based antioxidants or amine-based antioxidants. Specific examples of phenol-based antioxidants and amine-based antioxidants are the same as for the third embodiment described above and will not be repeated here.

The ashless antioxidant content in the lubricating oil composition for a wet clutch according to the fifth embodiment is 0.5-3% by mass as mentioned above, but it is preferably 0.8-2% by mass, based on the total amount of the composition. If the content of the ashless antioxidant is less than 0.5% by mass, the heat and oxidation stability will be insufficient and it will be difficult to inhibit production of sludge and varnish due to deterioration. If the ashless antioxidant content exceeds 3% by mass, there will be no effect of improved heat and oxidation stability commensurate with the increased addition.

The lubricating oil composition for a wet clutch of the fifth embodiment comprises an ashless dispersant as component (B-3). Specific examples of ashless dispersants are the same as for the third embodiment and will not be repeated here.

The ashless dispersant content in the lubricating oil composition for a wet clutch according to the fifth embodiment is 3-12% by mass as mentioned above, but it is preferably 4-10% by mass, based on the total amount of the composition. If the ashless dispersant content is less than 3% by mass the dispersibility of the combustion product will be insufficient, and if it is greater than 12% by mass the viscosity-temperature characteristic will be insufficient.

The lubricating oil composition for a wet clutch according to the fifth embodiment may consist entirely of the lubricating base oil of the first embodiment or second embodiment, the (A-3) ashless antioxidant and (B-3) ashless dispersant described above, but it may further contain the additives described below as necessary for further performance enhancement.

The lubricating oil composition for a wet clutch according to the fifth embodiment preferably contains a phosphorus-based anti-wear agent (including phosphorus-based extreme-pressure agents) from the viewpoint of further improving the fatigue life, extreme-pressure property and antiwear property. As such phosphorus-based anti-wear agents there are preferably used phosphorus-based anti-wear agents containing no sulfur as a constituent element, and anti-wear agents containing both phosphorus and sulfur (phosphorus/sulfur-based anti-wear agents).

As phosphorus-based anti-wear agents there may be mentioned phosphoric acid, phosphorous acid, phosphoric acid esters and phosphorous acid esters with C1-C30 and preferably C3-C20 hydrocarbon groups, and salts of the foregoing. As phosphorus/sulfur-based anti-wear agents there may be mentioned thiophosphoric acid, thiophosphorous acid, thiophosphoric acid esters and thiophosphorous acid esters with C1-C30 and preferably C3-C20 hydrocarbon groups, salts of the foregoing, and zinc dithiophosphate.

As examples of C1-C30 hydrocarbon groups there may be mentioned alkyl, cycloalkyl, alkylcycloalkyl, alkenyl, aryl, alkylaryl and arylalkyl groups.

As examples of alkyl groups there may be mentioned alkyl groups such as ethyl, propyl, butyl, pentyl, hexyl, heptyl, octyl, nonyl, decyl, undecyl, dodecyl, tridecyl, tetradecyl, pentadecyl, hexadecyl, heptadecyl and octadecyl (which alkyl groups may be straight-chain or branched).

As cycloalkyl groups there may be mentioned C5-C7 cycloalkyl groups such as cyclopentyl, cyclohexyl and cycloheptyl.

As examples of alkylcycloalkyl groups there may be mentioned C6-11 alkylcycloalkyl groups such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl and diethylcycloheptyl, (where the alkyl groups may be substituted at any position on the cycloalkyl groups).

As examples of the alkenyl groups there may be mentioned alkenyl groups such as butenyl, pentenyl, hexenyl, heptenyl, octenyl, nonenyl, decenyl, undecenyl, dodecenyl, tridecenyl, tetradecenyl, pentadecenyl, hexadecenyl, heptadecenyl and octadecenyl (where the alkenyl groups may be straight-chain or branched, and the double bonds may be at any positions).

As examples of aryl groups there may be mentioned aryl groups such as phenyl and naphthyl.

As examples of alkylaryl groups there may be mentioned C7-C18 alkylaryl groups such as tolyl, xylyl, ethylphenyl, propylphenyl, butylphenyl, pentylphenyl, hexylphenyl, heptylphenyl, octylphenyl, nonylphenyl, decylphenyl, undecylphenyl and dodecylphenyl (where the alkyl groups may be straight-chain or branched and substituted at any positions on the aryl groups).

As examples of arylalkyl groups there may be mentioned C7-C12 arylalkyl groups such as benzyl, phenylethyl, phenylpropyl, phenylbutyl, phenylpentyl and phenylhexyl (where the alkyl groups may be either straight-chain or branched).

It is preferred to use at least one phosphorus-based anti-wear agent selected from among phosphorous acid, phosphorous acid monoesters, phosphorous acid diesters, phosphorous acid triesters and salts of the foregoing, in the lubricating oil composition for a wet clutch of the fifth embodiment. As phosphorus/sulfur-based anti-wear agents there are preferably used one or more compounds selected from among thiophosphorous acid, thiophosphorous acid monoesters, thiophosphorous acid diesters, thiophosphorous acid triesters, dithiophosphorous acid, dithiophosphorous acid monoesters, dithiophosphorous acid diesters, dithiophosphorous acid triesters, trithiophosphorous acid, trithiophosphorous acid monoesters, trithiophosphorous acid diesters and trithiophosphorous acid triesters, as well as salts of the foregoing.

As specific preferred examples of phosphorus-based anti-wear agents there may be mentioned monobutyl phosphate, monooctyl phosphate, monolauryl phosphate, dibutyl phosphate, dioctyl phosphate, dilauryl phosphate, diphenyl phosphate, tributyl phosphate, trioctyl phosphate, trilauryl phosphate, triphenyl phosphate, monobutyl phosphite, monooctyl phosphite, monolauryl phosphite, dibutyl phosphite, dioctyl phosphite, dilauryl phosphite, diphenyl phosphite, tributyl phosphite, trioctyl phosphite, trilauryl phosphite, triphenyl phosphite, and salts of the foregoing, among which phosphorous acid ester-based anti-wear agents and especially phosphorous acid diester-based anti-wear agents are preferred.

As specific preferred examples of phosphorus/sulfur-based anti-wear agents there may be mentioned monobutyl thiophosphate, monooctyl thiophosphate, monolauryl thiophosphate, dibutyl thiophosphate, dioctyl thiophosphate, dilauryl thiophosphate, diphenyl thiophosphate, tributyl thiophosphate, trioctyl thiophosphate, triphenyl thiophosphate, trilauryl thiophosphate, monobutyl thiophosphite, monooctyl thiophosphite, monolauryl thiophosphite, dibutyl thiophosphite, dioctyl thiophosphite, dilauryl thiophosphite, diphenyl thiophosphate, tributyl thiophosphite, trioctyl thiophosphite, triphenyl thiophosphite and trilauryl thiophosphite having 1-3, preferably 2 or 3 and especially 3 sulfur atoms in the molecule, as well as salts of the foregoing, among which thiophosphorous acid ester-based anti-wear agents and especially trithiophosphorous acid ester-based anti-wear agents are preferred.

As examples of salts of (thio)phosphoric acid esters and (thio)phosphorous acid esters there may be mentioned salts obtained by reacting with (thio)phosphoric acid monoesters, (thio)phosphoric acid diesters, (thio)phosphorous acid monoesters, (thio)phosphorous acid diesters and the like with nitrogen compounds such as ammonia or amine compounds containing only C1-C8 hydrocarbon or hydroxyl-containing hydrocarbon groups in the molecule, or metal bases such as zinc oxide or zinc chloride, and neutralizing all or a portion of the remaining acidic hydrogens.

As specific nitrogen compounds there may be mentioned ammonia; alkylamines such as monomethylamine, monoethylamine, monopropylamine, monobutylamine, monopentylamine, monohexylamine, monoheptylamine, monooctylamine, dimethylamine, methylethylamine, diethylamine, methylpropylamine, ethylpropylamine, dipropylamine, methylbutylamine, ethylbutylamine, propylbutylamine, dibutylamine, dipentylamine, dihexylamine, diheptylamine and dioctylamine (where the alkyl groups may be straight-chain or branched); alkanolamines such as monomethanolamine, monoethanolamine, monopropanolamine, monobutanolamine, monopentanolamine, monohexanolamine, monoheptanolamine, monooctanolamine, monononanolamine, dimethanolamine, methanolethanolamine, diethanolamine, methanolpropanolamine, ethanolpropanolamine, dipropanolamine, methanolbutanolamine, ethanolbutanolamine, propanolbutanolamine, dibutanolamine, dipentanolamine, dihexanolamine, diheptanolamine and dioctanolamine (where the alkanol groups may be straight-chain or branched); and mixtures of the foregoing.

As phosphorus-based anti-wear agents to be used for the invention there are preferred phosphorous acid diester-based anti-wear agents such as di-2-ethylhexyl phosphite from the viewpoint of improving the fatigue life and heat and oxidation stability, trithiophosphorous acid triester-based anti-wear agents such as trilauryl trithiophosphite from the viewpoint of improving the fatigue life, and zinc dialkyldithiophosphates from the viewpoint of improving the wear resistance.

There are no particular restrictions on the content of the phosphorus-based anti-wear agent according to the invention, but from the viewpoint of the fatigue life, extreme-pressure property, wear resistance and oxidation stability, it is preferably 0.01-0.2% by mass and more preferably 0.02-0.15% by mass in terms of phosphorus element based on the total amount of the composition.

A sulfur-based anti-wear agent containing no phosphorus as a constituent element may also be used in the lubricating oil composition for a wet clutch according to the fifth embodiment. As such sulfur-based anti-wear agents there are preferred sulfurized fats and oils, olefin sulfides, dihydrocarbyl polysulfides, dithiocarbamates, thiadiazoles, benzothiazoles and the like, among which one or more sulfur-based anti-wear agents selected from among sulfurized fats and oils, olefin sulfides, dihydrocarbyl polysulfides, dithiocarbamates, thiadiazoles and benzothiazoles are preferred.

Specific examples of sulfurized fats and oils, olefin sulfides, dihydrocarbylpolysulfides, dithiocarbamates and thiadiazoles are the same as for the fourth embodiment and will not be repeated here.

There are no particular restrictions on the sulfur-based anti-wear agent content of the lubricating oil composition for a wet clutch according to the fifth embodiment, but from the viewpoint of fatigue life, extreme-pressure property, wear resistance and oxidation stability, it is preferably 0.01-3% by mass, more preferably 0.1-3% by mass, even more preferably 0.5-2.5% by mass and most preferably 1.5-2.5% by mass as sulfur element based on the total amount of the composition.

The lubricating oil composition for a wet clutch according to the fifth embodiment preferably contains a friction modifier to allow further improvement in the frictional properties. Specific examples of friction modifiers are the same as for the third embodiment and will not be repeated here.

The friction modifier content of the lubricating oil composition for a wet clutch according to the fifth embodiment is preferably 0.01% by mass or greater, more preferably 0.1% by mass or greater and even more preferably 0.3% by mass or greater, and preferably not greater than 3% by mass, more preferably not greater than 2% by mass and even more preferably not greater than 1% by mass, based on the total amount of the composition. If the friction modifier content is less than the aforementioned lower limit the friction reducing effect by the addition will tend to be insufficient, while if it is greater than the aforementioned upper limit, the effects of the phosphorus-based anti-wear agent may be inhibited, or the solubility of the additives may be reduced.

The lubricating oil composition for a wet clutch according to the fifth embodiment preferably further contains a metal-based detergent from the viewpoint of cleanability. Specific examples, preferred examples and contents for metal-based detergents are the same as for the third embodiment described above, and will not be repeated here.

The lubricating oil composition for a wet clutch according to the fifth embodiment preferably contains a viscosity index improver to allow further improvement in the viscosity-temperature characteristic. Specific examples, preferred examples and contents for viscosity index improvers are the same as for the third embodiment described above, and will not be repeated here.

If necessary in order to improve performance, other additives in addition to those mentioned above may be added to the lubricating oil composition for a wet clutch according to the fifth embodiment, and such additives may include antioxidants other than component (A-3), corrosion inhibitors, rust-preventive agents, demulsifiers, metal deactivators, pour point depressants, rubber swelling agents, antifoaming agents, coloring agents and the like, either alone or in combinations of two or more. As examples of antioxidants other than component (A-3) there may be mentioned copper-based and molybdenum-based metal antioxidants. Specific examples of these additives are the same as for the third embodiment and will not be repeated here.

When such additives are added to a lubricating oil composition of the invention, the contents will normally be selected in ranges of 0.01-2% by mass for antioxidants other than component (A-3), 0.005-5% by mass for corrosion inhibitors, rust-preventive agents and demulsifiers, 0.005-1% by mass for metal deactivators, 0.05-1% by mass for pour point depressants, 0.0005-1% by mass for antifoaming agents and 0.001-1.0% by mass for coloring agents, based on the total amount of the composition.

There are no particular restrictions on the kinematic viscosity at 100° C. of the lubricating oil composition for a wet clutch of the fifth embodiment, but it is preferably 2-20 $mm^2/s$, more preferably 4-15 $mm^2/s$ and even more preferably 5-10 $mm^2/s$.

The lubricating oil composition for a wet clutch of the fifth embodiment having the construction described above has sufficiently high heat and oxidation stability, and also excellent viscosity-temperature characteristics, frictional properties and low volatility. The lubricating oil composition for a wet clutch of the fifth embodiment having such excellent properties can sufficiently prevent production of insoluble components such as sludge and varnish caused by deterioration, and the clogging of wet clutches that occurs as a result of the insoluble components, and is therefore suitable as a lubricating oil to be used in 4-stroke internal combustion engines for motorcycles with wet clutch mechanisms. The lubricating oil for a wet clutch according to the invention can also be suitably used in transmission devices such as automatic transmissions, continuously variable transmissions and dual-clutch transmissions.

Sixth Embodiment

The lubricating oil composition for a drive-train according to the sixth embodiment comprises a lubricating base oil of the first embodiment or second embodiment described above, (A-4) a poly(meth)acrylate-based viscosity index improver and (B-4) a phosphorus-containing compound. The descriptions of the lubricating base oils according to the first embodiment and second embodiment will not be repeated here. The lubricating oil composition for an internal combustion engine of the fifth embodiment may further contain the mineral base oils and synthetic base oils mentioned above in the explanation of the first embodiment, in addition to the lubricating base oil according to the first embodiment or second embodiment, and those mineral base oils and synthetic base oils will not be repeated here.

By combining the (A-4) poly(meth)acrylate-based viscosity index improver with the lubricating base oil of the first embodiment or second embodiment described above in the lubricating oil composition for a drive-train of the sixth embodiment, it is possible to effectively exhibit a viscosity index-improving effect, a viscosity-suppressing effect at low temperatures and a pour point-lowering effect, in addition to the original excellent viscosity-temperature characteristic of the lubricating base oil, and thus to achieve a high level of low-temperature characteristics.

There are no particular restrictions on the poly(meth)acrylate-based viscosity index improver used for the sixth embodiment, and non-dispersant or dispersant poly(meth) acrylate compounds commonly employed as viscosity index improvers for lubricating oils may be used. Polymers of compounds represented by the following general formula (18) may be mentioned as non-dispersant poly(meth)acrylate-based viscosity index improvers.

[Chemical Formula 27]

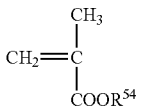

(18)

In general formula (18), $R^{54}$ represents a C1-C30 alkyl group. The alkyl group represented by $R^{54}$ may be either straight-chain or branched. Specific examples include methyl, ethyl, propyl, butyl, pentyl, hexyl, heptyl, octyl, nonyl, decyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl and triacontyl (which alkyl groups may be either straight-chain or branched).

As preferred examples of dispersant poly(meth)acrylate-based viscosity index improvers there may be mentioned, specifically, copolymers obtained by copolymerizing one or more monomers selected from among compounds represented by general formula (18) above, with one or more nitrogen-containing monomers selected from among compounds represented by general formula (19) or (20) below.

[Chemical Formula 28]

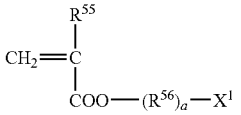

(19)

[Chemical Formula 29]

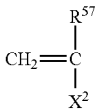

(20)

In general formulas (19) and (20), $R^{55}$ and $R^{57}$ each separately represent hydrogen or methyl. $R^{56}$ represents a C1-C30 alkylene group, of which specific examples include methylene, ethylene, propylene, butylene, pentylene, hexylene, heptylene, octylene, nonylene, decylene, undecylene, dodecylene, tridecylene, tetradecylene, pentadecylene, hexadecylene, heptadecylene, octadecylene, nonadecylene, eicosylene, heneicosylene, docosylene, tricosylene, tetracosylene, pentacosylene, hexacosylene, heptacosylene, octacosylene, nonacosylene and triacontylene (where the alkylene groups may be either straight-chain or branched). The letter "a" represents an integer of 0 or 1, and $X^1$ and $X^2$ each separately represent an amine residue or heterocyclic residue containing 1-2 nitrogen atoms and 0-2 oxygen atoms. Specific preferred examples for $X^1$ and $X^2$ include dimethylamino, diethylamino, dipropylamino, dibutylamino, anilino, toluidino, xylidino, acetylamino, benzoylamino, morpholino, pyrolyl, pyrrolino, pyridyl, methylpyridyl, pyrrolidinyl, piperidinyl, quinonyl, pyrrolidonyl, pyrrolidono, imidazolino and pyrazino.

Specific preferred examples of nitrogen-containing monomers represented by general formula (19) or (20) include dimethylaminomethyl methacrylate, diethylaminomethyl methacrylate, dimethylaminoethyl methacrylate, diethylaminoethyl methacrylate, 2-methyl-5-vinylpyridine, morpholinomethyl methacrylate, morpholinoethyl methacrylate, N-vinylpyrrolidone, and mixtures thereof.

A poly(meth)acrylate-based viscosity index improver used for the sixth embodiment may be either dispersant or non-dispersant as mentioned above, but preferably a non-dispersant poly(meth)acrylate-based viscosity index improver is used, and more preferably one of the following (A-4-1)-(A4-3).

(A-4-1) A polymer composed mainly of a monomer of general formula (18) wherein $R^{54}$ is methyl or a C12-C15 straight-chain alkyl group.

(A-4-2) A polymer composed mainly of a monomer of general formula (18) wherein $R^{54}$ is methyl or a C12-C15, C16 or C18 straight-chain alkyl group.

(A-4-3) A polymer of a monomer of general formula (18) wherein $R^{54}$ is methyl or a C12-C15, C16, C18 straight-chain alkyl group and a monomer of general formula (18) wherein $R^{54}$ is a C20-C30 straight-chain or branched alkyl group.

Of polymers (A-4-1)-(A-4-3) above, polymers (A-4-2) and (A-4-3) are especially preferred from the viewpoint of improving the fatigue life. Polymer (A-4-3) preferably contains a monomer of general formula (18) wherein $R^{54}$ is a C22-C28 branched alkyl group (more preferably a 2-decyltetradecyl group) as a structural unit.

The weight-average molecular weight of the poly(meth)acrylate-based viscosity index improver used for the sixth embodiment is not particularly restricted but is preferably 5,000-100,000, more preferably 10,000-60,000 and even more preferably 15,000-24,000. If the weight-average molecular weight of the poly(meth)acrylate-based viscosity index improver is less than 5,000 the viscosity increase effect due to addition of the viscosity index improver will be insufficient, while if it is greater than 100,000 the fatigue life, wear resistance and shear stability will be inadequate. The weight-average molecular weight referred to here is the weight-average molecular weight based on polystyrene, as measured using a 150-CALC/GPC by Japan Waters Co., equipped with two GMHHR-M (7.8 mmID×30 cm) columns by Tosoh Corp. set in series, with tetrahydrofuran as the solvent and a differential refractometer (RI) as the detector, and with a temperature of 23° C., a flow rate of 1 mL/min, a sample concentration of 1% by mass, a sample injection rate of 75 μL.

The poly(meth)acrylate-based viscosity index improver content in the lubricating oil composition for a drive-train according to the sixth embodiment is preferably 0.1-20% by mass and more preferably 1-15% by mass based on the total amount of the composition. If the poly(meth)acrylate-based viscosity index improver content is less than 0.1% by mass the viscosity-increasing effect and the cold flow property-improving effect of the addition will tend to be insufficient, while if it is greater than 20% by mass the viscosity of the lubricating oil composition will be increased, making it difficult to achieve fuel savings and tending to lower the shear stability. When a poly(meth)acrylate-based viscosity index improver is added to the lubricating base oil, the poly(meth)acrylate-based viscosity index improver will generally be dissolved in 5-95% by mass of a diluent and the mixture added to the lubricating base oil, for improved lubricity and handleability, and the poly(meth)acrylate-based viscosity index improver content in this case refers to the total amount of the poly(meth)acrylate-based viscosity index improver and the diluent.

The lubricating oil composition for a drive-train according to the sixth embodiment further includes a phosphorus-containing compound as component (B-4). As phosphorus-containing compounds there are preferably used phosphorus-based extreme-pressure agents and phosphorus-sulfur-based extreme-pressure agents. The specific examples and preferred examples of phosphorus-based extreme-pressure agents and phosphorus-sulfur-based extreme-pressure agents are the same as the examples of phosphorus-based anti-wear agents mentioned for the fifth embodiment and will not be repeated here.

There are no particular restrictions on the phosphorus-containing compound content according to the sixth embodiment, but from the viewpoint of the fatigue life, extreme-pressure property, wear resistance and oxidation stability, it is preferably 0.01-0.2% by mass and more preferably 0.02-0.15% by mass in terms of phosphorus element based on the total amount of the composition. If the phosphorus-containing compound content is below the aforementioned lower limit, the lubricity will tend to be insufficient. Also, when the lubricating oil composition is used as a lubricating oil for a manual transmission the synchro property (lubrication which allows gears with different reduction gear ratios to engage smoothly for function) will tend to be insufficient. On the other hand, if the phosphorus-containing compound content is greater than the aforementioned upper limit the fatigue life will tend to be inadequate. Also, when the lubricating oil composition is used as a lubricating oil for a manual transmission, the heat and oxidation stability will tend to be insufficient.

The lubricating oil composition for a drive-train according to the sixth embodiment may consist only of the lubricating base oil, the (A-4) poly(meth)acrylate-based viscosity index improver and the (B-4) phosphorus-containing compound described above, but it may further contain the various additives mentioned below as necessary.

The lubricating oil composition for a drive-train according to the sixth embodiment also preferably comprises a sulfur-based extreme-pressure agent in addition to the aforementioned phosphorus-sulfur-based extreme-pressure agent, from the viewpoint of yet further improving the fatigue life, extreme-pressure property and wear resistance. The specific examples and preferred examples of sulfur-based extreme-pressure agents are the same as the examples of sulfur-based anti-wear agents mentioned for the fifth embodiment and will not be repeated here.

There are no particular restrictions on the sulfur-based extreme-pressure agent content of the lubricating oil composition for a drive-train according to the sixth embodiment, but from the viewpoint of fatigue life, extreme-pressure property, wear resistance and oxidation stability, it is preferably 0.01-3% by mass, more preferably 0.1-3% by mass, even more preferably 0.5-2.5% by mass and most preferably 1.5-2.5% by mass as sulfur element based on the total amount of the composition. If the sulfur-based extreme-pressure agent content is below the aforementioned lower limit, the lubricity will tend to be insufficient. Also, when the lubricating oil composition is used as a lubricating oil for a manual transmission, the synchro property (lubrication which allows gears with different reduction gear ratios to engage smoothly for function) will tend to be insufficient. On the other hand, if the sulfur-based extreme-pressure agent content is above the aforementioned upper limit, the fatigue life will tend to be inadequate. Also, when the lubricating oil composition is used as a lubricating oil for a manual transmission, the heat and oxidation stability will tend to be insufficient. When the lubricating oil composition for a drive-train according to the sixth embodiment is to be used as a lubricating oil for a final reduction gear it will be necessary to ensure an even superior extreme-pressure property, and therefore the sulfur-based extreme-pressure agent content is preferably 0.5-3% by mass and more preferably 1.5-2.5% by mass as sulfur element based on the total amount of the composition.

The lubricating oil composition for a drive-train of the sixth embodiment contains (A-4) a poly(meth)acrylate-based viscosity index improver as mentioned above, but it may further contain a viscosity index improver other than the (A-4) poly(meth)acrylate-based viscosity index improver (this will hereinafter also be referred to as "component (C-4)"). As component (C-4) there may be mentioned dispersant ethylene-α-olefin copolymers and their hydrides, polyisobutylene or its hydrides, styrene-diene hydrogenated copolymers, styrene-maleic anhydride ester copolymers and polyalkylstyrenes.

When using component (C-4), the content thereof will normally be selected within a range of 0.1-10% by mass based on the total amount of the composition.

The lubricating oil composition for a drive-train according to the sixth embodiment also preferably comprises (D-4) an ashless dispersant from the viewpoint of yet further improving the wear resistance, heat and oxidation stability and frictional properties. As examples of (D-4) ashless dispersants there may be mentioned the following nitrogen compounds (D-4-1)-(D-4-3). These may be used alone or in combinations of two or more.

(D-4-1) Succiniimides having at least one C40-400 alkyl or alkenyl group in the molecule, or derivatives thereof.

(D4-2) Benzylamines having at least one C40-400 alkyl or alkenyl group in the molecule, or derivatives thereof.

(D-4-3) Polyamines having at least one C40-400 alkyl or alkenyl group in the molecule, or derivatives thereof.

More specifically, examples of the (D-4-1) succiniimides include compounds represented by the following general formula (21) or (22).

[Chemical Formula 30]

(21)

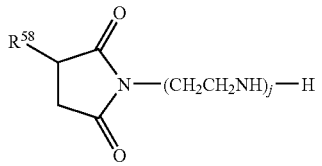

[Chemical Formula 31]

(22)

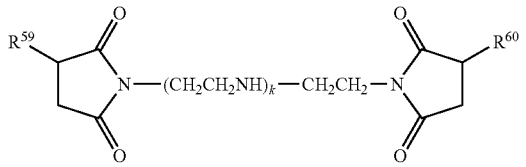

In general formula (21), $R^{58}$ represents a C40-400 and preferably C60-350 alkyl or alkenyl group, and j represents an integer of 1-5 and preferably 2-4.

In general formula (22), $R^{59}$ and $R^{60}$ each separately represent a C40-C400 and preferably C60-C350 alkyl or alkenyl group, and k represents an integer of 0-4 and preferably 1-3.

The aforementioned succiniimides include "mono type" succiniimides represented by general formula (21), in a form with succinic anhydride added to one end of a polyamine by imidation, and "bis type" succiniimides represented by general formula (22), in a form with succinic anhydride added to both ends of a polyamine, and either of these or mixtures of both of these may be used for the lubricating oil composition for a drive-train according to the sixth embodiment.

Specific examples of the (D-4-2) benzylamines include compounds represented by the following general formula (23).

[Chemical Formula 32]

(23)

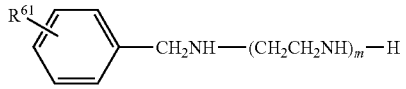

In general formula (23), $R^{61}$ represents a C40-C400 and preferably C60-C350 alkyl or alkenyl group, and m represents an integer of 1-5 and preferably 2-4.

The benzylamine may be obtained, for example, by reacting a polyolefin (for example, a propylene oligomer, polybutene or ethylene-α-olefin copolymer) with a phenol to produce an alkylphenol, and then reacting this with formaldehyde and a polyamine (for example, diethylenetriamine, triethylenetetramine, tetraethylenepentamine or pentaethylenehexamine) by Mannich reaction.

Specific examples of the (D4-3) polyamines include compounds represented by the following general formula (24).

$$R^{62}—NH—(CH_2CH_2NH)_m—H \quad (24)$$

In general formula (24), $R^{62}$ represents a C40-C400 and preferably C60-C350 alkyl or alkenyl group, and m represents an integer of 1-5 and preferably 2-4.

The polyamine may be obtained, for example, by chlorination of a polyolefin (for example, a propylene oligomer, polybutene or ethylene-α-olefin copolymer) followed by reaction with ammonia or a polyamine (for example, ethylenediamine, diethylenetriamine, triethylenetetramine, tetraethylenepentamine, pentaethylenehexamine or the like).

The nitrogen compound may have any nitrogen content, but from the viewpoint of wear resistance, oxidation stability and frictional properties, the nitrogen content is usually preferred to be 0.01-10% by mass and more preferably 0.1-10% by mass.

As examples of derivatives of the aforementioned nitrogen compounds there may be mentioned "acid-modified compounds" obtained by reacting the aforementioned nitrogen compounds with C2-C30 monocarboxylic acids (fatty acids and the like) or C2-C30 polycarboxylic acids such as oxalic acid, phthalic acid, trimellitic acid or pyromellitic acid, and neutralizing or amidating all or a portion of the remaining amino and/or imino groups; "boron-modified compounds" obtained by reacting the aforementioned nitrogen compounds with boric acid and neutralizing or amidating all or a portion of the remaining amino and/or imino groups; sulfur-modified compounds obtained by reacting the aforementioned nitrogen compounds with sulfur compounds; and modified compounds obtained by combining two or more types of modification selected from among acid modification, boron modification and sulfur modification of the aforementioned nitrogen compounds.

When the lubricating oil composition for a drive-train according to the sixth embodiment contains (D-4) an ashless dispersant, there are no particular restrictions on its content but it is preferably 0.5-10.0% by mass and more preferably 1-8.0% by mass based on the total amount of the composition. If the ashless dispersant content is less than 0.5% by mass the effect of improving the fatigue life and extreme-pressure property will tend to be insufficient, while if it is greater than 10.0% by mass the cold flow property of the composition will be excessively impaired. Particularly when the lubricating oil composition for a drive-train according to the sixth embodiment is used as a lubricating oil for an automatic transmission or continuously variable transmission, the content of the ashless dispersant is preferably 1-6% by mass based on the total amount of the composition. When the lubricating oil composition for a drive-train according to the sixth embodiment is used as a lubricating oil for a manual transmission, the content of the ashless dispersant is preferably 0.5-6% by mass and more preferably 0.5-2% by mass based on the total amount of the composition.

The lubricating oil composition for a drive-train according to the sixth embodiment also preferably comprises a metal-based detergent from the viewpoint of yet further improving the frictional properties. Specific examples and preferred examples for metal-based detergents are the same as for the third embodiment described above, and will not be repeated here.

When the lubricating oil composition for a drive-train according to the sixth embodiment contains a metal-based detergent, there are no particular restrictions on its content, but it is preferably 0.005-0.5% by mass, more preferably 0.008-0.3% by mass and even more preferably 0.01-0.2% by mass as metal element based on the total amount of the composition. If the metal-based detergent content is less than 0.005% by mass as metal element the improving effect on the frictional property will be insufficient, and if it exceeds 0.5% by mass an adverse effect may be exhibited on the wet clutch friction material. When the lubricating oil composition for a drive-train according to the sixth embodiment is to be used as a lubricating oil for an automatic transmission or continuously variable transmission, the metal-based detergent content is preferably 0.005-0.2% by mass and more preferably 0.008-0.02% by mass in terms of metal element based on the total amount of the composition. Particularly when the lubricating oil composition for a drive-train according to the sixth embodiment is to be used as a lubricating oil for a manual transmission, the metal-based detergent content is preferably 0.05-0.5% by mass, more preferably 0.1-0.4% by mass and even more preferably 0.2-0.35% by mass in terms of metal element based on the total amount of the composition.

The lubricating oil composition for a drive-train according to the sixth embodiment also preferably comprises an antioxidant from the viewpoint of yet further improving the heat and oxidation stability. As antioxidants there may be used any ones commonly employed in the field of lubricating oils, but particularly preferred ones are phenol-based antioxidants and/or amine-based antioxidants, and especially combinations of phenol-based antioxidants and amine-based antioxidants. Specific examples of phenol-based antioxidants and amine-based antioxidants are the same as for the third embodiment described above and will not be repeated here.

There are no particular restrictions on the antioxidant content of the lubricating oil composition for a drive-train of the sixth embodiment, but it is preferably 0.01-5.0% by mass based on the total amount of the composition.

The lubricating oil composition for a drive-train according to the sixth embodiment also preferably comprises a friction modifier from the viewpoint of yet further improving the wet clutch frictional properties for gearboxes. As friction modifiers there may be used any compounds commonly employed as friction modifiers in the field of lubricating oils, but preferred for use are amine compounds, imide compounds, fatty acid esters, fatty acid amides, fatty acid metal salts and the like having at least one C6-C30 alkyl or alkenyl and especially C6-C30 straight-chain alkyl or straight-chain alkenyl group in the molecule.

Examples of amine compounds include C6-C30 straight-chain or branched and preferably straight-chain aliphatic monoamines, straight-chain or branched and preferably straight-chain aliphatic polyamines, or alkylene oxide addition products of these aliphatic amines. As imide compounds there may be mentioned succiniimides with C6-C30 straight-chain or branched alkyl or alkenyl groups, and/or the same modified with a carboxylic acid, boric acid, phosphoric acid, sulfuric acid or the like. Examples of fatty acid esters include esters of C7-C31 straight-chain or branched and preferably straight-chain fatty acids with aliphatic monohydric alcohols or aliphatic polyhydric alcohols. Examples of fatty acid amides include amides of C7-C31 straight-chain or branched and preferably straight-chain fatty acids with aliphatic monoamines or aliphatic polyamines. As fatty acid metal salts there may be mentioned alkaline earth metal salts (magnesium salts, calcium salts, etc.) and zinc salts of C7-C31 straight-chain or branched and preferably straight-chain fatty acids.

Preferred among these according to the sixth embodiment are ones containing one or more selected from among amine-based friction modifiers, ester-based friction modifiers, amide-based friction modifiers and fatty acid friction modifiers, and most preferred from the viewpoint of further improving the fatigue life are ones containing one or more selected from among amine-based friction modifiers, fatty acid friction modifiers and amide-based friction modifiers. From the viewpoint of notably improving the anti-shudder life when the lubricating oil composition for a drive-train according to the sixth embodiment is to be used as a lubricating oil for an automatic transmission or continuously variable transmission, it is most preferred to include an imide-based friction modifier.

According to the sixth embodiment, the one or more compounds selected from among the friction modifiers mentioned above may be used in any desired amounts. There are no particular restrictions on the friction modifier content, but it is preferably 0.01-5.0% by mass and more preferably 0.03-3.0% by mass based on the total amount of the composition. When the lubricating oil composition for a drive-train according to the sixth embodiment is to be used as a lubricating oil for an automatic transmission or continuously variable transmission, it will be necessary to further improve the frictional properties, and therefore the friction modifier content is preferably 0.5-5% by mass and more preferably 2-4% by mass based on the total amount of the composition. When the lubricating oil composition for a drive-train according to the sixth embodiment is used as a lubricating oil composition for a manual transmission, the content of the friction modifier is preferably 0.1-3% by mass and more preferably 0.5-1.5% by mass based on the total amount of the composition.

If necessary in order to improve performance, other additives in addition to those mentioned above may be added to the lubricating oil composition for a drive-train according to the sixth embodiment, and such additives may include corrosion inhibitors, rust-preventive agents, demulsifiers, metal deactivators, pour point depressants, rubber swelling agents, antifoaming agents, coloring agents and the like, either alone or in combinations of two or more. Specific examples of these additives are the same as for the third embodiment and will not be repeated here.

When such additives are added to a lubricating oil composition for a drive-train of the sixth embodiment, the contents will normally be selected in ranges of 0.005-5% by mass for corrosion inhibitors, rust-preventive agents and demulsifiers, 0.005-1% by mass for metal deactivators, 0.05-1% by mass for pour point depressants, 0.0005-1% by mass for antifoaming agents and 0.001-1.0% by mass for coloring agents, based on the total amount of the composition.

A lubricating oil composition for a drive-train according to the sixth embodiment having the construction described above can exhibit high levels of wear resistance, anti-seizing property and fatigue life for prolonged periods even with reduced viscosity, and can achieve both fuel efficiency and durability in drive-trains while also improving the cold startability. There are no particular restrictions on drive power transmission devices to which the lubricating oil composition for a drive-train according to the sixth embodiment may be applied, and specifically there may be mentioned gearboxes such as automatic transmissions, continuously variable transmissions and manual transmissions, as well as final reduction gears, power distribution/regulating mechanisms and the like. The following preferred modes of the invention will now be described: (I) a lubricating oil composition for an automatic transmission or continuously variable transmission, (II) a lubricating oil composition for a manual transmission and (III) a lubricating oil composition for a final reduction gear.

The kinematic viscosity at 100° C. of the lubricating base oil according to the first embodiment or second embodiment in the (I) lubricating oil composition for an automatic transmission or continuously variable transmission is preferably 2-8 $mm^2/s$, more preferably 2.6-4.5 $mm^2/s$, even more preferably 2.8-4.3 $mm^2/s$ and most preferably 3.3-3.8 $mm^2/s$. If the kinematic viscosity is below this lower limit the lubricity will tend to be insufficient, while if it is greater than the upper limit the cold flow property will tend to be insufficient.

The kinematic viscosity at 40° C. of the lubricating base oil according to first embodiment or second embodiment in the (I) lubricating oil composition for an automatic transmission or continuously variable transmission is preferably 15-50 $mm^2/s$, more preferably 20-40 $mm^2/s$ and even more preferably 25-35 $mm^2/s$. If the kinematic viscosity is below this lower limit the lubricity will tend to be insufficient, while if it is greater than the upper limit the fuel savings will tend to be insufficient due to increased stirring resistance.

The viscosity index of the lubricating base oil according to the first embodiment or second embodiment in the (I) lubricating oil composition for an automatic transmission or continuously variable transmission is preferably 120-160, more preferably 125-150 and even more preferably 130-145. A viscosity index within this range will allow the viscosity-temperature characteristic to be further improved.

The phosphorus-containing compounds in the (I) lubricating oil composition for an automatic transmission or continuously variable transmission are preferably one or more selected from among phosphoric acid, phosphoric acid esters, phosphorous acid, phosphorous acid esters, thiophosphoric acid, thiophosphoric acid esters, thiophosphorous acid, thiophosphorous acid esters, and salts of the foregoing, more preferably one or more selected from among phosphoric acid, phosphoric acid esters, phosphorous acid, phosphorous acid esters, and salts of the foregoing, and even more preferably one or more selected from among phosphoric acid esters, phosphorous acid esters and salts of the foregoing.

The phosphorus-containing compound content of the (I) lubricating oil composition for an automatic transmission or continuously variable transmission is preferably 0.005-0.1% by mass, more preferably 0.01-0.05% by mass and even more preferably 0.02-0.04% by mass, in terms of phosphorus element based on the total amount of the composition. If the phosphorus-containing compound content is below the aforementioned lower limit the lubricity will tend to be insufficient, while if it is greater than the aforementioned upper limit the wet frictional properties and fatigue life will tend to be insufficient.

The BF viscosity at −40° C. of the (I) lubricating oil composition for an automatic transmission or continuously variable transmission is preferably not greater than 20,000 mPa·s, more preferably not greater than 15,000 mPa·s, even more preferably not greater than 10,000 mPa·s, yet more preferably not greater than 8,000 mPa·s and most preferably not greater than 7,000 mPa·s. If the BF viscosity exceeds the aforementioned upper limit, the cold startability will tend to be insufficient.

The viscosity index of the (I) lubricating oil composition for an automatic transmission or continuously variable transmission is preferably 100-250, more preferably 150-250 and even more preferably 170-250. If the viscosity index is below the aforementioned lower limit, the fuel savings will tend to be insufficient. A composition wherein the aforementioned upper limit is exceeded will have an excessive poly(meth) acrylate-based viscosity index improver content, and the shear stability will tend to be insufficient.

The kinematic viscosity at 100° C. of the lubricating base oil of the first embodiment or second embodiment in the (II) lubricating oil composition for a manual transmission is preferably 3.0-20 $mm^2/s$, more preferably 3.3-15 $mm^2/s$, even more preferably 3.3-8 $mm^2/s$, yet more preferably 3.8-6 $mm^2/s$ and most preferably 4.3-5.5 $mm^2/s$. If the kinematic viscosity is below this lower limit the lubricity will tend to be insufficient, while if it is greater than the upper limit the cold flow property will tend to be insufficient.

The kinematic viscosity at 40° C. of the lubricating base oil according to the first embodiment or second embodiment in the (II) lubricating oil composition for a manual transmission is preferably 10-200 $mm^2/s$, more preferably 15-80 $mm^2/s$, even more preferably 20-70 $mm^2/s$ and most preferably 23-60 $mm^2/s$. If the kinematic viscosity is below this lower limit the lubricity will tend to be insufficient, while if it is greater than the upper limit the fuel savings will tend to be insufficient due to increased stirring resistance.

The viscosity index of the lubricating base oil of the first embodiment or second embodiment in the (II) lubricating oil composition for a manual transmission is preferably 130-170, more preferably 135-165 and even more preferably 140-160. A viscosity index within this range will allow the viscosity-temperature characteristic to be further improved.

As phosphorus-containing compounds to be added to the (II) lubricating oil composition for a manual transmission, there are preferred one or more selected from among thiophosphoric acid, thiophosphoric acid esters, thiophosphorous acid and thiophosphorous acid esters, there are more preferred one or more selected from among thiophosphoric acid esters and thiophosphorous acid esters, especially preferred is zinc dithiophosphate.

The phosphorus-containing compound content of the (II) lubricating oil composition for a manual transmission is preferably 0.01-0.2% by mass, more preferably 0.05-0.15% by mass and even more preferably 0.09-0.14% by mass, in terms of phosphorus element based on the total amount of the composition. If the phosphorus-containing compound content is below the aforementioned lower limit the lubricity and synchro property will tend to be insufficient, while if it is greater than the aforementioned upper limit the heat and oxidation stability and fatigue life will tend to be insufficient.

The BF viscosity at −40° C. of the (II) lubricating oil composition for a manual transmission is preferably not greater than 20,000 mPa·s, more preferably not greater than 15,000 mPa·s, even more preferably not greater than 10,000 mPa·s, yet more preferably not greater than 9,000 mPa·s and most preferably not greater than 8,000 mPa·s. If the BF viscosity exceeds the aforementioned upper limit, the cold startability will tend to be insufficient.

The viscosity index of the (II) lubricating oil composition for a manual transmission is preferably 100-250, more preferably 140-250 and even more preferably 150-250. If the viscosity index is below the aforementioned lower limit, the fuel savings will tend to be insufficient. A composition wherein the aforementioned upper limit is exceeded will have an excessive poly(meth)acrylate-based viscosity index improver content, and the shear stability will tend to be insufficient.

The kinematic viscosity at 100° C. of the lubricating base oil of the first embodiment or second embodiment in the (III) lubricating oil composition for a final reduction gear is preferably 3.0-20 $mm^2/s$, more preferably 3.3-15 $mm^2/s$, even more preferably 3.3-8 $mm^2/s$, yet more preferably 3.8-6 $mm^2/s$ and most preferably 4.3-5.5 $mm^2/s$. If the kinematic viscosity is below this lower limit the lubricity will tend to be insufficient, while if it is greater than the upper limit the cold flow property will tend to be insufficient.

The kinematic viscosity at 40° C. of the lubricating base oil of the first embodiment or second embodiment in the (III) lubricating oil composition for a final reduction gear is preferably 15-200 $mm^2/s$, more preferably 20-150 $mm^2/s$ and even more preferably 23-80 $mm^2/s$. If the kinematic viscosity is below this lower limit the lubricity will tend to be insufficient, while if it is greater than the upper limit the fuel savings will tend to be insufficient due to increased stirring resistance.

The viscosity index of the lubricating base oil of the first or second embodiment in the (III) lubricating oil composition for a final reduction gear is preferably 130-170, more preferably 135-165 and even more preferably 140-160. A viscosity index within this range will allow the viscosity-temperature characteristic to be further improved.

As phosphorus-containing compounds to be added to the (III) lubricating oil composition for a final reduction gear there are preferred one or more selected from among phosphoric acid esters, phosphorous acid esters, thiophosphoric acid esters, thiophosphorous acid esters and salts of the foregoing, there are more preferred one or more selected from among phosphoric acid esters, phosphorous acid esters and their amine salts, and there are even more preferred one or more selected from among phosphorous acid esters, amine salts thereof and phosphoric acid esters.

The phosphorus-containing compound content of the (III) lubricating oil composition for a final reduction gear is preferably 0.01-0.2% by mass, more preferably 0.05-0.15% by mass and even more preferably 0.1-0.14% by mass, in terms of phosphorus element based on the total amount of the composition. If the phosphorus-containing compound content is below the aforementioned lower limit the lubricity will tend to be insufficient, while if it is greater than the aforementioned upper limit the fatigue life will tend to be insufficient.

The BF viscosity at −40° C. of the (III) lubricating oil composition for a final reduction gear is preferably not greater than 100,000 mPa·s, more preferably not greater than 50,000 mPa·s, even more preferably not greater than 20,000 mPa·s and yet more preferably not greater than 10,000 mPa·s. If the BF viscosity exceeds the aforementioned upper limit, the cold startability will tend to be insufficient.

The viscosity index of the (III) lubricating oil composition for an automatic transmission or continuously variable transmission is preferably 100-250, more preferably 120-250 and even more preferably 125-250. If the viscosity index is below the aforementioned lower limit, the fuel savings will tend to be insufficient. A composition wherein the aforementioned upper limit is exceeded will have an excessive poly(meth) acrylate-based viscosity index improver content, and the shear stability will tend to be insufficient.

Examples

The present invention will now be explained in greater detail based on examples and comparative examples, with the understanding that these examples are in no way limitative on the invention.

Examples 1-3

The fraction separated by vacuum distillation in a process for refining of a solvent refined base oil was subjected to solvent extraction with furfural and then hydrotreatment, which was followed by solvent dewaxing with a methyl ethyl ketone-toluene mixed solvent. The wax portion obtained by further deoiling of slack wax removed during the solvent dewaxing (hereunder, "WAX1") was used as feedstock oil for the lubricating base oil. The properties of WAX1 are shown in Table 1.

TABLE 1

| Starting wax | WAX1 |
|---|---|
| Kinematic viscosity at 100° C. ($mm^2/s$) | 6.8 |
| Melting point (° C.) | 58 |
| Oil content (% by mass) | 6.3 |
| Sulfur content (ppm by mass) | 900 |

WAX1 was hydrocracked in the presence of a hydrocracking catalyst, under conditions with a hydrogen partial pressure of 5 MPa, a mean reaction temperature of 350° C. and an LHSV of 1 $hr^{-1}$. The hydrocracking catalyst was used as the sulfurized form of a catalyst comprising 3% by mass nickel and 15% by mass molybdenum supported on an amorphous silica-alumina support (silica:alumina=20:80 (mass ratio)).

The decomposition product obtained by the hydrocracking was subjected to vacuum distillation to obtain a lube-oil distillate at 26% by volume with respect to the feedstock oil. The lube-oil distillate was subjected to solvent dewaxing using a methyl ethyl ketone-toluene mixed solvent under conditions with a solvent/oil ratio of 4 and a filtration temperature of −25° C., to obtain lubricating base oils (D1-D3) for Examples 1-3 having different viscosity grades.

Examples 4-6

After mixing and kneading 800 g of USY zeolite and 200 g of alumina binder, the mixture was molded into a cylindrical shape with a diameter of 1/16 inch (approximately 1.6 mm) and a height of 6 mm. The obtained molded article was calcined at 450° C. for 3 hours to obtain a support. The support was impregnated with an aqueous solution of dichlorotetraamine-platinum(II) in an amount of 0.8% by mass of the support in terms of platinum, and then dried at 120° C. for 3 hours and calcined at 400° C. for 1 hour to obtain the target catalyst.

Next, 200 ml of the obtained catalyst was packed into a fixed-bed circulating reactor, and the reactor was used for hydrocracking/hydroisomerization of the paraffinic hydrocarbon-containing feedstock oil. As the feedstock oil for this step there was used an FT wax with a paraffin content of 95% by mass and a carbon number distribution of 20-80 (hereunder, "WAX2"). The properties of WAX2 are shown in Table 2. The conditions for hydrocracking were a hydrogen pressure of 3 MPa, a reaction temperature of 350° C. and an LHSV of 2.0 $h^{-1}$, to obtain a cracking/isomerization product oil wherein the content of fractions with boiling points of 380° C. or lower (decomposition product) was 30% by mass (cracking severity: 30%) with respect to the starting material.

TABLE 2

| Starting wax | WAX2 |
|---|---|
| Kinematic viscosity at 100° C. ($mm^2/s$) | 5.8 |
| Melting point (° C.) | 70 |

TABLE 2-continued

| Starting wax | WAX2 |
|---|---|
| Oil content (% by mass) | <1 |
| Sulfur content (ppm by mass) | <0.2 |

The cracking/isomerization product oil obtained in the hydrocracking/hydroisomerization step was then subjected to vacuum distillation to obtain a lube-oil distillate. The lube-oil distillate was subjected to solvent dewaxing using a methyl ethyl ketone-toluene mixed solvent under conditions with a solvent/oil ratio of 4 and a filtration temperature of −25° C., to obtain lubricating base oils (D4-D6) for Examples 4-6 having different viscosity grades.

Examples 7-15

The fraction separated by vacuum distillation in a process for refining of a solvent refined base oil was subjected to solvent extraction with furfural and then hydrotreatment, which was followed by solvent dewaxing with a methyl ethyl ketone-toluene mixed solvent. The wax portion obtained by further deoiling of slack wax removed during the solvent dewaxing (hereunder, "WAX3") was used as starting material for the lubricating base oil. The properties of WAX3 are shown in Table 3.

TABLE 3

| Starting wax | WAX3 |
|---|---|
| Kinematic viscosity at 100° C. ($mm^2/s$) | 6.3 |
| Melting point (° C.) | 53 |
| Oil content (% by mass) | 19.9 |
| Sulfur content (ppm by mass) | 1900 |

WAX3 was hydrocracked in the presence of a hydrocracking catalyst, under conditions with a hydrogen partial pressure of 5 MPa, a mean reaction temperature of 350° C. and an LHSV of 1 $hr^{-1}$. The hydrocracking catalyst was used as the sulfurized form of a catalyst comprising 3% by mass nickel and 15% by mass molybdenum supported on an amorphous silica-alumina support (silica:alumina=20:80 (mass ratio)).

The decomposition product obtained by the hydrocracking was subjected to vacuum distillation to obtain a lube-oil distillate at 26% by volume with respect to the feedstock oil. The lube-oil distillate was subjected to solvent dewaxing using a methyl ethyl ketone-toluene mixed solvent under conditions with a solvent/oil ratio of 4 and a filtration temperature of −25° C., to obtain lubricating base oils (D7-D9, D10-D12, D13-D15) for Examples 7-9, 10-12 and 13-15 having different viscosity grades.

The results of evaluation testing of the properties and performance of the lubricating base oils of Examples 1-15 are shown in Tables 4-6. The results of evaluation testing of the properties and performance of the high viscosity index base oils R1-R9 as Comparative Examples 1-9 are shown in Tables 7-9.

TABLE 4

| | | Example 1 | Example 4 | Example 7 | Example 8 | Example 9 |
|---|---|---|---|---|---|---|
| Base oil | | D1 | D4 | D7 | D8 | D9 |
| Crude wax | | WAX1 | WAX2 | WAX3 | WAX3 | WAX3 |
| Base oil composition (based on total amount of base oil) | Saturated components content % by mass | 98.2 | 99.2 | 96.8 | 99.6 | 95.8 |
| | Aromatic components content % by mass | 0.9 | 0.3 | 3.1 | 0.3 | 3.9 |
| | Polar compounds content % by mass | 0.9 | 0.5 | 0.1 | 0.1 | 0.3 |

TABLE 4-continued

| | | | Example 1 | Example 4 | Example 7 | Example 8 | Example 9 |
|---|---|---|---|---|---|---|---|
| Saturated components composition (based on total amount of saturated components) | Cyclic saturated components content % by mass | | 5.6 | 1.0 | 14.2 | 10.8 | 17.5 |
| | Acyclic saturated components content % by mass | | 94.4 | 99.0 | 85.8 | 89.2 | 82.5 |
| Acyclic saturated components composition (based on total amount of base oil) | Straight-chain paraffins content % by mass | | 0.1 | 0.1 | 0.1 | 0.1 | 0.2 |
| | Branched paraffins content % by mass | | 92.6 | 98.1 | 83.0 | 88.7 | 78.8 |
| EI-MS saturated components composition analysis | Monocyclic saturated components content % by mass | | 1.3 | 0.0 | 5.1 | 3.2 | 5.5 |
| | Bicyclic saturated components content % by mass | | 1.8 | 0.4 | 5.5 | 3.8 | 6.2 |
| Cyclic saturated components composition (based on total amount of saturated components) | Bicyclic or greater saturated components content % by mass | | 4.3 | 1.0 | 9.1 | 7.6 | 11.5 |
| | Monocyclic saturated components content/bicyclic saturated components content (mass ratio) | | 0.7 | 0.0 | 0.9 | 0.8 | 0.9 |
| | Monocyclic saturated components content/bicyclic or greater saturated components content (mass ratio) | | 0.3 | 0.0 | 0.6 | 0.4 | 0.5 |
| n-d-M Ring analysis | % $C_P$ | | 92.2 | 94.5 | 87.9 | 97.0 | 85.0 |
| | % $C_N$ | | 7.8 | 5.5 | 11.3 | 3.0 | 10.8 |
| | % $C_A$ | | 0.0 | 0.0 | 0.9 | 0.0 | 4.2 |
| | % $C_P$/% $C_N$ | | 11.8 | 17.2 | 7.8 | 32.3 | 7.9 |
| Sulfur content | | ppm by mass | <1 | <1 | <1 | <1 | <1 |
| Nitrogen content | | ppm by mas | <3 | <3 | <3 | <3 | <3 |
| Refractive index (20° C.) $n_{20}$ | | | 1.4497 | 1.4502 | 1.4535 | 1.4480 | 1.4577 |
| Kinematic viscosity (40° C.) | | $mm^2/s$ | 10.4 | 10.6 | 9.70 | 10.0 | 9.30 |
| Kinematic viscosity (100° C.) kv100 | | $mm^2/s$ | 2.8 | 2.8 | 2.7 | 2.8 | 2.6 |
| Viscosity index | | | 125 | 115 | 125 | 125 | 114 |
| $n_{20}$-0.002 × kv100 | | | 1.444 | 1.445 | 1.448 | 1.442 | 1.452 |
| Density (15° C.) | | $g/cm^3$ | 0.809 | 0.809 | 0.816 | 0.803 | 0.822 |
| Pour point | | ° C. | −22.5 | −22.5 | −25 | −25 | −27.5 |
| Iodine value | | | 0.88 | 0.51 | 2.10 | 1.80 | 1.95 |
| Aniline point | | ° C. | 114 | 114 | 116 | 115 | 109 |
| Distillation properties | IBP[° C.] | ° C. | 336 | 340 | 328 | 315 | 325 |
| | T10[° C.] | ° C. | 360 | 362 | 358 | 342 | 351 |
| | T50[° C.] | ° C. | 388 | 387 | 394 | 390 | 393 |

TABLE 5

| | | Example 2 | Example 5 | Example 10 | Example 11 | Example 12 |
|---|---|---|---|---|---|---|
| Base oil | | D2 | D5 | D10 | D11 | D12 |
| Crude wax | | WAX1 | WAX2 | WAX3 | WAX3 | WAX3 |
| Base oil composition (based on total base oil) | Saturated components content % by mass | 98.6 | 99.5 | 97.7 | 98.2 | 95.2 |
| | Aromatic components content % by mass | 0.8 | 0.2 | 2.1 | 1.0 | 3.4 |
| | Polar compounds content % by mass | 0.6 | 0.3 | 0.2 | 0.8 | 1.2 |
| Saturated components composition (based on total amount of saturated components) | Cyclic saturated components content % by mass | 5.6 | 1.2 | 13.7 | 12.2 | 36.1 |
| | Acyclic saturated components content % by mass | 95.4 | 98.8 | 86.3 | 87.8 | 63.9 |
| Acyclic saturated components composition (based on total amount of base oil) | Straight-chain paraffins content % by mass | 0.1 | 0.1 | 0.1 | 0.1 | 0.2 |
| | Branched paraffins content % by mass | 94.0 | 98.2 | 84.2 | 86.1 | 59.9 |
| EI-MS saturated components composition analysis | Monocyclic saturated components content % by mass | 2.1 | 0.0 | 4.8 | 3.3 | 10.9 |
| | Bicyclic saturated components content % by mass | 1.9 | 0.4 | 4.0 | 3.1 | 9.8 |
| Cyclic saturated components composition (based on total amount of saturated components) | Bicyclic or greater saturated components content % by mass | 3.5 | 1.2 | 8.9 | 8.9 | 25.2 |
| | Monocyclic saturated components content/bicyclic saturated components content (mass ratio) | 1.1 | 0.0 | 1.2 | 1.0 | 1.1 |

TABLE 5-continued

| | | | Example 2 | Example 5 | Example 10 | Example 11 | Example 12 |
|---|---|---|---|---|---|---|---|
| | Monocyclic saturated components content/bicyclic or greater saturated components content (mass ratio) | | 0.6 | 0.0 | 0.5 | 0.4 | 04 |
| n-d-M Ring analysis | % $C_P$ | | 89.1 | 93.3 | 91.3 | 95.0 | 89.6 |
| | % $C_N$ | | 10.6 | 6.7 | 8.7 | 5.0 | 7.3 |
| | % $C_A$ | | 0.3 | 0.0 | 0.0 | 0.0 | 3.1 |
| | % $C_P$/% $C_N$ | | 8.4 | 13.9 | 10.5 | 19.0 | 12.3 |
| Sulfur content | | ppm by mass | 2 | <1 | <1 | <1 | <1 |
| Nitrogen content | | ppm by mass | <3 | <3 | <3 | <3 | <3 |
| Refractive index (20° C.) $n_{20}$ | | | 1.4537 | 1.4538 | 1.4565 | 1.452 | 1.4605 |
| Kinematic viscosity (40° C.) | | $mm^2/s$ | 17.3 | 16.7 | 16.6 | 17.6 | 16.89 |
| Kinematic viscosity (100° C.) kv100 | | $mm^2/s$ | 4.1 | 3.9 | 4.0 | 4.1 | 4.0 |
| Viscosity index | | | 143 | 131 | 144 | 140 | 140 |
| $n_{20}$ − 0.002 × kv100 | | | 1.445 | 1.446 | 1.449 | 1.444 | 1.452 |
| Density (15° C.) | | $g/cm^3$ | 0.825 | 0.815 | 0.821 | 0.811 | 0.827 |
| Pour point | | ° C. | −20 | −20 | −22.5 | −22.5 | −25 |
| Iodine value value | | | 0.63 | 0.21 | 1.35 | 1.57 | 1.73 |
| Aniline point | | ° C. | 120 | 121 | 121 | 119 | 124 |
| Distillation properties | IBP[° C.] | ° C. | 353 | 350 | 356 | 353 | 350 |
| | T10[° C.] | ° C. | 386 | 384 | 398 | 386 | 390 |
| | T50[° C.] | ° C. | 432 | 431 | 431 | 433 | 435 |
| | T90[° C.] | ° C. | 470 | 467 | 479 | 469 | 471 |

TABLE 6

| | | | Example 3 | Example 6 | Example 13 | Example 14 | Example 15 |
|---|---|---|---|---|---|---|---|
| Base oil | | | D3 | D6 | D13 | D14 | D15 |
| Crude wax | | | WAX1 | WAX2 | WAX3 | WAX3 | WAX3 |
| Base oil composition (based on total amount of base oil) | Saturated components content % by mass | | 97.8 | 99.3 | 95.7 | 97.4 | 92.2 |
| | Aromatic components content % by mass | | 1.3 | 0.2 | 4.0 | 1.5 | 6.1 |
| | Polar compounds content % by mass | | 1.1 | 0.5 | 0.3 | 1.1 | 1.7 |
| Saturated components composition (based on total amount of saturated components) | Cyclic saturated components content % by mass | | 13.0 | 1.4 | 24.1 | 20.1 | 35.8 |
| | Acyclic saturated components content % by mass | | 87.0 | 98.6 | 75.9 | 79.9 | 64.2 |
| Acyclic saturated components composition (based on total amount of base oil) | Straight-chain paraffins content % by mass | | 0.1 | 0.1 | 0.1 | 0.1 | 0.2 |
| | Branched paraffins content % by mass | | 84.8 | 97.8 | 72.5 | 77.7 | 59.0 |
| EI-MS saturated components composition analysis | Monocyclic saturated components content % by mass | | 5.9 | 0.0 | 11.8 | 7.6 | 12.7 |
| | Bicyclic saturated components content % by mass | | 4.8 | 0.6 | 8.5 | 5.8 | 10.9 |
| Cyclic saturated components composition (based on total amount of saturated components) | Bicyclic or greater saturated components content % by mass | | 7.1 | 1.4 | 12.3 | 12.5 | 23.1 |
| | Monocyclic saturated components content/bicyclic saturated components content (mass ratio) | | 1.4 | 0.0 | 1.4 | 1.3 | 1.2 |
| | Monocyclic saturated components content/bicyclic or greater saturated components content (mass ratio) | | 0.8 | 0.0 | 1.0 | 0.6 | 0.5 |
| n-d-M Ring analysis | % $C_P$ | | 94.9 | 95.3 | 88.1 | 95.00 | 88.9 |
| | % $C_N$ | | 5.1 | 4.7 | 11.8 | 5.0 | 8.3 |
| | % $C_A$ | | 0.0 | 0.0 | 0.1 | 0.0 | 2.8 |
| | % $C_P$/% $C_N$ | | 18.6 | 20.3 | 7.5 | 19.0 | 10.7 |
| Sulfur content | | ppm by mass | 2 | <1 | 2 | <1 | <1 |
| Nitrogen content | | ppm by mass | <3 | <3 | <3 | <3 | <3 |
| Refractive index (20° C.) $n_{20}$ | | | 1.4583 | 1.4593 | 1.4600 | 1.4590 | 1.4660 |
| Kinematic viscosity (40° C.) | | $mm^2/s$ | 38.2 | 37.2 | 30.4 | 35.0 | 33.9 |
| Kinematic viscosity (100° C.) kv100 | | $mm^2/s$ | 7.2 | 7.0 | 6.0 | 6.8 | 6.5 |
| Viscosity index | | | 155 | 152 | 148 | 154 | 148 |
| $n_{20}$ − 0.002 × kv100 | | | 1.444 | 1.445 | 1.448 | 1.446 | 1.453 |
| Density (15° C.) | | $g/cm^3$ | 0.826 | 0.826 | 0.833 | 0.825 | 0.837 |
| Pour point | | ° C. | −15 | −15 | −15 | −17.5 | −20 |

TABLE 6-continued

| | | | Example 3 | Example 6 | Example 13 | Example 14 | Example 15 |
|---|---|---|---|---|---|---|---|
| Iodine value | | | 0.56 | 0.19 | 0.77 | 0.95 | 1.03 |
| Aniline point | | ° C. | 133 | 133 | 128 | 131 | 125 |
| Distillation properties | IBP[° C.] | ° C. | 424 | 421 | 416 | 425 | 421 |
| | T10[° C.] | ° C. | 453 | 450 | 446 | 449 | 445 |
| | T50[° C.] | ° C. | 485 | 483 | 473 | 473 | 472 |
| | T90[° C.] | ° C. | 513 | 510 | 508 | 493 | 492 |

TABLE 7

| | | | Comp. Ex. 1 | Comp. Ex. 2 | Comp. Ex. 3 |
|---|---|---|---|---|---|
| Base oil | | | R1 | R2 | R3 |
| Crude wax | | | — | — | — |
| Base oil composition (based on total amount of base oil) | Saturated components content % by mass | | 93.8 | 99.3 | 99.6 |
| | Aromatic components content % by mass | | 6.0 | 0.5 | 0.3 |
| | Polar compounds content % by mass | | 0.2 | 0.2 | 0.1 |
| Saturated components composition (based on total amount of saturated components) | Cyclic saturated components content % by mass | | 46.5 | 42.1 | 45.7 |
| | Acyclic saturated components content % by mass | | 53.5 | 57.9 | 54.3 |
| Acyclic saturated components composition (based on total amount of base oil) | Straight-chain paraffins content % by mass | | 0.4 | 0.1 | 0.1 |
| | Branched paraffins content % by mass | | 49.8 | 57.4 | 54.0 |
| EI-MS saturated components composition analysis | Monocyclic saturated components content % by mass | | 16.2 | 14.6 | 19.2 |
| | Bicyclic saturated components content % by mass | | 10.0 | 10.2 | 14.0 |
| Cyclic saturated components composition (based on total amount of saturated components) | Bicyclic or greater saturated components content % by mass | | 30.3 | 127.5 | 29.9 |
| | Monocyclic saturated components content/bicyclic saturated components content (mass ratio) | | 1.6 | 1.4 | 1.4 |
| | Monocyclic saturated components content/bicyclic or greater saturated components content (mass ratio) | | 0.5 | 0.5 | 0.6 |
| n-d-M Ring analysis | % $C_P$ | | 75.4 | 72.9 | 72.6 |
| | % $C_N$ | | 23.2 | 26.0 | 27.4 |
| | % $C_A$ | | 1.4 | 1.1 | 0.0 |
| | % $C_P$/% $C_N$ | | 3.3 | 2.8 | 2.7 |
| Sulfur content | | ppm by mass | <1 | <1 | <1 |
| Nitrogen content | | ppm by mass | <3 | <3 | <3 |
| Refractive index (20° C.) $n_{20}$ | | | 1.4597 | 1.4606 | 1.4611 |
| Kinematic viscosity (40° C.) | | $mm^2/s$ | 9.4 | 9.7 | 12.6 |
| Kinematic viscosity (100° C.) kv100 | | $mm^2/s$ | 2.6 | 2.6 | 3.1 |
| Viscosity index | | | 109 | 98 | 105 |
| $n_{20}$ − 0.002 × kv100 | | | 1.455 | 1.455 | 1.455 |
| Density (15° C.) | | $g/cm^3$ | 0.829 | 0.831 | 0.835 |
| Pour point | | ° C. | −27.5 | −17.5 | −27.5 |
| Iodine value | | | 5.10 | 5.40 | 5.80 |
| Aniline point | | ° C. | 104 | 104 | 107 |
| Distillation properties | IBP[° C.] | ° C. | 243 | 249 | 288 |
| | T10[° C.] | ° C. | 312 | 317 | 350 |
| | T50[° C.] | ° C. | 377 | 386 | 389 |
| | T90[° C.] | ° C. | 418 | 425 | 428 |
| | FBP[° C.] | ° C. | 492 | 499 | 529 |
| CCS viscosity (−35° C.) | | mPa · s | <1000 | <1000 | <1000 |
| NOACK evaporation amount (250° C., 1 hr) | | % by mass | 51.9 | 62.7 | 58.7 |

TABLE 8

| | | Comp. Ex. 4 | Comp. Ex. 5 | Comp. Ex. 6 |
|---|---|---|---|---|
| Base oil | | R4 | R5 | R6 |
| Crude wax | | — | — | — |
| Base oil composition (based on total amount of base oil) | Saturated components content % by mass | 94.8 | 94.8 | 99.9 |
| | Aromatic components content % by mass | 5.2 | 5.0 | 0.1 |

TABLE 8-continued

| | | | Comp. Ex. 4 | Comp. Ex. 5 | Comp. Ex. 6 |
|---|---|---|---|---|---|
| | Polar compounds content % by mass | | 0.0 | 0.2 | 0.0 |
| Saturated components composition (based on total amount of saturated components) | Cyclic saturated components content % by mass | | 46.8 | 42.3 | 46.0 |
| | Acyclic saturated components content % by mass | | 53.2 | 57.7 | 54.0 |
| Acyclic saturated components composition (based on total amount of base oil) | Straight-chain paraffins content % by mass | | 0.1 | 0.1 | 0.1 |
| | Branched paraffins content % by mass | | 50.3 | 54.6 | 53.8 |
| EI-MS saturated components composition analysis | Monocyclic saturated components content % by mass | | 16.9 | 16.1 | 20.1 |
| | Bicyclic saturated components content % by mass | | 13.3 | 12.2 | 14.2 |
| Cyclic saturated components composition (based on total amount of saturated components) | Bicyclic or greater saturated components content % by mass | | 29.9 | 26.2 | 25.9 |
| | Monocyclic saturated components content/bicyclic saturated components content (mass ratio) | | 1.3 | 1.3 | 1.4 |
| | Monocyclic saturated components content/bicyclic or greater saturated components content (mass ratio) | | 0.6 | 0.6 | 0.8 |
| n-d-M Ring analysis | % $C_P$ | | 78.0 | 78.1 | 80.7 |
| | % $C_N$ | | 20.7 | 20.6 | 19.3 |
| | % $C_A$ | | 1.3 | 0.7 | 0.0 |
| | % $C_P$/% $C_N$ | | 3.8 | 3.8 | 4.2 |
| Sulfur content | | ppm by mass | 2 | 1 | <1 |
| Nitrogen content | | ppm by mass | 4 | 3 | <3 |
| Refractive index (20° C.) $n_{20}$ | | | 1.4640 | 1.4633 | 1.4625 |
| Kinematic viscosity (40° C.) | | $mm^2/s$ | 18.7 | 18.1 | 19.9 |
| Kinematic viscosity (100° C.) kv100 | | $mm^2/s$ | 4.1 | 4.0 | 4.3 |
| Viscosity index | | | 121 | 119 | 125 |
| $n_{20}$ − 0.002 × kv100 | | | 1.456 | 1.454 | 1.454 |
| Density (15° C.) | | $g/cm^3$ | 0.839 | 0.836 | 0.835 |
| Pour point | | ° C. | −22.5 | −27.5 | −17.5 |
| Iodine value | | | 2.78 | 2.65 | 2.55 |
| Aniline point | | ° C. | 112 | 112 | 116 |
| Distillation properties | IBP[° C.] | ° C. | 325 | 309 | 314 |
| | T10[° C.] | ° C. | 383 | 385 | 393 |
| | T50[° C.] | ° C. | 420 | 425 | 426 |
| | T90[° C.] | ° C. | 458 | 449 | 459 |
| | FBP[° C.] | ° C. | 495 | 489 | 505 |
| CCS viscosity (−35° C.) | | mPa · s | 3500 | 2900 | 3000 |
| NOACK evaporation amount (250° C., 1 hr) | | % by mass | 16.1 | 16.5 | 14.5 |

TABLE 9

| | | Comp. Ex. 7 | Comp. Ex. 8 | Comp. Ex. 9 |
|---|---|---|---|---|
| Base oil | | R7 | R8 | R9 |
| Crude wax | | — | — | — |
| Base oil composition (based on total amount of base oil) | Saturated components content % by mass | 93.3 | 99.5 | 99.5 |
| | Aromatic components content % by mass | 6.6 | 0.4 | 0.4 |
| | Polar compounds content % by mass | 0.1 | 0.1 | 0.1 |
| Saturated components composition (based on total amount of saturated components) | Cyclic saturated components content % by mass | 47.2 | 42.7 | 46.4 |
| | Acyclic saturated components content % by mass | 52.8 | 57.3 | 53.6 |
| Acyclic saturated components composition (based on total amount of base oil) | Straight-chain paraffins content % by mass | 0.1 | 0.1 | 0.1 |
| | Branched paraffins content % by mass | 49.2 | 50.9 | 53.2 |

TABLE 9-continued

| | | | Comp. Ex. 7 | Comp. Ex. 8 | Comp. Ex. 9 |
|---|---|---|---|---|---|
| EI-MS saturated components composition analysis | Monocyclic saturated components content % by mass | | 17.4 | 17.5 | 23.0 |
| | Bicyclic saturated components content % by mass | | 13.5 | 13.2 | 14.2 |
| Cyclic saturated components composition (based on total amount of saturated components) | Bicyclic or greater saturated components content % by mass | | 29.8 | 25.2 | 23.5 |
| | Monocyclic saturated components content/bicyclic saturated components content (mass ratio) | | 1.3 | 1.3 | 1.6 |
| | Monocyclic saturated components content/bicyclic or greater saturated components content (mass ratio) | | 0.6 | 0.7 | 1.0 |
| n-d-M Ring analysis | % $C_P$ | | 78.4 | 83.4 | 80.6 |
| | % $C_N$ | | 21.1 | 16.1 | 19.4 |
| | % $C_A$ | | 0.5 | 0.5 | 0.0 |
| | % $C_P$/% $C_N$ | | 3.7 | 5.2 | 4.2 |
| Sulfur content | | ppm by mass | <1 | <1 | <1 |
| Nitrogen content | | ppm by mass | <3 | <3 | <3 |
| Refractive index (20° C.) $n_{20}$ | | | 1.4685 | 1.4659 | 1.4657 |
| Kinematic viscosity (40° C.) | | $mm^2/s$ | 37.9 | 32.7 | 33.9 |
| Kinematic viscosity (100° C.) kv100 | | $mm^2/s$ | 6.6 | 6.0 | 6.2 |
| Viscosity index | | | 129 | 131 | 133 |
| $n_{20}$ − 0.002 × kv100 | | | 1.455 | 1.454 | 1.453 |
| Density (15° C.) | | $g/cm^3$ | 0.847 | 0.838 | 0.841 |
| Pour point | | ° C. | −17.5 | −17.5 | −17.5 |
| Iodine value | | | 5.30 | 4.52 | 3.95 |
| Aniline point | | ° C. | 126 | 123 | 123 |
| Distillation properties | IBP[° C.] | ° C. | 317 | 308 | 310 |
| | T10[° C.] | ° C. | 412 | 420 | 422 |
| | T50[° C.] | ° C. | 477 | 469 | 472 |
| | T90[° C.] | ° C. | 525 | 522 | 526 |
| | FBP[° C.] | ° C. | 576 | 566 | 583 |
| CCS viscosity (−35° C.) | | mPa · s | >10000 | >10000 | >10000 |
| NOACK evaporation amount (250° C., 1 hr) | | % by mass | 6.0 | 9.7 | 8.2 |

[Light Stability Evaluation Test]

First, as measuring samples there were prepared each of the lubricating base oils of Examples 1-3 and Comparative Examples 1, 2, 4, 5, 7 and 8, and compositions obtained by adding a phenol-based antioxidant (2,6-di-tert-butyl-p-cresol: DBPC) at 0.2% by mass to each of the lubricating base oils. Next, a sunshine weather meter test apparatus was used for 70 hours of irradiation of each lubricating base oil or composition using light with a wavelength range of 400-750 nm, to a mean temperature of 40° C. The color tone of each lubricating base oil before and after irradiation was evaluated by the Saybolt color units based on ASTM D 156-00. The results are shown in Tables 5-7.

TABLE 10

| | | | Example 1 | Comp. Ex. 1 | Comp. Ex. 2 |
|---|---|---|---|---|---|
| Base oil | | | D1 | R1 | R2 |
| Saybolt color units | Before irradiation | | >+30 | +26 | >+30 |
| | After irradiation | No DBPC addition | <−16 | <−16 | <−16 |
| | | DBPC addition | +28 | +5 | +11 |

TABLE 11

| | | | Example 2 | Comp. Ex. 4 | Comp. Ex. 5 |
|---|---|---|---|---|---|
| Base oil | | | D2 | R4 | R5 |
| Saybolt color units | Before irradiation | | +26 | +24 | +25 |
| | After irradiation | No DBPC addition | <−16 | <−16 | <−16 |
| | | DBPC addition | +23 | +6 | +5 |

TABLE 12

| | | | Example 3 | Comp. Ex. 7 | Comp. Ex. 8 |
|---|---|---|---|---|---|
| Base oil | | | D3 | R7 | R8 |
| Saybolt color units | Before irradiation | | +24 | +22 | +23 |
| | After irradiation | No DBPC addition | <−16 | <−16 | <−16 |
| | | DBPC addition | +20 | +6 | +9 |

The results shown in Tables 4-9 indicate that the lubricating base oils of Examples 1-15 had higher viscosity indexes and superior viscosity-temperature characteristics compared to the lubricating base oils of Comparative Examples 1-9. Also, based on RBOT life comparison between Examples 1, 4 and 7-9 and Comparative Examples 1-3, between Examples 2, 5 and 10-12 and Comparative Examples 4-6 and between Examples 3, 6 and 13-15 and Comparative Examples 7-9 shown in Tables 4-9, and light stability test comparison between Example 1 and Comparative Examples 1 and 2, between Example 2 and Comparative Examples 4 and 5, and between Example 3 and Comparative Examples 7 and 8 shown in Tables 10-12, the lubricating base oils of Examples 1-15 had longer usable lives at each viscosity grade, and exhibited superiority in terms of heat and oxidation stability and antioxidant-addition effect.

Example 16

WAX1 was hydrocracked in the presence of a hydrocracking catalyst in the same manner as Example 16, under conditions with a hydrogen partial pressure of 5 MPa, a mean reaction temperature of 350° C. and an LHSV of 1 $hr^{-1}$. The hydrocracking catalyst was used as the sulfurized form of a catalyst comprising 3% by mass nickel and 15% by mass molybdenum supported on an amorphous silica-alumina support (silica:alumina=20:80 (mass ratio)).

The decomposition product obtained by the hydrocracking was then subjected to vacuum distillation to obtain a lube-oil distillate with a kinematic viscosity at 100° C. of 4 $mm^2/s$. The lube-oil distillate was subjected to solvent dewaxing using a methyl ethyl ketone-toluene mixed solvent with a solvent/oil ratio of 4, to a freezing point of −29° C. for the obtained solvent dewaxed oil, to obtain a lubricating base oil (D16) for Example 1. The dewaxing temperature was −32° C.

Example 17

After mixing and kneading 800 g of USY zeolite and 200 g of alumina binder, the mixture was shaped into a cylindrical shape with a diameter of 1/16 inch (approximately 1.6 mm) and a height of 6 mm. The obtained molded article was calcined at 450° C. for 3 hours to obtain a support. The support was impregnated with an aqueous solution of dichlorotetraamine-platinum (II) in an amount of 0.8% by mass of the support in terms of platinum, and then dried at 120° C. for 3 hours and calcined at 400° C. for 1 hour to obtain the target catalyst.

Next, 200 ml of the obtained catalyst was packed into a fixed-bed circulating reactor, and the reactor was used for hydrocracking/hydroisomerization of the paraffinic hydrocarbon-containing feedstock oil. In this step, WAX2 was used as the feedstock oil. The conditions for hydrocracking were a hydrogen pressure of 3 MPa, a reaction temperature of 350° C. and an LHSV of 2.0 $h^{-1}$, to obtain a cracking/isomerization product oil wherein the content of fractions with boiling points of 380° C. or lower (decomposition product) was 30% by mass (cracking severity: 30%) with respect to the starting material.

The decomposition product obtained by the hydrocracking was then subjected to vacuum distillation to obtain a lube-oil distillate with a kinematic viscosity at 100° C. of 4 $mm^2/s$. The lube-oil distillate was subjected to solvent dewaxing using a methyl ethyl ketone-toluene mixed solvent with a solvent/oil ratio of 4, to a freezing point of −25° C. for the obtained solvent dewaxed oil, to obtain a lubricating base oil (D17) for Example 2. The dewaxing temperature was −25° C.

Example 18

WAX3 was hydrocracked in the presence of a hydrocracking catalyst in the same manner as Example 18, under conditions with a hydrogen partial pressure of 5 MPa, a mean reaction temperature of 350° C. and an LHSV of 1 $hr^{-1}$. The hydrocracking catalyst was used as the sulfurized form of a catalyst comprising 3% by mass nickel and 15% by mass molybdenum supported on an amorphous silica-alumina support (silica:alumina=20:80 (mass ratio)).

The decomposition product obtained by the hydrocracking was then subjected to vacuum distillation to obtain a lube-oil distillate with a kinematic viscosity at 100° C. of 4 $mm^2/s$. The lube-oil distillate was subjected to solvent dewaxing using a methyl ethyl ketone-toluene mixed solvent with a solvent/oil ratio of 4, to a freezing point of −29° C. for the obtained solvent dewaxed oil, to obtain a lubricating base oil (D18) for Example 3. The dewaxing temperature was −32° C.

The results of evaluation testing of the properties and performance of the lubricating base oils of Examples 16-18 are shown in Table 13. The results of evaluation testing of the properties and performance of the high viscosity index base oils R10-R12 as Comparative Examples 10-12 are shown in Table 14.

TABLE 13

| | | Example 16 | Example 17 | Example 18 |
|---|---|---|---|---|
| Base oil | | D16 | D17 | D18 |
| Crude wax | | WAX1 | WAX2 | WAX3 |
| Base oil composition (based on total amount of base oil) | Saturated components content % by mass | 98.6 | 99.5 | 97.5 |
| | Aromatic components content % by mass | 0.8 | 0.2 | 2.4 |
| | Polar compounds content % by mass | 0.4 | 0.3 | 0.1 |
| Saturated components composition (based on total amount of saturated components) | Cyclic saturated components content % by mass | 6.1 | 1.2 | 13.0 |
| | Acyclic saturated components content % by mass | 93.9 | 98.8 | 87.0 |
| Acyclic saturated components composition (based on total amount of base oil) | Straight-chain paraffins content % by mass | 0.1 | 0.1 | 0.1 |
| | Branched paraffins content % by mass | 92.5 | 98.2 | 84.7 |
| EI-MS saturated components composition analysis | Monocyclic saturated components content % by mass | 2.3 | 0.0 | 4.5 |
| Cyclic saturated components composition (based on total amount of saturated components) | Bicyclic saturated components content % by mass | 2.3 | 0.4 | 4.0 |
| | Bicyclic or greater saturated components content % by mass | 3.8 | 1.2 | 8.5 |
| | Monocyclic saturated components content/bicyclic saturated components content (mass ratio) | 1.0 | 0.0 | 1.1 |
| | Monocyclic saturated components content/bicyclic or greater saturated components content (mass ratio) | 0.6 | 0.0 | 0.5 |
| n-d-M Ring analysis | % $C_P$ | 92.1 | 93.3 | 91.6 |
| | % $C_N$ | 7.9 | 6.7 | 8.4 |
| | % $C_A$ | 0.0 | 0.0 | 0.0 |
| | % $C_P$/% $C_N$ | 11.7 | 13.9 | 10.9 |

TABLE 13-continued

| | | | Example 16 | Example 17 | Example 18 |
|---|---|---|---|---|---|
| Sulfur content | | ppm by mass | <1 | <1 | 2 |
| Nitrogen content | | ppm by mass | <3 | <3 | <3 |
| Refractive index (20° C.) $n_{20}$ | | | 1.4549 | 1.4538 | 1.4559 |
| Kinematic viscosity (40° C.) | | $mm^2/s$ | 16.3 | 16.7 | 16.8 |
| Kinematic viscosity (100° C.) kv100 | | $mm^2/s$ | 3.9 | 3.9 | 4.0 |
| Viscosity index | | | 140 | 131 | 140 |
| $n_{20} - 0.002 \times kv100$ | | | 1.447 | 1.446 | 1.448 |
| Density (15° C.) | | $g/cm^3$ | 0.819 | 0.816 | 0.820 |
| Freezing point | | ° C. | −29 | −25 | −29 |
| Pour point | | ° C. | −27.5 | −20 | −25 |
| Iodine value | | | 0.63 | 0.21 | 1.35 |
| Aniline point | | ° C. | 119 | 121 | 118 |
| Distillation properties | IBP[° C.] | ° C. | 347 | 353 | 374 |
| | T10[° C.] | ° C. | 391 | 386 | 402 |
| | T50[° C.] | ° C. | 437 | 432 | 421 |
| | T90[° C.] | ° C. | 463 | 469 | 464 |
| | FBP[° C.] | ° C. | 487 | 497 | 501 |

TABLE 14

| | | | Comp. Ex. 10 | Comp. Ex. 11 | Comp. Ex. 12 |
|---|---|---|---|---|---|
| Base oil | | | R10 | R11 | R12 |
| Crude wax | | | — | — | — |
| Base oil composition (based on total amount of base oil) | Saturated components content % by mass | | 94.8 | 94.8 | 99.9 |
| | Aromatic components content % by mass | | 5.2 | 5.0 | 0.1 |
| | Polar compounds content % by mass | | 0.0 | 0.2 | 0.0 |
| Saturated components composition (based on total amount of saturated components) | Cyclic saturated components content % by mass | | 46.8 | 42.3 | 46.0 |
| | Acyclic saturated components content % by mass | | 53.2 | 57.7 | 54.0 |
| Acyclic saturated components composition (based on total amount of base oil) | Straight-chain paraffins content % by mass | | 0.1 | 0.1 | 0.1 |
| | Branched paraffins content % by mass | | 50.3 | 54.6 | 53.8 |
| EI-MS saturated components composition analysis | Monocyclic saturated components content % by mass | | 16.9 | 16.1 | 20.1 |
| Cyclic saturated components composition (based on total amount of saturated components) | Bicyclic saturated components content % by mass | | 13.3 | 12.2 | 14.2 |
| | Bicyclic or greater saturated components content % by mass | | 29.9 | 26.2 | 25.9 |
| | Monocyclic saturated components content/bicyclic saturated components content (mass ratio) | | 1.3 | 1.3 | 1.4 |
| | Monocyclic saturated components content/bicyclic or greater saturated components content (mass ratio) | | 0.6 | 0.6 | 0.8 |
| n-d-M Ring analysis | % $C_P$ | | 78.0 | 78.1 | 80.7 |
| | % $C_N$ | | 20.7 | 20.6 | 19.3 |
| | % $C_A$ | | 1.3 | 0.7 | 0.0 |
| | % $C_P$/% $C_N$ | | 3.8 | 3.8 | 4.2 |
| Sulfur content | | ppm by mass | 2 | 1 | <1 |
| Nitrogen content | | ppm by mass | 4 | 3 | <3 |
| Refractive index (20° C.) $n_{20}$ | | | 1.4640 | 1.4633 | 1.4625 |
| Kinematic viscosity (40° C.) | | $mm^2/s$ | 18.7 | 18.1 | 19.9 |
| Kinematic viscosity (100° C.) kv100 | | $mm^2/s$ | 4.1 | 4.0 | 4.3 |
| Viscosity index | | | 121 | 119 | 125 |
| $n_{20} - 0.002 \times kv100$ | | | 1.456 | 1.454 | 1.454 |
| Density (15° C.) | | $g/cm^3$ | 0.839 | 0.836 | 0.835 |
| Freezing point | | ° C. | −24 | −29 | −20 |
| Pour point | | ° C. | −22.5 | −27.5 | −17.5 |
| Iodine value | | | 2.78 | 2.65 | 2.55 |
| Aniline point | | ° C. | 112 | 112 | 116 |
| Distillation properties | IBP[° C.] | ° C. | 325 | 309 | 314 |
| | T10[° C.] | ° C. | 383 | 385 | 393 |
| | T50[° C.] | ° C. | 420 | 425 | 426 |
| | T90[° C.] | ° C. | 458 | 449 | 459 |
| | FBP[° C.] | ° C. | 495 | 489 | 505 |

The results shown in Tables 13 and 14 indicate that the lubricating base oils of Examples 16-18 had higher viscosity indexes and superior low-temperature viscosity characteristics (CCS viscosity at −35° C.) compared to the lubricating base oils of Comparative Examples 10-12. Also, based on the RBOT life comparison between Examples 16-18 and Comparative Examples 10-12 shown in Tables 13 and 14, the lubricating base oils of Examples 16-18 had longer usable lives at each viscosity grade, and exhibited superiority in terms of heat and oxidation stability and antioxidant-addition effect.

Examples 20-22, Comparative Examples 13-15

For Examples 20-22 and Comparative Examples 13-15, lubricating oil compositions having the compositions shown in Tables 15 and 16 were prepared using the lubricating base oils D16-D18 and R10-R12, respectively, and a package additive for 0W-20 engine oil containing the additives indicated below (0W-20 additive PKG). The properties of the obtained lubricating oil compositions are shown in Tables 15 and 16.

(Pour Point Depressant)

A1-1: Polymethacrylate (Viscosity Index Improver)

B1-1: Dispersant polymethacrylate (Metal-Based Detergent)

C1-1: Calcium sulfonate (Dispersing Agent)

D1-1: Alkenylsuccinimide and boric acid-modified alkenylsuccinimide (Anti-Wear Agent)

E1-1: Secondary alkyl-type zinc dithiophosphate (Antioxidant)

F1-1: Alkyldiphenylamine and molybdenum-amine complex.

TABLE 15

| | | Example 20 | Example 21 | Example 22 |
|---|---|---|---|---|
| Base oil composition [% by mass] | D16 | 100 | — | — |
| | D17 | — | 100 | — |
| | D18 | — | — | 100 |
| Lubricating oil composition [% by mass] | Base oil | remainder | remainder | remainder |
| | 0W-20 additive PKG | 18.0 | 18.0 | 18.0 |
| Kinematic viscosity at 100° C. [$mm^2/s$] | | 8.9 | 8.8 | 8.7 |
| Viscosity index | | 220 | 218 | 225 |
| Freezing point [° C.] | | −45 | −42.5 | −45 |
| MRV viscosity at −40° C. [mPa · s] | | 11000 | 12000 | 10600 |

TABLE 15-continued

| | Example 20 | Example 21 | Example 22 |
|---|---|---|---|
| Yield stress at −40° C. [Pa] | 0 | 0 | 0 |

TABLE 16

| | | Comp. Ex. 13 | Comp. Ex. 14 | Comp. Ex. 15 |
|---|---|---|---|---|
| Base oil composition [% by mass] | R10 | 100 | — | — |
| | R11 | — | 100 | — |
| | R12 | — | — | 100 |
| Lubricating oil composition [% by mass] | Base oil | remainder | remainder | remainder |
| | 0W-20 additive PKG | 18.0 | 18.0 | 18.0 |
| Kinematic viscosity at 100° C. [$mm^2/s$] | | 8.6 | 8.8 | 8.7 |
| Viscosity index | | 199 | 201 | 206 |
| Freezing point [° C.] | | −45 | −40 | −42.5 |
| MRV viscosity at −40° C. [mPa · s] | | 24000 | 23100 | 21000 |
| Yield stress at −40° C. [Pa] | | 350 | 350 | 350 |

The results in Tables 15 and 16 indicate that the lubricating oil compositions of Examples 20-22 had high viscosity indexes, low MRV viscosities at −40° C. and yield stresses of 0 Pa, and therefore exhibited very excellent low-temperature viscosity characteristics.

[Production of Lubricating Base Oil]

(Base Oil D19)

WAX1 shown in Table 1 was hydrocracked in the presence of a hydrocracking catalyst, under conditions with a hydrogen partial pressure of 5 MPa, a mean reaction temperature of 350° C. and an LHSV of 1 $hr^{-1}$. The hydrocracking catalyst was used as the sulfurized form of a catalyst comprising 3% by mass nickel and 15% by mass molybdenum supported on an amorphous silica-alumina support (silica:alumina=20:80 (mass ratio)).

The decomposition product obtained by the hydrocracking was subjected to atmospheric distillation to obtain a lube-oil distillate at 26% by volume. The lube-oil distillate was subjected to solvent dewaxing using a methyl ethyl ketone-toluene mixed solvent under conditions with a solvent/oil ratio of 4 and a filtration temperature of −25° C., to obtain the target lubricating base oil (hereinafter referred to as "base oil D19"). The results of evaluation testing of the properties and performance of the base oil D19 are shown in Table 17. The results of evaluation testing of the properties and performance of a high viscosity index base oil R4 are also shown in Table 17.

TABLE 17

| | | D19 | R4 |
|---|---|---|---|
| Base oil | | D19 | R4 |
| Crude wax | | WAX1 | — |
| Base oil composition (based on total amount of base oil) | Saturated components content % by mass | 98.5 | 94.8 |
| | Aromatic components content % by mass | 1.0 | 5.2 |
| | Polar compounds content % by mass | 0.5 | 0.0 |
| Saturated components composition (based on total amount of saturated components) | Cyclic saturated components content % by mass | 4.8 | 46.8 |
| | Acyclic saturated components content % by mass | 95.2 | 53.2 |
| Acyclic saturated components composition (based on total amount of base oil) | Straight-chain paraffins content % by mass | 0.1 | 0.1 |
| | Branched paraffins content % by mass | 98.4 | 50.3 |
| EI-MS saturated components composition analysis | Monocyclic saturated components content % by mass | 1.8 | 16.9 |
| | Bicyclic saturated components content % by mass | 1.7 | 13.3 |

TABLE 17-continued

| | | | | |
|---|---|---|---|---|
| Cyclic saturated components composition (based on total amount of saturated components) | Bicyclic or greater saturated components content % by mass | | 3.0 | 29.9 |
| | Monocyclic saturated components content/bicyclic saturated components content (mass ratio) | | 1.1 | 1.3 |
| | Monocyclic saturated components content/bicyclic or greater saturated components content (mass ratio) | | 0.6 | 0.6 |
| n-d-M Ring analysis | % $C_P$ | | 92.8 | 78.0 |
| | % $C_N$ | | 6.7 | 20.7 |
| | % $C_A$ | | 0.1 | 1.3 |
| | % $C_P$/% $C_N$ | | 13.85 | 3.8 |
| Sulfur content | | ppm by mass | <1 | 2 |
| Nitrogen content | | ppm by mass | <3 | 4 |
| Refractive index (20° C.) $n_{20}$ | | | 1.4555 | 1.4640 |
| Kinematic viscosity (40° C.) | | $mm^2/s$ | 16.9 | 18.7 |
| Kinematic viscosity (100° C.) kv100 | | $mm^2/s$ | 4.0 | 4.1 |
| Viscosity index | | | 140 | 121 |
| $n_{20}$-0.002 × kv100 | | | 1.4475 | 1.456 |
| Density (15° C.) | | $g/cm^3$ | 0.820 | 0.839 |
| Pour point | | ° C. | −25 | −22.5 |
| Iodine value | | | 0.61 | 2.78 |
| Aniline point | | ° C. | 120 | 112 |
| Distillation properties | IBP[° C.] | ° C. | 363 | 325 |
| | T10[° C.] | ° C. | 390 | 383 |
| | T50[° C.] | ° C. | 435 | 420 |
| | T90[° C.] | ° C. | 475 | 458 |
| | FBP[° C.] | ° C. | 502 | 495 |
| CCS viscosity (−35° C.) | | mPa · s | 1980 | 3500 |
| NOACK evaporation amount (250° C., 1 hr) | | % by mass | 13.2 | 16.1 |
| RBOT life (150° C.) | | min | 392 | 300 |

Examples 23-25, Comparative Examples 16, 17

For Examples 23-25 there were prepared lubricating oil compositions having the compositions shown in Table 18, using base oil D19 and the additives listed below. For Comparative Examples 16 and 17 there were prepared lubricating oil compositions having the compositions shown in Table 18, using base oil R4 and the additives listed below.

(Phosphorus-Based Anti-Wear Agent)

A2-1: Zinc dialkyldithiophosphate (phosphorus content: 7.2% by mass, alkyl group: mixture of secondary butyl group or secondary hexyl group)

A2-2: Zinc mono- and dialkylphosphates (phosphorus content: 10.0% by mass, alkyl group: primary octyl group)

(Ashless Antioxidant)

B2-1: Alkyldiphenylamine (alkyl group: butyl group or octyl group)

B2-2: 4,4'-Methylenebis(2,6-di-tert-butylphenol)

(Ashless Dispersant)

C2-1: Polybutenylsuccinimide (number-average molecular weight of polybutenyl group: 1300, nitrogen content: 1.8% by mass)

C2-2: Boric acid-modified polybutenylsuccinimide (number-average molecular weight of polybutenyl group: 1300, nitrogen content: 1.8% by mass, boron content: 0.77% by mass)

(Metal-Based Detergent)

D2-1: Calcium salicylate

D2-2: Calcium sulfonate (Anti-Wear Agent Other than Component (A))

E2-1: Molybdenum dithiocarbamate (Friction Modifier)

F2-1: Glycerin monooleate (Corrosion Inhibitor)

G2-1: Benzotriazole (Other Components)

H2-1: Package containing viscosity index improver, pour point depressant and antifoaming agent.

[Measurement of Sulfated Ash Content]

The sulfated ash contents of the lubricating oil composition of Examples 23-25 and Comparative Examples 16 and 17 were measured according to JIS K 2272-1985. The results are shown in Table 18.

[NOx Absorption Test]

Following the method described in Proceedings of the Japanese Society of Tribologists 1992, 10, 465, NOx-containing gas was blown into the test oil for forced aging, and the time-related changes in base value (hydrochloric acid method) and acid value were measured. The test temperature for this test was 140° C., the NOx concentration in the NOx-containing gas was 1200 ppm and the $O_2$ concentration was 85%. Table 18 shows the acid value increase after 96 hours from the start of blowing in NOx gas. In the table, a smaller acid value increase indicates a longer oxidation life even in the presence of NOx when used in internal combustion engines.

TABLE 18

| | | Example 23 | Example 24 | Example 25 | Comp. Ex. 16 | Comp. Ex. 17 |
|---|---|---|---|---|---|---|
| Composition (% by mass) | Base oil D19 | remainder | remainder | remainder | — | — |
| | Base oil R4 | — | — | — | remainder | remainder |
| | A2-1 (in terms of phosphorus element) | (0.05) | (0.05) | — | (0.10) | (0.05) |
| | A2-2 (in terms of phosphorus element) | — | — | (0.05) | — | — |
| | B2-1 | — | 1.5 | — | — | 1.5 |

TABLE 18-continued

| | Example 23 | Example 24 | Example 25 | Comp. Ex. 16 | Comp. Ex. 17 |
|---|---|---|---|---|---|
| B2-2 | 1.0 | — | 1.0 | 1.0 | — |
| C2-1 | 2.0 | 2.0 | 2.0 | 2.0 | 2.0 |
| C2-2 | 3.0 | 3.0 | 3.0 | 3.0 | 3.0 |
| D2-1 (in terms of calcium element) | (0.2) | — | (0.2) | (0.2) | (0.2) |
| D2-2 (in terms of calcium element) | — | (0.2) | — | — | — |
| E2-1 | 0.07 | 0.07 | — | 0.07 | 0.07 |
| F2-1 | — | — | 0.5 | — | — |
| G2-1 | 0.01 | — | — | 0.01 | 0.01 |
| H2-1 | 5.0 | 5.0 | 5.0 | 5.0 | 5.0 |
| Sulfated ash content (% by mass) | 0.88 | 0.88 | 0.78 | 1.02 | 0.89 |
| Acid value increase (mgKOH/g) | 4.4 | 4.7 | 2.9 | 5.0 | 7.7 |

As seen in Table 18, the lubricating oil compositions of Examples 23-25 all had small sulfated ash contents and acid value increases. These results show that the lubricating oil compositions of Examples 23-25 are lubricating oil compositions with sufficiently long oxidation life and capable of adequately maintaining the performance of exhaust gas after-treatment devices for long periods.

On the other hand, the lubricating oil compositions of Comparative Examples 16 and 17 all had larger sulfated ash contents and acid value increases compared to the lubricating oil compositions of Examples 23-25. In the case of the lubricating oil composition of Comparative Example 16, the sulfated ash content was high and the content of zinc dithiophosphate (A2-1) providing an oxidation preventing function was greater than in Examples 23 and 24, and yet the acid value increase was greater and a sufficient oxidation preventing property was not obtained. In the case of the lubricating oil composition of Comparative Example 17 which had a zinc dithiophosphate (A2-1) content similar to that of the lubricating oil compositions of Examples 23 and 24, the sulfated ash content was roughly the same but the acid value increase was greater and a sufficient oxidation preventing property was not obtained.

Examples 26-29, Comparative Examples 18-21

For Examples 26-29 there were prepared lubricating oil compositions having the compositions shown in Table 19, using base oil D19 and the additives listed below. For Comparative Examples 18-21 there were prepared lubricating oil compositions having the compositions shown in Table 20, using base oil R4 and the additives listed below.

(Ashless Antioxidants Containing No Sulfur as a Constituent Element)

A3-1: Alkyldiphenylamine (alkyl group: butyl group or octyl group)

A3-2: 4,4'-Methylenebis(2,6-di-tert-butylphenol)

(Ashless Antioxidant Containing Sulfur as a Constituent Element and Organic Molybdenum Compound)

B3-1: Ashless dithiocarbamate (sulfur content: 29.4% by mass)

B3-2: Molybdenum ditridecylamine complex (molybdenum content: 10.0% by mass)

(Anti-Wear Agent)

C3-1: Zinc dialkyldithiophosphate (phosphorus content: 7.2% by mass, alkyl group: mixture of secondary butyl group or secondary hexyl group)

C3-2: Zinc dialkylphosphate (phosphorus content: 10.0% by mass, alkyl group: primary octyl group)

(Ashless Dispersant)

D3-1: Polybutenylsucciniimide (number-average molecular weight of polybutenyl group: 1300, nitrogen content: 1.8% by mass)

D3-2: Boric acid-modified polybutenylsucciniimide (number-average molecular weight of polybutenyl group: 1300, nitrogen content: 1.8% by mass, boron content: 0.77% by mass)

(Metal-Based Detergents)

E3-1: Calcium salicylate

E3-2: Calcium sulfonate (Corrosion Inhibitor)

F3-1: Benzotriazole (Antifoaming Agent)

G3-1: Package containing viscosity index improver, pour point depressant and antifoaming agent.

[NOx Absorption Test]

Following the method described in Proceedings of the Japanese Society of Tribologists 1992, 10, 465, NOx-containing gas was blown into the test oil for forced aging, and the time-related changes in base value (hydrochloric acid method) and acid value were measured. The test temperature for this test was 140° C., the NOx concentration in the NOx-containing gas was 1200 ppm and the $O_2$ concentration was 85%. Tables 19 and 20 show the dynamic viscosity ratio (the values of the dynamic viscosities at 100° C. after 168 hours divided by the dynamic viscosities 100° C. of the fresh oil) and acid value increase, after 168 hours from the start of blowing in NOx gas. In the table, a smaller kinematic viscosity ratio and a smaller acid value increase indicate a longer oxidation life even in the presence of NOx used in internal combustion engines.

TABLE 19

| | | Example 26 | Example 27 | Example 28 | Example 29 |
|---|---|---|---|---|---|
| Composition (% by mass) | Base oil D19 | remainder | remainder | remainder | remainder |
| | Base oil R4 | — | — | — | — |
| | A3-1 | — | 1.5 | 1.5 | — |
| | A3-2 | 1.0 | — | — | 1.0 |

TABLE 19-continued

| | Example 26 | Example 27 | Example 28 | Example 29 |
|---|---|---|---|---|
| B3-1 (in terms of molybdenum element) | (0.07) | (0.07) | (0.07) | — |
| B3-2 (in terms of molybdenum element) | — | — | — | (0.02) |
| C3-1 (in terms of phosphorus element) | (0.10) | (0.10) | (0.10) | — |
| C3-2 (in terms of phosphorus element) | — | — | — | (0.10) |
| D3-1 | 2.0 | 2.0 | 2.0 | 2.0 |
| D3-2 | 3.0 | 3.0 | 3.0 | 3.0 |
| E3-1 (in terms of calcium element) | (0.2) | (0.2) | — | (0.2) |
| E3-2 (in terms of calcium element) | — | — | (0.2) | — |
| F3-1 | 0.01 | — | — | — |
| G3-1 | 6.4 | 6.4 | 6.4 | 6.4 |
| Kinematic viscosity at 100° C. ($mm^2/s$) | 8.6 | 8.6 | 8.6 | 8.7 |
| Viscosity index | 241 | 241 | 241 | 242 |
| Kinematic viscosity ratio | 1.4 | 1.6 | 1.7 | 1.3 |
| Acid value increase (mgKOH/g) | 9.3 | 10.5 | 11.1 | 7.3 |

TABLE 20

| | | Comp. Ex. 18 | Comp. Ex. 19 | Comp. Ex. 20 | Comp. Ex 21 |
|---|---|---|---|---|---|
| Composition (% by mass) | Base oil D19 | — | — | — | — |
| | Base oil R4 | Remainder | remainder | remainder | remainder |
| | A3-1 | — | 1.5 | 1.5 | — |
| | A3-2 | 1.0 | — | — | — |
| | B3-1 (in terms of molybdenum element) | (0.07) | (0.07) | — | (0.07) |
| | B3-2 (in terms of molybdenum element) | — | — | — | — |
| | C3-1 (in terms of phosphorus element) | (0.10) | (0.10) | (0.10) | (0.10) |
| | C3-2 (in terms of phosphorus element) | — | — | — | — |
| | D3-1 | 2.0 | 2.0 | 2.0 | 2.0 |
| | D3-2 | 3.0 | 3.0 | 3.0 | 3.0 |
| | E3-1 (in terms of calcium element) | (0.2) | (0.2) | (0.2) | (0.2) |
| | E3-2 (in terms of calcium element) | — | — | — | — |
| | F3-1 | — | — | — | — |
| | G3-1 | 6.0 | 6.0 | 6.0 | 6.0 |
| Kinematic viscosity at 100° C. ($mm^2/s$) | | 8.7 | 8.7 | 8.7 | 8.7 |
| Viscosity index | | 211 | 211 | 211 | 211 |
| Kinematic viscosity ratio | | 2.7 | 3.0 | — (test canceled) | — (test canceled) |
| Acid value increase (mgKOH/g) | | 14.2 | 15.8 | >20 (test canceled) | >20 (test canceled) |

As seen in Table 19, the lubricating oil compositions of Examples 26-29 all exhibited small values for the kinematic viscosity ratio and acid value increase in the NOx absorption test, and therefore had excellent long drain properties.

On the other hand, the lubricating oil compositions of Comparative Examples 18-21 all had larger kinematic viscosity ratios and acid value increases in the NOx absorption test compared to the lubricating oil compositions of Examples 26-29. In particular, the lubricating oil compositions of Comparative Examples 20 and 21 underwent notable deterioration in the presence of NOx, and therefore the test was canceled before 168 hours from the start of blowing in the NOx gas.

Example 30, Comparative Example 22

For Example 30 there was prepared a lubricating oil composition having the composition shown in Table 21, using base oil D19 and the additives listed below. For Comparative Example 22 there was prepared a lubricating oil composition having the composition shown in Table 21, using base oil R4 and the additives listed below.

(Ashless Antioxidant)

A4-1: Alkyldiphenylamine (alkyl group: butyl or octyl group)

A4-2: 4,4'-Methylenebis(2,6-di-tert-butylphenol)

(Ashless Dispersant)

B4-1: Polybutenylsucciniimide (number-average molecular weight of polybutenyl group: 1300, nitrogen content: 1.8% by mass)

B4-2: Boric acid-modified polybutenylsucciniimide (number-average molecular weight of polybutenyl group: 1300, nitrogen content: 1.8% by mass, boron content: 0.77% by mass)

(Phosphorus-Sulfur-Based Anti-Wear Agent)

C4-1: Zinc dialkyldithiophosphate (phosphorus content: 7.2% by mass, alkyl group: mixture of secondary butyl group or secondary hexyl group)

(Metal-Based Detergent)

D4-1: Calcium Sulfonate (Sulfur-Based Anti-Wear Agent)

E4-1: Molybdenum dithiocarbamate (Friction Modifier)

F4-1: Glycerin monooleate (Antifoaming Agent)

G4-1: Package containing viscosity index improver, pour point depressant and antifoaming agent.

[NOx Absorption Test]

Following the method described in Proceedings of the Japanese Society of Tribologists 1992, 10, 465, NOx-containing gas was blown into the test oil for forced aging, and the time-related change in production of insoluble components was measured. The test temperature for this test was 140° C., the NOx concentration in the NOx-containing gas was 1200 ppm and the $O_2$ concentration was 85%. Table 21 shows the production of insoluble components after 168 hours from the start of blowing in NOx gas.

TABLE 21

| | | Example 30 | Comp. Ex. 22 |
|---|---|---|---|
| Composition (% by mass) | Base oil D19 | remainder | — |
| | Base oil R4 | — | remainder |
| | A4-1 | 0.5 | 0.5 |
| | A4-2 | 0.8 | 0.8 |
| | B4-1 | 2.0 | 2.0 |
| | B4-2 | 3.0 | 3.0 |
| | C4-1 (in terms of phosphorus element) | (0.08) | (0.08) |
| | D4-1 (in terms of calcium element) | (0.2) | (0.2) |
| | E4-1 | 0.07 | 0.07 |
| | F4-1 | 0.5 | 0.5 |
| | G4-1 | 5.0 | 5.0 |
| Generation of insoluble components (% by mass) | | 0.04 | 3.53 |

As seen in Table 21, the lubricating oil composition of Example 30 had low production of insoluble components in the NOx absorption test, and has sufficient heat and oxidation stability for purposes such as 4-stroke internal combustion engines for two-wheel vehicles.

[Production of Lubricating Base Oil]

WAX1 shown in Table 1 was hydrocracked in the presence of a hydrocracking catalyst, under conditions with a hydrogen partial pressure of 5 MPa, a mean reaction temperature of 350° C. and an LHSV of 1 $hr^{-1}$. The hydrocracking catalyst was used as the sulfurized form of a catalyst comprising 3% by mass nickel and 15% by mass molybdenum supported on an amorphous silica-alumina support (silica:alumina=20:80 (mass ratio)).

The decomposition product obtained by the hydrocracking was subjected to vacuum distillation to obtain a lube-oil distillate at 26% by volume with respect to the feedstock oil. The lube-oil distillate was subjected to solvent dewaxing using a methyl ethyl ketone-toluene mixed solvent under conditions with a solvent/oil ratio of 4 and a filtration temperature of −25° C., to obtain lubricating base oils (base oils D20, D21 and D22) having different viscosity grades. The results of evaluation testing of the properties and performance of each lubricating base oil are shown in Table 22.

TABLE 22

| Base oil | | | D20 | D21 | D22 |
|---|---|---|---|---|---|
| Crude wax | | | WAX1 | WAX1 | WAX1 |
| Base oil composition (based on total amount of base oil) | Saturated components content % by mass | | 98.3 | 98.5 | 98.2 |
| | Aromatic components content % by mass | | 1.2 | 1.0 | 1.0 |
| | Polar compounds content % by mass | | 0.5 | 0.5 | 0.8 |
| Saturated components composition (based on total amount of saturated components) | Cyclic saturated components content % by mass | | 3.5 | 4.8 | 8.5 |
| | Acyclic saturated components content % by mass | | 96.5 | 95.2 | 91.5 |
| Acyclic saturated components composition (based on total amount of base oil) | Straight-chain paraffins content % by mass | | 0.1 | 0.1 | 0.1 |
| | Branched paraffins content % by mass | | 98.2 | 98.4 | 98.1 |
| EI-MS saturated components composition analysis | Monocyclic saturated components content % by mass | | 0.9 | 1.8 | 3.9 |
| Cyclic saturated components composition (based on total amount of saturated components) | Bicyclic saturated components content % by mass | | 1.2 | 1.7 | 3.1 |
| | Bicyclic or greater saturated components content % by mass | | 2.6 | 3.0 | 4.6 |
| | Monocyclic saturated components content/bicyclic saturated components content (mass ratio) | | 0.8 | 1.1 | 1.3 |
| | Monocyclic saturated components content/bicyclic or greater saturated components content (mass ratio) | | 0.3 | 0.6 | 0.8 |
| n-d-M Ring analysis | % $C_P$ | | 91.4 | 92.8 | 91.7 |
| | % $C_N$ | | 8.5 | 6.7 | 8.3 |
| | % $C_A$ | | 0.1 | 0.1 | 0.0 |
| | % $C_P$/% $C_N$ | | 10.75 | 13.85 | 11.05 |
| Sulfur content | | ppm by mass | <1 | <1 | <1 |
| Nitrogen content | | ppm by mass | <3 | <3 | <3 |
| Refractive index (20° C.) $n_{20}$ | | | 1.4498 | 1.4555 | 1.4610 |
| Kinematic viscosity (40° C.) | | $mm^2/s$ | 10.3 | 16.9 | 34.6 |
| Kinematic viscosity (100° C.) kv100 | | $mm^2/s$ | 2.9 | 4.0 | 6.6 |

TABLE 22-continued

| | | | | | |
|---|---|---|---|---|---|
| Viscosity index | | | 125 | 140 | 150 |
| $n_{20} - 0.002 \times kv100$ | | | 1.4440 | 1.4475 | 1.4478 |
| Density (15° C.) | | g/cm$^3$ | 0.810 | 0.820 | 0.825 |
| Pour point | | ° C. | −25 | −25 | −15 |
| Iodine value | | | 0.79 | 0.61 | 0.48 |
| Aniline point | | ° C. | 110 | 120 | 124 |
| Distillation properties | IBP[° C.] | ° C. | 323 | 363 | 415 |
| | T10[° C.] | ° C. | 355 | 390 | 450 |
| | T50[° C.] | ° C. | 382 | 435 | 483 |
| | T90[° C.] | ° C. | 425 | 475 | 500 |
| | FBP[° C.] | ° C. | 470 | 502 | 536 |
| CCS viscosity (−35° C.) | | mPa · s | <1000 | 1980 | 14800 |
| NOACK evaporation amount (250° C., 1 hr) | | % by mass | 35.3 | 13.2 | 2.4 |
| RBOT life (150° C.) | | min | 347 | 392 | 451 |

Examples 31-33, Comparative Examples 24-26

Preparation of Lubricating Oil Composition for Automatic Transmission

For Examples 31-33 there were prepared lubricating oil compositions having the compositions shown in Table 23, using base oils D20 and D21, and base oil R13 and additives A5-1, A5-2, B5-1 and C5-1 listed below. For Comparative Examples 24-26 there were prepared lubricating oil compositions having the composition shown in Table 24, using base oil RI shown in Table 7 and base oil R4 shown in Table 8, and base oil R13 and additives A5-1, A5-2, B5-1 and C5-1 listed below. The dynamic viscosities at 40° C. and 100° C., viscosity indexes and phosphorus contents of the obtained lubricating oil compositions are shown in Tables 23 and 24.

(Base Oils)

Base oil R13: Paraffinic solvent refined base oil (saturated components content: 60.1% by mass, aromatic components content: 35.7% by mass, resin components content: 4.2% by mass, sulfur content: 0.51% by mass, kinematic viscosity at 100° C.: 32 mm$^2$/s, viscosity index: 95)

(Viscosity Index Improvers)

A5-1: Non-dispersant polymethacrylate (copolymer of monomer mixture composed mainly of monomer of general formula (18) wherein $R^{54}$ is methyl or a C12-C15 straight-chain alkyl group, weight-average molecular weight: 25,000)

A5-2: Dispersant polymethacrylate (copolymer of monomer mixture composed mainly of monomer of general formula (18) wherein $R^{54}$ is methyl or a C12, C14, C16 or C18 straight-chain alkyl group, and containing a nitrogen-containing monomer represented by general formula (55) or (56), weight-average molecular weight: 40,000)

(Phosphorus-Containing Compound)

B5-1: Mixture of phosphorous acid and phosphorous acid ester (Package Additive)

C5-1: Package additive (additive amount to lubricating oil composition: 12.5% by mass, ashless dispersant in lubricating oil composition: 4.0% by mass, alkaline earth metal sulfonate: 0.01% by mass (in terms of alkaline earth metal element), corrosion inhibitor: 0.1% by mass, antioxidant: 0.2% by mass, friction modifier: 3.5% by mass, rubber swelling agent: 1.0% by mass, antifoaming agent: 0.003% by mass, diluent: remainder)

The following evaluation test was then conducted using the lubricating oil compositions for an automatic transmission of Examples 31-33 and Comparative Examples 24-26.

[Cold Flow Property Test]

The BF viscosity at −40° C. of each of the lubricating oil compositions was then measured according to ASTM D 2983. The obtained results are shown in Tables 23 and 24. For this test, a lower BF viscosity value represents a superior cold flow property.

[Shear Stability Test]

An ultrasonic shearing test was conducted under the following conditions according to JASO M347-95, and the kinematic viscosity at 100° C. of each lubricating oil composition was measured after the test. The obtained results are shown in Tables 23 and 24. For this test, a lower viscosity and a higher kinematic viscosity at 100° C. after ultrasonic shearing indicates superior shear stability.

(Test Conditions)

Test oil volume: 30 ml

Ultrasonic frequency: 10 kHz

Test oil temperature: 40° C.

Test time: 1 hour

[Wear Resistance Test]

A four ball test was conducted under the following conditions according to JPI-5S-32-90, and the wear scar diameter after the test was measured. The obtained results are shown in Tables 23 and 24. In this test, a smaller wear scar diameter indicates more excellent wear resistance.

(Test Conditions)

Rotation speed: 1800 rpm

Load: 392 N

Test oil temperature: 75° C.

Test time: 1 hour

[Heat and Oxidation Stability Test]

First, the acid value of each lubricating oil composition was measured. Next, each lubricating oil composition was subjected to forced aging under conditions of 165° C., 144 hours by ISOT according to JIS K 2514 and the acid value thereof was measured, and the increase amount in acid value from the measured acid values before and after the test. The obtained results are shown in Tables 23 and 24. For this test, a lower change in acid value indicates superior heat and oxidation stability.

TABLE 23

| | | Example 31 | Example 32 | Example 33 |
|---|---|---|---|---|
| Lubricating base oil composition | Base oil D20 | 35 | 35 | 75 |
| [% by mass] | Base oil D21 | 65 | 65 | 15 |
| | Base oil R13 | — | — | 10 |

TABLE 23-continued

| | | Example 31 | Example 32 | Example 33 |
|---|---|---|---|---|
| Kinematic viscosity of lubricating base oil [$mm^2/s$] | 40° C. | 14.1 | 14.1 | 14.3 |
| | 100° C. | 3.6 | 3.6 | 3.6 |
| Viscosity index of lubricating base oil | | 138 | 138 | 136 |
| Composition of lubricating oil composition [% by mass] | Base oil | Remainder | remainder | Remainder |
| | A5-1 | 6.9 | — | 6.5 |
| | A5-2 | — | 7.0 | — |
| | B5-1 (in terms of phosphorus element) | 0.03 | 0.03 | 0.03 |
| | C5-1 | 12.5 | 12.5 | 12.5 |
| Kinematic viscosity of lubricating oil composition [$mm^2/s$] | 40° C. | 25.3 | 28.8 | 25.8 |
| | 100° C. | 5.8 | 6.8 | 5.8 |
| Viscosity index of lubricating oil composition | | 183 | 209 | 180 |
| Phosphorus content of lubricating oil composition [% by mass] | | 0.03 | 0.03 | 0.03 |
| Cold flow property (BF viscosity at −40° C. [mPa · s]) | | 5800 | 6800 | 7600 |
| Shear stability (Kinematic viscosity at 100° C. [$mm^2/s$]) | | 5.6 | 6.5 | 5.6 |
| Antiwear property (Wear scar diameter [mm]) | | 0.44 | 0.44 | 0.45 |
| Heat andoxidation stability (Acid value increase [mgKOH/g]) | | 1.24 | 1.26 | 1.35 |

TABLE 24

| | | Comp. Ex. 24 | Comp. Ex. 25 | Comp. Ex. 26 |
|---|---|---|---|---|
| Lubricating base oil composition [% by mass] | Base oil R13 | — | — | 10 |
| | Base oil R1 | 25 | 25 | 55 |
| | Base oil R4 | 75 | 75 | 35 |
| Kinematic viscosity of lubricating base oil [$mm^2/s$] | 40° C. | 15.5 | 15.5 | 15.8 |
| | 100° C. | 3.6 | 3.6 | 3.6 |
| Viscosity index of lubricating base oil | | 118 | 118 | 115 |
| Composition of lubricating oil composition [% by mass] | Base oil | Remainder | remainder | remainder |
| | A5-1 | 6.6 | — | 5.9 |
| | A5-2 | — | 6.8 | — |
| | B5-1 (in terms of phosphorus element) | 0.03 | 0.03 | 0.03 |
| | C5-1 | 12.5 | 12.5 | 12.5 |
| Kinematic viscosity of lubricating oil composition [$mm^2/s$] | 40° C. | 27.2 | 30.8 | 27.6 |
| | 100° C. | 5.8 | 6.8 | 5.8 |
| Viscosity index of lubricating oil composition | | 162 | 190 | 159 |
| Phosphorus content of lubricating oil composition [% by mass] | | 0.03 | 0.03 | 0.03 |
| Cold flow property (BF viscosity at −40° C. [mPa · s]) | | 10500 | 13200 | 14300 |
| Shear stability (Kinematic viscosity at 100° C. [$mm^2/s$]) | | 5.4 | 6.3 | 5.5 |
| Antiwear property (Wear scar diameter [mm]) | | 0.52 | 0.50 | 0.49 |
| Heat and oxidation stability (Acid value increase [mgKOH/g]) | | 1.82 | 1.68 | 2.01 |

Examples 34 and 35, Comparative Examples 27 and 28

Preparation of Lubricating Oil Compositions for Manual Transmission

For Examples 34 and 35 there were prepared lubricating oil compositions having the compositions shown in Table 25, using base oils D21 and D22 and additive A5-1, and additives A5-3, B5-2 and C5-2 listed below. For Comparative Examples 27 and 28 there were prepared lubricating oil compositions having the compositions shown in Table 25, using base oil R4 in Table 8 and additive A1 shown, and base oil R7 in Table 9 and additives A5-3, B5-2 and C5-2 shown. The dynamic viscosities at 40° C. and 100° C., viscosity indexes and phosphorus contents of the obtained lubricating oil compositions are shown in Table 6.

(Viscosity Index Improver)

A5-3: Non-dispersant polymethacrylate (copolymer of monomer mixture composed mainly of monomer of general formula (5) wherein $R^1$ is methyl or a C12, 14, 16 or 18 straight-chain alkyl group, weight-average molecular weight: 60,000)

(Phosphorus-Containing Compound)

B5-2: Zinc dialkyldithiophosphate (mixture of Pri-ZDTP and Sec-ZDTP)

(Package additive)

C5-2: Package additive (additive amount to lubricating oil composition: 6.0% by mass, alkaline earth metal sulfonate in lubricating oil composition: 0.25% by mass (in terms of alkaline earth metal element), corrosion inhibitor: 0.1% by mass, antioxidant: 0.5% by mass, friction modifier: 1.0% by mass, rubber swelling agent: 0.5% by mass, antifoaming agent: 0.001% by mass, diluent: remainder)

Next, each of the lubricating oil compositions for a manual transmission of Examples 34 and 35 and Comparative Examples 27 and 28 were subjected to the same test as for the lubricating oil compositions for an automatic transmission of Examples 31-33 and Comparative Examples 24-26, and the cold flow property, shear stability and wear resistance of each was evaluated. The results are shown in Table 6.

TABLE 25

| | | Example 34 | Example 35 | Comp. Ex. 27 | Comp. Ex. 28 |
|---|---|---|---|---|---|
| Lubricating base oil composition [% by mass] | Base oil D21 | 75 | 75 | — | — |
| | Base oil 22 | 25 | 25 | — | — |
| | Base oil R4 | — | — | 78 | 78 |
| | Base oil R7 | — | — | 22 | 22 |
| Kinematic viscosity of lubricating base oil [mm²/s] | 40° C. | 20.2 | 20.2 | 21.6 | 21.6 |
| | 100° C. | 4.5 | 4.5 | 4.5 | 4.5 |
| Viscosity index of lubricating base oil | | 143 | 143 | 124 | 124 |
| Composition of lubricating oil composition [% by mass] | Base oil | remainder | remainder | remainder | remainder |
| | A5-1 | 4.0 | | 4.0 | |
| | A5-3 | | 15.4 | | 15.4 |
| | B5-2 (in terms of phosphorus element) | 0.11 | 0.11 | 0.11 | 0.11 |
| | C5-2 | 6.0 | 6.0 | 6.0 | 6.0 |
| Kinematic viscosity of lubricating oil composition [mm²/s] | 40° C. | 28.0 | 58.5 | 29.7 | 63.0 |
| | 100° C. | 6.1 | 12.8 | 6.1 | 13.0 |
| Viscosity index of lubricating oil composition | | 173 | 225 | 160 | 212 |
| Phosphorus content of lubricating oil composition [% by mass] | | 0.11 | 0.11 | 0.11 | 0.11 |
| Cold flow property (BF viscosity at −40° C. [mPa · s]) | | 7900 | 14500 | 15200 | 41000 |
| Shear stability (Kinematic viscosity at 100° C. [mm²/s]) | | 5.9 | 12.0 | 5.8 | 11.5 |
| Antiwear property (Wear scar diameter [mm]) | | 0.37 | 0.34 | 0.44 | 0.37 |

The invention claimed is:

1. A lubricating base oil comprising saturated components of 97% by mass or greater, wherein the proportion of cyclic saturated components among the saturated components is not greater than 40% by mass, an iodine value of not greater than 2.5, wherein the kinematic viscosity at 100° C., the viscosity index and the pour point of the lubricating base oil are in a combination chosen from (a) a kinematic viscosity at 100° C. ranging from 2.0-3.0 mm²/s, a viscosity index ranging from 110-135, and a pour point not greater than −15° C., (b) a kinematic viscosity at 100° C. ranging from 3.0-4.5 mm²/s, a viscosity index ranging from 135-150, and a pour point not greater than −17.5° C., and (c) a kinematic viscosity at 100° C. ranging from 4.5-20 mm²/s, a viscosity index ranging from 110-135, and a pour point not greater than −12.5° C., wherein the mass ratio of monocyclic saturated components and bicyclic or greater saturated components among the cyclic saturated components satisfies the condition represented by the following inequality:

$$M_A/M_B \leqq 3$$

wherein $M_A$ represents the mass of monocyclic saturated components and $M_B$ represents the mass of bicyclic or greater saturated components.

2. A lubricating base oil according to claim 1, wherein the proportion of bicyclic or greater saturated components among the saturated components is 0.1% by mass or greater.

3. A lubricating base oil according to claim 1, having an aromatic components content of 0.1-7% by mass.

4. A lubricating base oil according to claim 1, wherein the proportion of branched paraffins in the lubricating base oil is 54-99% by mass.

5. A lubricating oil composition comprising a lubricating base oil according to claim 1, wherein a MRV viscosity at −40° C. is 20,000 mPa·s or lower.

6. A lubricating oil composition for an internal combustion engine, comprising:

a lubricating base oil according to claim 1, a phosphorus-based anti-wear agent of 0.02-0.08% by mass in terms of phosphorus element, an ashless antioxidant of 0.5-3% by mass, and an ashless dispersant of 3-12% by mass, based on the total amount of the composition.

7. A lubricating oil composition for an internal combustion engine according to claim 6, being used as a lubricating oil in an internal combustion engine for a vehicle with an exhaust gas aftertreatment device, and having a sulfated ash content of 1.2% by mass or less.

8. A lubricating oil composition for an internal combustion engine comprising:

a lubricating base oil according to claim 1, an ashless antioxidant containing no sulfur as a constituent element, and at least one compound selected from among ashless antioxidants containing sulfur as a constituent element and organic molybdenum compounds.

9. A lubricating oil composition for a wet clutch comprising:

a lubricating base oil according to claim 1, an ashless antioxidant of 0.5-3% by mass, and an ashless dispersant of 3-12% by mass, based on the total amount of the composition.

10. A lubricating oil composition for a drive-train comprising:

a lubricating base oil according to claim 1, a poly(meth)acrylate-based viscosity index improver and a phosphorus-containing compound.

11. A lubricating oil composition for a drive-train according to claim 10, wherein the proportion of bicyclic or greater saturated components among the saturated components in the lubricating base oil is 3% by mass or greater.

* * * * *